US011771961B2

(12) United States Patent
Brubaker et al.

(10) Patent No.: US 11,771,961 B2
(45) Date of Patent: Oct. 3, 2023

(54) GOLF CLUB HEAD WITH LATTICES

(71) Applicant: KARSTEN MANUFACTURING CORPORATION, Phoenix, AZ (US)

(72) Inventors: Cole D. Brubaker, Scottsdale, AZ (US); Alex G. Woodward, Phoenix, AZ (US); Erik M. Henrikson, Phoenix, AZ (US)

(73) Assignee: KARSTEN MANUFACTURING CORPORATION, Phoenix, AZ (US)

( * ) Notice: Subject to any disclaimer, the term of this patent is extended or adjusted under 35 U.S.C. 154(b) by 0 days.

(21) Appl. No.: 17/447,690

(22) Filed: Sep. 14, 2021

(65) Prior Publication Data

US 2022/0080270 A1 Mar. 17, 2022

Related U.S. Application Data

(60) Provisional application No. 63/078,257, filed on Sep. 14, 2020.

(51) Int. Cl.
*A63B 53/04* (2015.01)

(52) U.S. Cl.
CPC ..... *A63B 53/0412* (2020.08); *A63B 53/047* (2013.01); *A63B 53/0487* (2013.01); *A63B 2209/00* (2013.01)

(58) Field of Classification Search
CPC ..... A63B 53/0412; A63B 53/0487; A63B 53/047; A63B 2209/00
USPC ..... 473/324–350, 287–292
See application file for complete search history.

(56) References Cited

U.S. PATENT DOCUMENTS 3,847,399 A * 11/1974 Raymont ..... A63B 53/0466 473/350
4,664,383 A * 5/1987 Aizawa ..... A63B 60/00 273/DIG. 7
4,679,792 A * 7/1987 Straza ..... A63B 53/0487 473/331
5,244,211 A 9/1993 Lukasiewicz
5,301,941 A * 4/1994 Allen ..... A63B 53/0466 164/34

(Continued)

OTHER PUBLICATIONS

Filling in Undercut Cavity—What Material Would You Use? https://forums.golfwrx.com/topic/1443104-filling-in-undercut-cavity-what-material-would-you-use/ Oct. 6, 2017.

*Primary Examiner* — Sebastiano Passaniti

(57) ABSTRACT

Embodiments of a golf club head with an internal lattice structure are described herein. The golf club head can be an iron or putter-type club head. The lattice structure can have varying beam thicknesses that correlate to the effective density profile of the lattice. The effective density of the lattice structure can range between 0 g/mm$^3$ and 0.0075 g/mm$^3$, achieving beneficial product of inertia values for irons and a forward CG location for a putters. For irons, an Ixy product of inertia can be greater than or equal to −40 g·in$^2$. An Ixz product of inertia can be less than or equal to −25 g·in$^2$, resulting in improved sidespin for high and low face impacts. The lattice structure can concentrate mass into a high-toe and a low-heel quadrant or region of the iron to achieve the product of inertia values. Other embodiments may be described and claimed.

21 Claims, 40 Drawing Sheets

(56) References Cited

U.S. PATENT DOCUMENTS 5,401,021 A * 3/1995 Allen ..... A63B 53/047 473/291
5,447,311 A 9/1995 Viollaz et al.
5,540,436 A 7/1996 Boone
5,547,426 A * 8/1996 Wood ..... A63B 53/047 473/290
5,735,755 A * 4/1998 Kobayashi ..... A63B 53/04 473/331
6,231,458 B1 * 5/2001 Cameron ..... A63B 53/0487 473/332
6,290,609 B1 * 9/2001 Takeda ..... A63B 53/047 473/335
6,409,612 B1 6/2002 Evans et al.
6,425,832 B2 * 7/2002 Cackett ..... A63B 53/02 473/348
6,435,981 B2 * 8/2002 Naruo ..... A63B 53/047 473/345
6,547,676 B2 * 4/2003 Cackett ..... B29C 70/342 473/348
6,663,503 B1 12/2003 Kenmi
6,688,989 B2 2/2004 Best
6,699,140 B1 * 3/2004 Sun ..... A63B 53/0487 473/332
6,835,144 B2 12/2004 Best
6,932,716 B2 * 8/2005 Ehlers ..... A63B 53/047 473/340
6,958,019 B2 * 10/2005 Rohrer ..... A63B 60/02 473/251
RE39,178 E * 7/2006 Allen ..... A63B 53/04 473/332
7,137,903 B2 11/2006 Best et al.
7,338,397 B2 3/2008 Mizek et al.
7,527,565 B1 * 5/2009 Ehlers ..... C08G 18/10 473/345
7,938,738 B2 5/2011 Roach
8,007,373 B2 * 8/2011 Soracco ..... A63B 60/00 473/349
8,070,623 B2 * 12/2011 Stites ..... A63B 53/0466 473/346
8,235,833 B2 8/2012 Best et al.
8,366,566 B1 2/2013 Rollinson
8,480,515 B2 7/2013 Roach et al.
8,657,701 B2 * 2/2014 Boyd ..... A63B 60/00 473/346
8,814,725 B2 8/2014 Wahl et al.
9,089,747 B2 * 7/2015 Boyd ..... A63B 60/54
9,216,327 B2 * 12/2015 Morin ..... A63B 60/00
9,220,959 B2 12/2015 Roach et al.
9,662,549 B2 5/2017 Vrska et al.
9,675,852 B2 6/2017 Kronenberg et al.
9,731,170 B2 8/2017 Franklin et al.
9,764,208 B1 9/2017 Roach et al.
9,795,839 B2 * 10/2017 Greensmith ..... A63B 60/02
9,937,388 B2 * 4/2018 Cardani ..... A63B 53/04
10,052,535 B1 7/2018 Westrum
10,406,410 B2 3/2019 Parsons et al.
10,322,320 B2 * 6/2019 Morales ..... B23K 20/023
10,625,126 B2 4/2020 Demkowski et al.
10,646,757 B2 5/2020 Dipert et al.
10,949,375 B2 3/2021 Khan et al.
10,967,232 B2 * 4/2021 Woodward ..... A63B 53/0462
11,020,639 B2 7/2021 Golden et al.
11,511,166 B1 * 11/2022 Roach ..... A63B 53/04
2003/0022729 A1 1/2003 Pergande et al.
2005/0003903 A1 * 1/2005 Galloway ..... A63B 53/04 473/342
2005/0014573 A1 1/2005 Lee
2005/0209023 A1 9/2005 Tseng
2005/0266931 A1 12/2005 Hou et al.
2007/0178988 A1 8/2007 Tavares
2007/0281796 A1 12/2007 Gilbert et al.
2009/0291774 A1 11/2009 Bennett
2010/0267466 A1 * 10/2010 Stites ..... A63B 53/04 473/282
2010/0267467 A1 * 10/2010 Stites ..... A63B 60/02 473/324
2012/0322575 A1 12/2012 Tavares et al.
2013/0072321 A1 * 3/2013 Morales ..... B23K 20/233 228/159
2014/0274458 A1 * 9/2014 Kronenberg ..... A63B 60/46 700/106
2016/0263449 A1 * 9/2016 Morales ..... B23K 20/021
2018/0221724 A1 8/2018 Westrum et al.
2020/0139207 A1 5/2020 Taylor et al.
2020/0353321 A1 11/2020 Grenier et al.
2021/0008423 A1 1/2021 Golden et al.
2021/0113897 A1 4/2021 Halberg et al.
2021/0154535 A1 5/2021 Morales et al.
2021/0402266 A1 * 12/2021 Schweigert ..... A63B 60/02

* cited by examiner

GOLF CLUB HEAD WITH LATTICES

RELATED APPLICATIONS

This claims the benefit to U.S. Provisional Application No. 63/078,257 filed on Sep. 14, 2020, the contents of which are incorporated herein by reference.

FIELD

The present disclosure relates generally to golf equipment, and more particularly, to iron and putter golf club heads methods to manufacture the same.

BACKGROUND

Described herein are iron and putter-type golf club heads. The forgiveness of an iron-type golf club head corresponds to the moment of inertia (MOT) values of the club head. A higher MOT will result in greater shot accuracy for off-center strikes on the face of the club head, particularly strikes made closer to the heel or toe ends of the face. Furthermore, off-axis moment of inertia values, often called products of inertia (POI), affect the sidespin response for strikes made closer to the top rail or sole. Often, iron-type golf club head bodies are formed from a single material that comprises a uniform density throughout. However, in some iron designs, the MOT is increased by employing multiple materials in a single head design or attaching high-density weights to the periphery of the club head. However, these means of positioning mass are limited in their ability to increase MOT, approach optimal POI, and desirably place the center of gravity (CG). There is a need in the art for an iron-type golf club head that can achieve a high MOT for forgiveness and a desirable POI for sidespin benefits, all without compromising durability.

Similar to iron-type club heads, putters often comprise solid bodies formed from a single material. The performance of a putter can be quantified by horizontal launch angle, which correlates to the offline movement of the ball during a putt. The horizontal launch angle can be affected by the position of the center of gravity (CG) of the putter head. Positioning the CG within a putter can be achieved by shifting mass. To shift mass, material must be added to the perimeter or removed from the center. There is a need in the art for an iron-type golf club head that can achieve a high MOT and a beneficial CG position, all without compromising durability.

Figure 1:
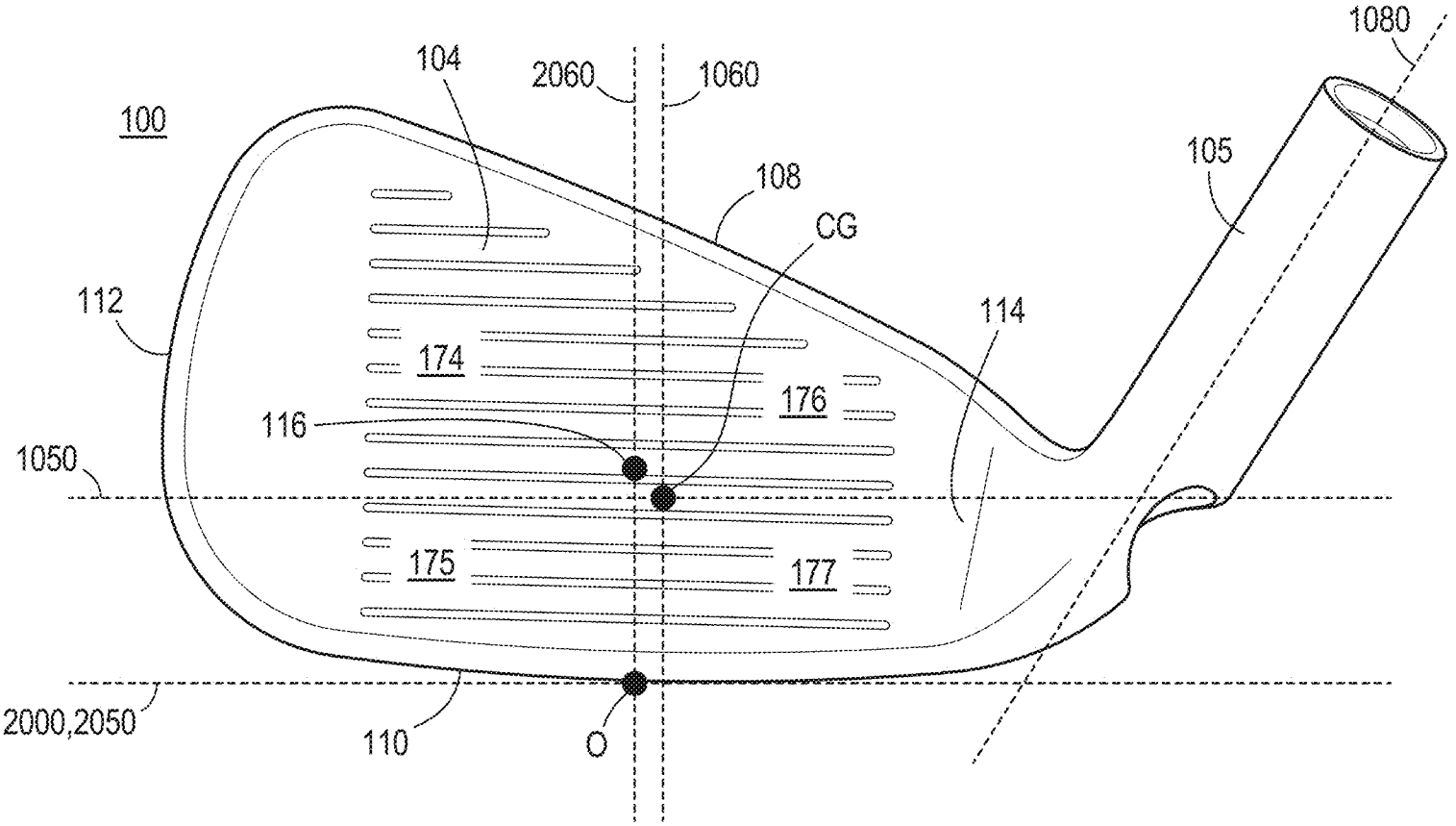
FIG. 1 illustrates a front view of an iron-type club head comprising a lattice structure, according to one embodiment.
Figure 2:
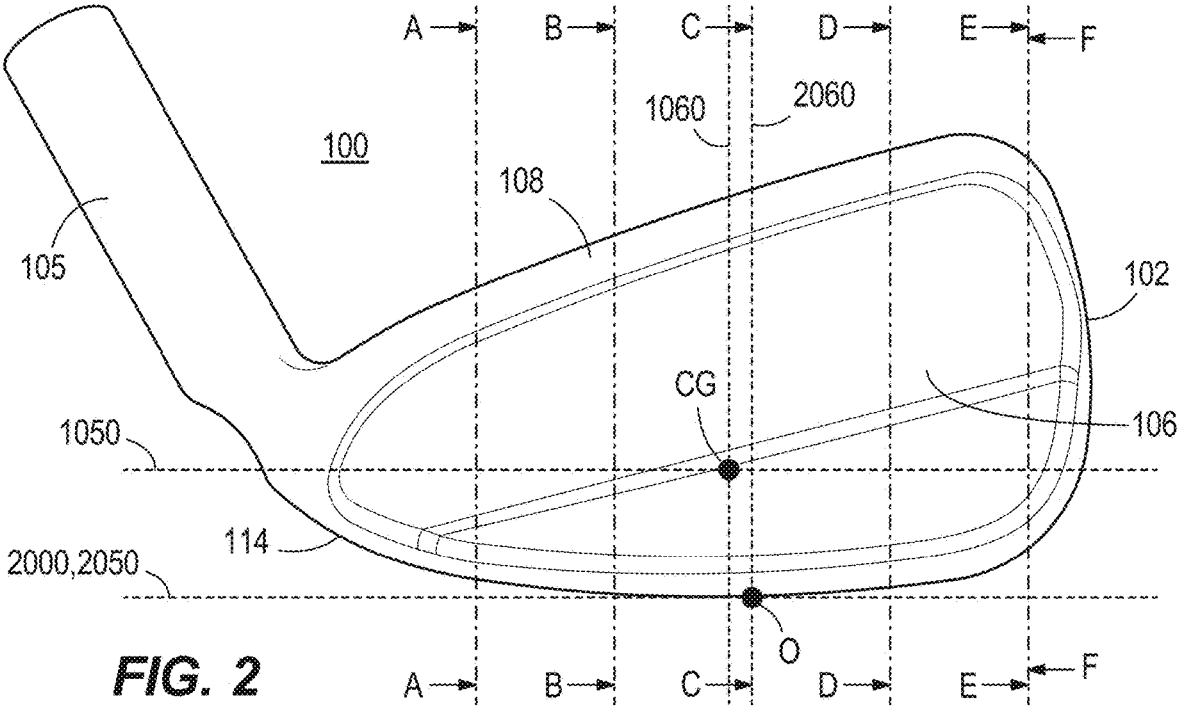
FIG. 2 illustrates a rear view of the iron-type club head of FIG. 1.
Figure 3:
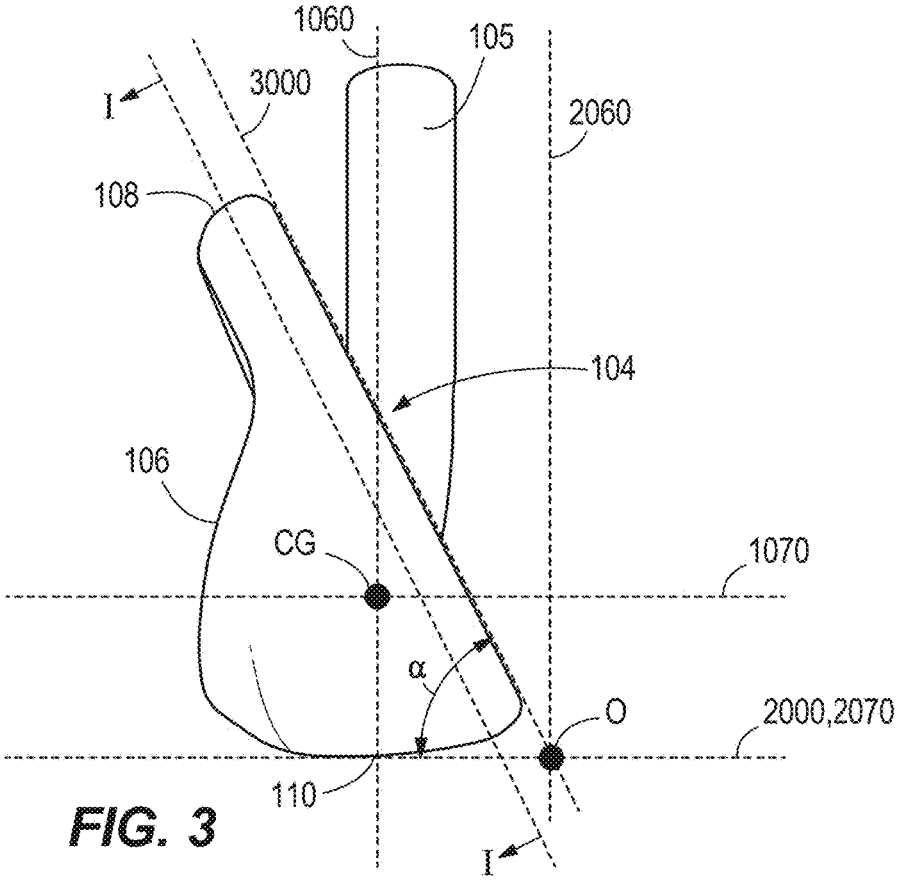
FIG. 3 illustrates a toe-side view of the iron-type club head of FIG. 1.

The golf club heads described herein comprise a lattice structure that allows a golf club head to consistently achieve high MOI values, desirable POI values, and/or a beneficial CG position. A body of the golf club head can comprise an internal cavity that can be occupied by the lattice structure, which strategically distributes mass to reduce sidespin on high and low mis-hits on irons and reduce horizontal launch angle on heel and toe mis-hits on putters.

For the iron-type club heads, described herein, a lattice structure can occupy an internal cavity and distribute mass, creating a variable density profile within the cavity that achieves Ixy and Ixz product of inertia (POI) values that improve by 15%-50% and 5%-45%, respectively, over a similar club head lacking the lattice structure. The variable density lattice structure allows mass to be increased or reduced in different quadrants or regions of the club head to provide a desired asymmetry. More specifically, the iron-type golf club head can be weighted in high-toe and low-heel regions, by increasing the beam thickness of the lattice structure within those quadrants or regions. The beam thickness of each lattice unit correlates to an effective density of the lattice unit. In some designs, the beam thickness, and thus effective density, is varied in one or more of a sole-to-top rail direction and a front-to-rear direction. The effective density profile of the lattice structure, across the internal cavity, can cause the club head to functionally achieve an Ixy product of inertia value between $-10\ g{\cdot}in^2$ and $-40\ g{\cdot}in^2$ and an Ixz product of inertia value between $-45\ g{\cdot}in^2$ and $-65\ g{\cdot}in^2$. These POI values can reduce sidespin by up to 40% on mis-hits above and below the center of the strike-face.

For the putter-type club heads, described herein, particularly mallets and mid-mallets, a lattice structure can at least partially occupy an internal cavity, distributing mass forward and away from a baseline center of gravity (CG'), which is where the center of gravity would be located without the inclusion of the lattice structure. A portion of the internal cavity can be void of the lattice structure. This void can be defined as a central reference shape. By increasing the size of the central reference shape (void), the lattice structure can be pushed further towards the perimeter of the club head, thus increasing the moment of inertia (MOI) values. By shifting the central reference shape (void) rearwards, more of the lattice structure and golf club head material can be positioned towards the face, moving the center of gravity (CG) forward.

By using a lattice structure to move the CG forwards, the gearing effect on heel and toe off-center impacts is reduced. The reduction of gearing leads to a smaller horizontal launch angle and, therefore, straighter putts. For example, in a mallet type club head, the inclusion of a lattice structure that pushes the CG forward and towards the periphery of the club head (away from the CG) can reduce the magnitude of the horizontal launch angle, compared to a similar mallet club head lacking a lattice structure. Therefore, the mallet and mid-mallet-type golf club heads, described herein, can achieve straighter putts by approaching the minimal horizontal launch angles of blade-type putters, while retaining the highly valued feel, appearance, and sound qualities of mallet and mid-mallet-type putters. Any of the putter-type club heads described herein can be designed with a center of gravity position that favors a certain putt stroke type.

Definitions

The term "strikeface," as used herein, can refer to a club head front surface that is configured to strike a golf ball. The strikeface is sometimes referred to simply as the "face."

The term "strikeface perimeter," as used herein, can refer to an edge of the strikeface. The strikeface perimeter can be located along an outer edge of the strikeface where the curvature deviates from a bulge and/or roll of the strikeface.

The term "face height," as used herein, can refer to a distance measured parallel to loft plane between a top end of the strikeface perimeter and a bottom end of the strikeface perimeter.

The term "geometric centerpoint," as used herein, can refer to a geometric centerpoint of the strikeface perimeter, and at a midpoint of the face height of the strikeface. In the same or other examples, the geometric centerpoint also can be centered with respect to an engineered impact zone, which can be defined by a region of grooves on the strikeface. As another approach, the geometric centerpoint of the strikeface can be located in accordance with the definition of a golf governing body such as the United States Golf Association (USGA). For example, the geometric centerpoint of the strikeface can be determined in accordance with Section 6.1 of the USGA's Procedure for Measuring the Flexibility of a Golf Clubhead (USGA-TPX3004, Rev. 1.0.0, May 1, 2008) (available at http://www.usga.org/equipment/testing/protocols/Procedure-For-Measuring-The-Flexibility-Of-A-Golf-Club-Head/) (the "Flexibility Procedure").

The term "center" of the face (or "face center"), as used herein, can refer to a point on the face that is a projection of the CG, wherein the center and the CG lie on a common line that is approximately perpendicular to the loft plane (as defined below). Shots that impact above the face center cause dynamic lofting. Shots that impact below the face center cause dynamic de-lofting.

The term "center region," as used herein, can refer to a region of the strikeface that is located both in front of and above the CG. In other words, a vertical line (along the Y-axis, as defined below) extending up from the CG and a horizontal line (along the X-axis, as defined below) extending forward from the CG towards the strikeface intersect the strikeface at the boundary of the center region. The center region extends from an end of the strikeface near the toe to an opposite end of the strikeface near the heel.

The term "ground plane," as used herein, can refer to a reference plane associated with the surface on which a golf ball is placed.

The term "loft plane," as used herein, can refer to a reference plane that is tangent to the geometric centerpoint of the strikeface.

The term "loft angle," as used herein, can refer to an angle measured between the ground plane and the loft plane.

The term "lie angle," as used herein, can refer to an angle between a hosel axis, extending through the hosel, and the ground plane. The lie angle is measured from a front view.

The term "iron," as used herein, can, in some embodiments, refer to an iron-type golf club head having a loft angle that is less than approximately 50 degrees, less than approximately 49 degrees, less than approximately 48 degrees, less than approximately 47 degrees, less than approximately 46 degrees, less than approximately 45 degrees, less than approximately 44 degrees, less than approximately 43 degrees, less than approximately 42 degrees, less than approximately 41 degrees, or less than approximately 40 degrees. Further, in many embodiments, the loft angle of the club head is greater than approximately 16 degrees, greater than approximately 17 degrees, greater than approximately 18 degrees, greater than approximately 19 degrees, greater than approximately 20 degrees, greater than approximately 21 degrees, greater than approximately 22 degrees, greater than approximately 23 degrees, greater than approximately 24 degrees, or greater than approximately 25 degrees.

In many embodiments, such as game improvement irons or regular irons, the volume of the club head is less than approximately 65 cc, less than approximately 60 cc, less than approximately 55 cc, or less than approximately 50 cc. In some embodiments, the volume of the club head can be approximately 50 cc to 60 cc, approximately 51 cc-53 cc, approximately 53 cc-55 cc, approximately 55 cc-57 cc, or approximately 57 cc-59 cc.

In many embodiments, such as for tour irons, the volume of the club head is less than approximately 45 cc, less than approximately 40 cc, less than approximately 35 cc, or less than approximately 30 cc. In some embodiments, the volume of the club head can be approximately 31 cc-38 cc (1.9 cubic inches to 2.3 cubic inches), approximately 31 cc-33 cc, approximately 33 cc-35 cc, approximately 35 cc-37 cc, or approximately 37 cc-39 cc.

In some embodiments, the iron can comprise a total mass ranging between 180 grams and 260 grams, 190 grams and 240 grams, 200 grams and 230 grams, 210 grams and 220 grams, or 215 grams and 220 grams. In some embodiments, the total mass of the club head is 215 grams, 216 grams, 217 grams, 218 grams, 219 grams, or 220 grams.

The term "putter," can, in some embodiments, refer to a putter-type club head having a loft angle less than 10 degrees. In many embodiments, the loft angle of the putter can be between 0 and 5 degrees, between 0 and 6 degrees, between 0 and 7 degrees, or between 0 and 8 degrees. For example, the loft angle of the club head can be less than 10 degrees, less than 9 degrees, less than 8 degrees, less than 7 degrees, less than 6 degrees, or less than 5 degrees. For further example, the loft angle of the club head can be 0 degrees, 1 degree, 2 degrees, 3 degrees, 4 degrees, 5 degrees, 6 degrees, 7 degrees, 8 degrees, 9 degrees, or 10 degrees. The putter-type golf club head can be a blade type putter, a mid-mallet type putter, a mallet type putter. It should be understood that the principles and structures described for the mid-mallet type putter can be applied in a blade type putter and/or a mallet type putter without departing from the scope of this disclosure.

In some embodiments, the putter can be a mid-mallet type club head comprising a total mass ranging between 320 grams and 400 grams, 330 grams and 390 grams, 340 grams and 380 grams, 350 grams and 380 grams, or 365 grams and 370 grams. In some embodiments, the total mass of the club head is 365 grams, 366 grams, 367 grams, 368 grams, 369 grams, or 370 grams.

The term "golf club head," as used herein, can refer to a golf club element comprising a face, a sole, a crown or top rail, a toe end, and a heel end. The golf club head can also comprise an external surface and an internal surface. The internal surface bounds an interior cavity or hollow portion. The lattice structures and benefits described herein with respect to the golf club head are not intended to apply to wood-type club heads, such as driver, fairway, or hybrid-type golf club heads.

The golf club head comprises a coordinate system centered about the center of gravity. The coordinate system comprises an X-axis, a Y-axis, and a Z-axis. The X-axis extends in a heel-to-toe direction. The X-axis is positive towards the heel and negative towards the toe. The Y-axis extends in a sole-to-crown direction and is orthogonal to both the Z-axis and the X-axis. The Y-axis is positive towards the crown and negative towards the sole. The Z-axis extends front-to-rear, parallel to the ground plane and is orthogonal to both the X-axis and the Y-axis. The Z-axis is positive towards the front and negative towards the rear.

The golf club head further comprises a secondary coordinate system, centered about an origin point just off a leading edge of the strikeface. The origin point is located where the loft plane intersects the ground plane. The origin point is also within a vertical, front-to-rear plane that intersects the geometric centerpoint of the strikeface and is perpendicular to the ground plane. This secondary coordinate system comprises an X'-axis, a Y'-axis, and a Z'-axis. The X'-axis extends in a heel-to-toe direction and is positive towards the heel end of the club head. The Y'-axis extends in a sole-to-crown (or sole-to-top rail) direction and is positive towards the crown (or top rail). The Z'-axis extends in a front-to-rear direction and is positive towards the front.

The term "moment of inertia" (hereafter "MOI") can refer to values measured about the CG. The term "Ixx" can refer to the MOI measured in the heel-to-toe direction, parallel to the X-axis. The term "Iyy" can refer to the MOI measured in the sole-to-top rail (or sole-to-crown) direction, parallel to the Y-axis. The term "Izz" can refer to the MOI measured in the front-to-back direction, parallel to the Z-axis. The MOI values Ixx, Iyy, and Izz determine how forgiving the club head is for off-center impacts with a golf ball.

The term "products of inertia" (hereafter "POI") can relate the symmetry of the golf club head about a first axis, to the symmetry of the club head about a second axis. The closer the product of inertia about two axes is near zero in magnitude, the less likely the golf club head is to rotate about those respective axes simultaneously, since the golf club head is symmetrically balanced. Products of inertia can have either positive or negative values. For a positive product of inertia, a positive rotation of the golf club head about the first axis creates a negative rotation of the golf club head about the second axis. Conversely, for a negative product of inertia, a positive rotation of the golf club head about the first axis creates a positive rotation of the golf club head about the second axis.

The terms "favorable POI", "desirable POI", or "improved POI" can refer to one or more product of inertia values of the club head that approach a target POI when compared to a control club head comprising similar features, but lacking lattice structures.

The golf club head can be divided into a high-toe quadrant, a low-toe quadrant, a high-heel high heel quadrant, and a low-heel low heel quadrant. The quadrants are divided by the X-axis and the Y-axis from a front view, and extend rearward in a direction orthogonal to the loft plane. Specifically, the term "high-toe quadrant" refers to a section of the golf club head where the X-axis is negative and the Y-axis is positive. The term "low-toe quadrant" refers to a section of the golf club head where the X-axis is negative and the Y-axis is negative. The term "high-heel quadrant" refers to a section of the golf club head where the X-axis is positive and the Y-axis is positive. The term "low-heel quadrant" refers to a section of the golf club head where the X-axis is positive and the Y-axis is negative.

DESCRIPTION

Described herein is a solid portions of the body. The effective density of the lattice structure can vary or remain constant across different regions of the golf club head. A varying density profile can be achieved by altering the beam thickness of the unit scaffolding within each lattice unit. The lattice structure can be used in either an iron-type or putter-type golf club head. In some iron-type golf club heads, the lattice structure density profile can be designed to add mass to high-toe and low-heel quadrants or regions, while reducing mass in the low-toe and high-heel quadrants or regions. Similarly, for some irons, the lattice structure density profile can be designed to add mass to the front-toe and rear-heel regions, while reducing mass in the rear-toe and front-heel quadrants or regions. By distributing mass with the lattice structure, certain product of inertia values can be achieved that result in improved spin properties on high and low mis-hits.

In some putter-type golf club heads, the lattice structure can be designed to add mass to the perimeter of the body and remove mass from a center of the body. The interior cavity can be partially or fully latticed. In partially latticed embodiments, the lattice structure can be excluded from a central reference shape, pushing mass towards the perimeter of the club head. Additionally, the lattice structure can be used to remove mass from a rear of the club head, shifting the center of gravity forward, compared to a similar putter head lacking the lattice structure. A putter head with a forward-positioned CG can exhibit a horizontal launch angle of a lower magnitude than a putter head with a CG positioned rearward in comparison. In particular, a mallet or mid-mallet putter head with a forward-positioned CG can perform more like a blade-type putter than a mallet or mid-mallet lacking a lattice structure. Thus, the lattice structure described herein can be implemented in a mallet or mid-mallet type putter head to create a putter head that looks, feels, and sounds like a mallet or mid-mallet, while having desirable performance benefits similar to a blade-type putter.

Described below is the lattice structure, followed by a description of iron embodiments with a lattice structure and putter embodiments with a lattice structure. The performance benefits achieved by inclusion of the lattice structure differs between iron-type club heads and putter-type club heads. However, the ability to strategically redistribute mass through a lattice structure is common across all the exemplary golf club heads described below.

Lattice Structure

As shown in FIGS. 1-4, the golf club head 100 can comprise a lattice structure 130 within the internal cavity 120. The lattice structure 130 can be used to either add mass or remove mass from portions of the club head 100. For example, the lattice structure 130 can be constructed within the internal cavity 120 to add discretionary mass in specific locations, or the lattice structure 130 can replace or mine out mass that is typically positioned in certain perimeter regions of the golf club head 100, such as the low toe 175. In some embodiments, a lattice structure 130 at least partially occupies the internal cavity 120. The lattice structure 130 can be divided into a plurality of lattice units 134. Each lattice unit 134 is a designated region within the lattice structure 130. Together, the plurality of lattice units 134 form the lattice structure 130. Each lattice unit 134 can be formed of a unit scaffolding 136 surrounded by empty space 138. The unit scaffolding 136 can be the material or structural portion within the lattice unit 134. The unit scaffolding 136 can have one or more beams 137 that connect or intersect to form a supportive geometry.

The lattice structure 130 can also be called a lattice array, a structural array, a gridwork, a mesh, a framework, a skeleton, or an internal lattice. The lattice structure 130 can occupy a latticed region. The lattice structure 130 (or latticed region) can comprise a total lattice volume and a filled volume. The total lattice volume is the volume occupied by the lattice 130, more specifically, bounded by a surface that is defined by the perimeter-most points 135 (or beam ends) of the lattice structure 130. In other words, the lattice structure 130 (or latticed region) covers, occupies, or spreads across the total lattice volume. The total lattice volume can include empty space 138. The lattice structure 130 (or latticed region) can cover between 20% and 100% of a volume of the interior cavity 120. In some embodiments, the lattice structure 130 (or latticed region) covers between 20% and 30%, 30% and 40%, 40% and 50%, 50% and 60%, 60% and 70%, 70% and 80%, 80% and 90%, or 90% and 100% of the volume of the interior cavity 120. In some embodiments, the total lattice volume can be between 0 cubic inches and 4 cubic inches (0 cubic centimeters (cc) and 65.5 cc). The total lattice volume can be between 0 cubic inches and 1 cubic inch (0 cc and 16.4 cc), 1 cubic inch and 2 cubic inches (16.4 cc and 32.8 cc), 2 cubic inches and 2.5 cubic inches (32.8 cc and 41.0 cc), 2.5 cubic inches and 3.0 cubic inches (41.0 cc and 49.2 cc), or 3.0 cubic inches and 4 cubic inches (49.2 cc and 65.5 cc). In some embodiments, the total lattice volume can be about 2.6 cubic inches (42.6 cc).

The filled volume is the volume that is occupied by the unit scaffolding 136 of the plurality of lattice units 134 (i.e. not including empty space 138). The filled volume can be approximately 5% to 90% of the total lattice volume. In other words, the unit scaffolding 136 can occupy approximately 5% to 90% of the total lattice volume. In some embodiments, the filled volume can be approximately 20% to 80%, 30% to 70%, 40% to 60%, 5% to 15%, 5% to 20%, 5% to 30%, 5% to 40%, 5% to 50%, or 45% to 75% of the total lattice volume.

An effective density of the lattice structure 130 (or of the latticed region) can equal the total mass of the unit scaffolding 136 divided by the total lattice volume. The effective density is determined by the beam thickness of the unit scaffolding. As described below, a greater beam thickness will result in a higher effective density. The effective density is less than the material density of the unit scaffolding 136. The effective density of the lattice structure 130 can range inclusively between 0 g/mm$^3$ and 0.0075 g/mm$^3$. In some embodiments, the effective density can range inclusively between 0 g/mm$^3$ and 0.001 g/mm$^3$, 0.001 g/mm$^3$ and 0.002 g/mm$^3$, 0.002 g/mm$^3$ and 0.003 g/mm$^3$, 0.003 g/mm$^3$ and 0.004 g/mm$^3$, 0.004 g/mm$^3$ and 0.005 g/mm$^3$, 0.005 g/mm$^3$ and 0.006 g/mm$^3$, 0.006 g/mm$^3$ and 0.007 g/mm$^3$, 0.007 g/mm$^3$ and 0.0075 g/mm$^3$, 0 g/mm$^3$ and 0.004 g/mm$^3$, 0.002 g/mm$^3$ and 0.006 g/mm$^3$, or 0.004 g/mm$^3$ and 0.0075 g/mm$^3$. The lattice structure 130 effective density can correlate to a beam thickness of the unit scaffolding, as described below.

The lattice structure 130 can have an effective density profile. The effective density can either be constant (and uniform) throughout the lattice structure 130 or it can vary (and be non-uniform). In some embodiments, the effective density can vary radially. For example, the effective density can increase as the distance from the CG increases. In some embodiments, the effective density can vary in only one direction. For example, the lattice structure effective density can vary in one of the following directions: heel-to-toe (parallel to X-axis), front-to-back (parallel to Z-axis), or top-to-bottom (parallel to Y-axis). In some embodiments, the density profile can vary in a single direction that is a combination of two or more of the following directions: heel-to-toe, front-to-back, or top-to-bottom. In other embodiments, the effective density can vary in more than one direction. Furthermore, the lattice structure effective density can vary linearly or non-linearly. In some embodiments, the lattice structure effective density can vary linearly in a first direction and non-linearly in a second direction.

In some embodiments, the effective density can vary at an average rate of inclusively between approximately 0.0005 g*mm$^3$ per cm and approximately 0.0015 g*mm$^3$ per cm (approximately 0.0013 g*mm$^3$ per inch and approximately 0.0038 g*mm$^3$ per inch). For example, the effective density can vary at an average rate of approximately 0.001 g*mm$^3$ per cm (approximately 0.0025 g*mm$^3$ per inch).

Beams

Figure 5A:
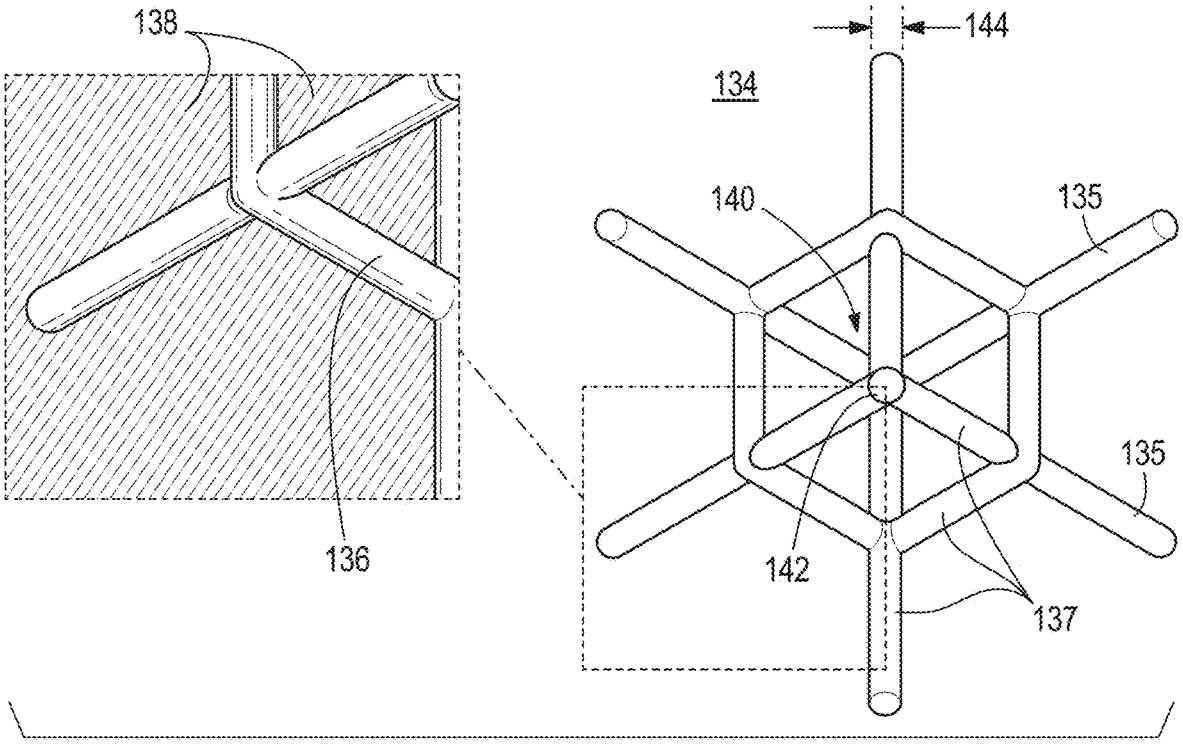
FIG. 5A illustrates a lattice unit, according to a first embodiment.
Figure 5B:
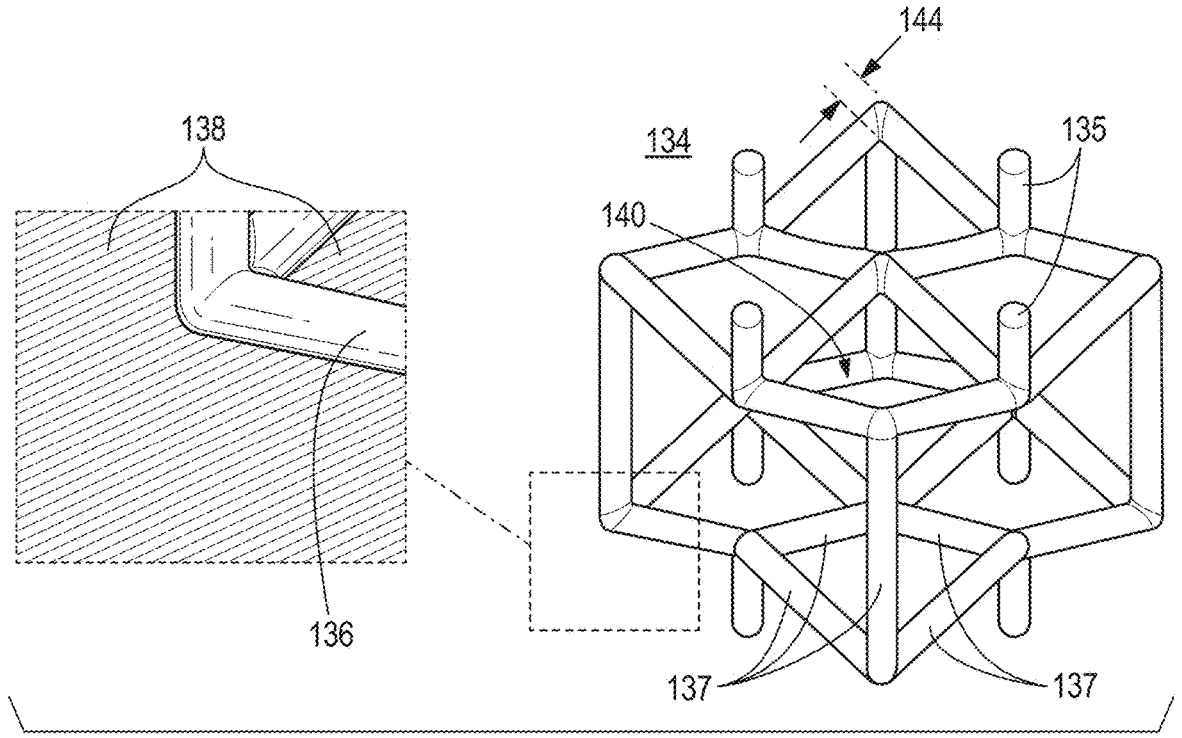
FIG. 5B illustrates a lattice unit, according to a second embodiment.
Figure 5C:
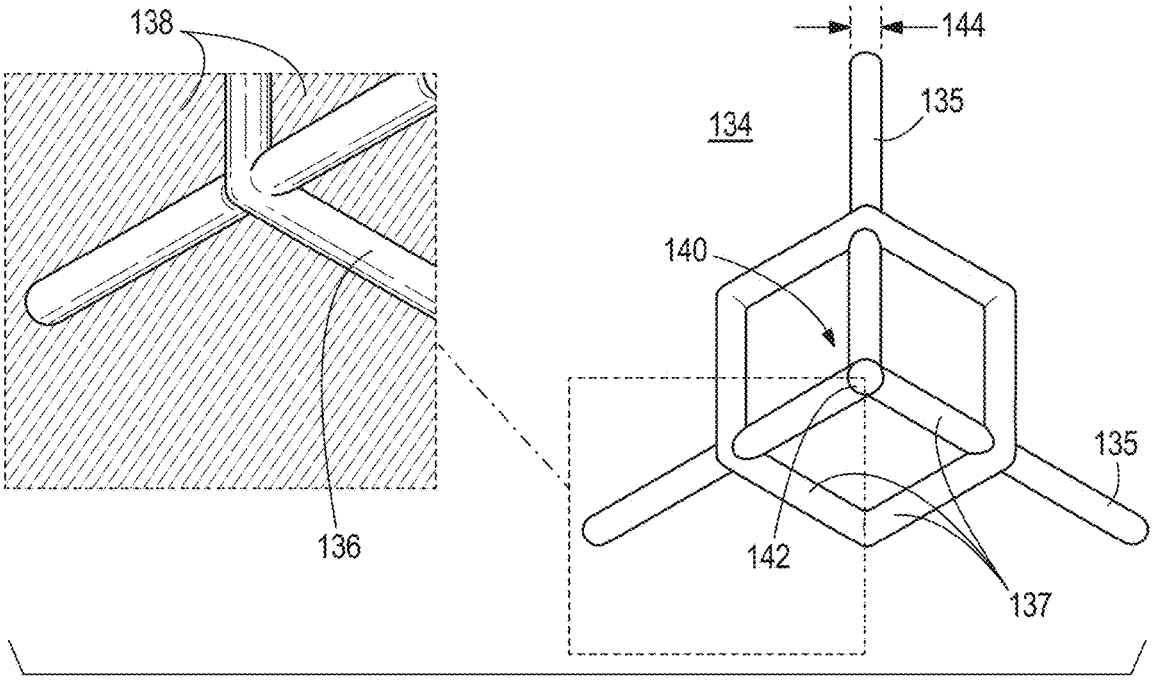
FIG. 5C illustrates a lattice unit, according to a third embodiment.

Referring to FIGS. 5A-5C, each lattice unit 134 of the plurality of lattice units can comprise a nodal network 140. The nodal network 140 can comprise a node 142 and a plurality of beams 137 (or rods) connected to the node 142. In other words, each unit scaffolding 136 (similar to the nodal network 140) can be formed of a plurality of beams 137.

The beams 137 of each unit scaffolding 136 can form geometric structures including but not limited to: simple cubic, body centered cubic, face centered cubic, column, columns, diamond, fluorite, octet, truncated cube, truncated octahedron, kelvin cell, IsoTruss, re-entrant, weaire-phelan, triangular honeycomb, triangular honeycomb rotated, hexagonal honeycomb, re-entrant honeycomb, square honeycomb rotate, square honeycomb, face centered cubic foam, body centered cubic foam, simple cubic foam, hex prism diamond, hex prism edge, hex prism vertex centroid, hex prism central axis edge, hex prism laves phase, tet oct vertex centroid, and oct vertex centroid.

The fluorite structure comprises interconnecting beams 137, arranged as illustrated in FIG. 5A. The re-entrant structure comprises interconnecting beams 137, arranged as illustrated in FIG. 5B. The diamond structure comprises interconnecting beams 137, arranged as illustrated in FIG. 5C. In other embodiments, the unit scaffolding 136 can have other geometric structures and/or beam arrangements. Outermost beam ends 135 of each unit scaffolding 136 can be configured to connect integrally with an adjacent unit scaffolding.

Referring to FIGS. 5A-5C, the one or more beams 137 can each comprise a beam thickness 144 (called a beam diameter for cylindrical beams). The beam thickness 144 can range, inclusively, between 0 mm and 5 mm. In some embodiments, the beam thickness 144 can range, inclusively, between 0 mm and 1 mm, 1 mm and 2 mm, 2 mm and 3 mm, 3 mm and 4 mm, or 4 mm and 5 mm. In embodiments with a constant effective density profile, the beam thickness 144 can be constant (or uniform) throughout the lattice structure 130.

Figure 6:
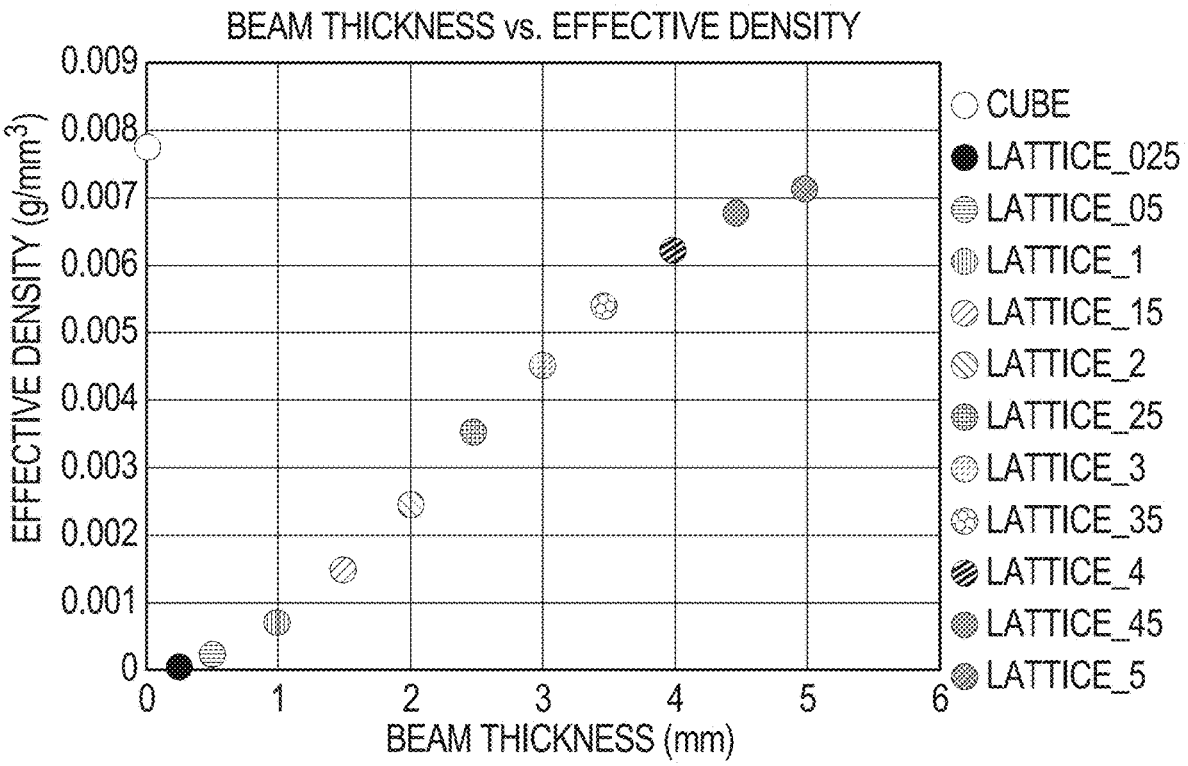
FIG. 6 illustrates a graph correlating the beam thickness of a lattice structure to the effective density of a lattice structure, according to a lattice embodiment made from a stainless steel material.

Referring to the graph in FIG. 6, the beam thickness 144 can correlate to the effective density of the lattice structure 130. For example, a beam thickness 144 equal to or less than 1 mm can correlate to an effective density of less than 0.001 g/mm$^3$. For further example, a beam thickness 144 inclusively between 2 mm and 3 mm can correlate to an effective density within a range between 0.002 g/mm$^3$ and 0.005 g/mm$^3$. In the graphed correlation of FIG. 6, a solid cube of the club head material is stainless steel and can have a density of approximately 0.0078 g/mm$^3$. In embodiments with a different club head material and material density, the correlation between beam thickness 144 and effective density can numerically differ from the graph of FIG. 6, while following a similar trend.

In embodiments with a varying effective density profile, the beam thickness 144 can vary throughout the lattice structure 130. In some embodiments, the beam thickness 144 can increase in any direction by approximately two-fold (double), three-fold (triple), four-fold (quadruple), five-fold (quintuple), six-fold, seven-fold, eight-fold, nine-fold or ten-fold across the lattice structure 130. In some embodiments, the beam thickness 144 can increase in any direction by approximately 0% to 50%, 50% to 100%, 100% to 200%, 200% to 300%, 300% to 400%, 400% to 500%, 500% to 600%, 600% to 700%, 700% to 800%, 800% to 900%, or 900% to 1000% across the lattice structure 130. In some embodiments, the beam thickness 144 increases by the same factor in all directions. In other embodiments, the beam thickness 144 increases by different factors in some directions.

Unit Scaffolding

The plurality of beams 144 can form the unit scaffolding 136. Each lattice unit 134 of the plurality of lattice units can comprise a unit scaffolding 136. The unit scaffolding 136 can also be called the unit structure, the unit skeleton, or the unit frame. The unit scaffolding 136 is the structural portion of each lattice unit 134. The unit scaffolding 136 bears the stresses and loads placed on the lattice structure 130. The remainder of each lattice unit 134 is void, empty, and/or vacant of structural material. The portion of the lattice unit 134 that is devoid of the unit scaffolding 136 can be referred to as the unit void 138. The volume occupied by the unit scaffolding 136, compared to the volume of the unit void 138, determines the effective density of each lattice unit 134. The effective density of the lattice units 134 can vary within different parts of the latticed region. The varying effective densities of the lattice units 134 enables mass concentration towards the periphery of the club head 100. Since the plurality of lattice units 134 makes up the lattice structure 130, an overall effective density profile of the lattice structure 130 is determined by the densities of individual lattice units 134.

Lattice Units

The lattice structure 130 can comprise a plurality of lattice units 134. Each lattice unit 134 can comprise a unit scaffolding 136, formed of a plurality of beams 137, and a unit void 138. The unit void 138 can often be empty space surrounding the unit scaffolding 136. The plurality of lattice units 134 can have any shape which can be tessellated in three dimensions, such as a cube (most common), a rhombic dodecahedron, a truncated octahedron, a triangular prism, a quadrilateral prism, a hexagonal prism, or any other suitable plesiohedron (shape-filling polyhedron).

Similar to the overall lattice structure 130 (or latticed region), each lattice unit 134 comprises a total unit volume and a filled unit volume. The total unit volume is the volume occupied by a lattice unit 134. Each lattice unit 134 can comprise a total unit volume between approximately 0.007 cubic inch and 1.700 cubic inches. In some embodiments, each lattice unit 134 can comprise a total unit volume between approximately 0.007 cubic inch and 0.010 cubic inch, 0.010 cubic inch and 0.050 cubic inch, 0.050 cubic inch and 0.100 cubic inch, 0.100 cubic inch and 0.150 cubic inch, 0.150 cubic inch and 0.200 cubic inch, 0.200 cubic inch and 0.300 cubic inch, 0.300 cubic inch and 0.400 cubic inch, 0.400 cubic inch and 0.500 cubic inch, 0.500 cubic inch and 0.600 cubic inch, 0.600 cubic inch and 0.700 cubic inch, 0.700 cubic inch and 0.800 cubic inch, 0.800 cubic inch and 0.900 cubic inch, 0.900 cubic inch and 1.000 cubic inch, 1.0 cubic inch and 1.1 cubic inch, 1.1 cubic inch and 1.2 cubic inch, 1.2 cubic inch and 1.3 cubic inch, 1.3 cubic inch and 1.4 cubic inch, 1.4 cubic inch and 1.5 cubic inch, 1.5 cubic and 1.6 cubic inch, or 1.6 cubic inch and 1.7 cubic inch. The total unit volume of the lattice unit 134 can affect the supporting strength and the weight of the lattice structure 130. The total unit volume determines the number of lattice units 134 within the plurality of lattice units.

The filled unit volume is the volume occupied by the unit scaffolding 136. The filled unit volume can be between 5% and 95% of the total unit volume. In some embodiments, the filled unit volume can be approximately 20% to 80%, 30% to 70%, 40% to 60%, 5% to 15%, 5% to 20%, 5% to 30%, 5% to 40%, 5% to 50%, or 45% to 75% of the total unit volume. A ratio of filled unit volume to total unit volume can vary between lattice units 134 within the same lattice structure 130 (or latticed region).

The plurality of lattice units 134 can comprise between 2 and 600 lattice units 134. In some embodiments, the plurality of lattice units 134 can comprise between 2 and 10, 4 and 8, 5 and 8, 5 and 10, 10 and 20, 10 and 50, 50 and 100, 100 and 150, 150 and 200, 200 and 250, 250 and 300, 300 and 350, 350 and 400, 400 and 450, 450 and 500, 500 and 550, or 550 and 600 lattice units 134. In some embodiments, the plurality of lattice units comprises more than 10, more than 20, more than 50, more than 100, more than 200, more than 300, more than 400, or more than 500. The number of lattice units 134 can affect the supporting strength, weight, and manufacturability of the lattice structure 130.

In some embodiments, each lattice unit 134 of the plurality of lattice units 134 can comprise a side length (not illustrated) between 5 mm and 30 mm (0.197 inch and 1.181 inch). In some embodiments, each lattice unit 134 can comprise a side length between 5 mm and 10 mm, 10 mm and 15 mm, 15 mm and 20 mm, 20 mm and 25 mm, 25 mm and 30 mm. In some embodiments, each lattice unit 134 can comprise a side length measuring equal to or less than: 8 mm (about 0.31 inch), 10 mm (about 0.39 inch), 12 mm (about 0.47 inch), 14 mm (about 0.55 inch), 16 mm (about 0.63 inch), 18 mm (about 0.71 inch), 20 mm (about 0.79 inch), 25 mm (about 0.98 inch), or 30 mm (about 1.18 inches). In a cubic shaped lattice unit 134, the side lengths are equal across the three-dimensional (3D) shape. In other shapes, the side lengths can differ.

Ultra-Lightweight Filler

In some embodiments, the unit void 138 of each lattice unit 134 can be filled with an ultra-lightweight filler. In other words, the ultra-lightweight filler can surround or fill around the unit scaffolding 136. The ultra-lightweight filler can be a polymer resin, a foam, a rubber, an absorptive material, or any other low-density filler material.

Reference Shape Devoid of Lattice

Figure 38:
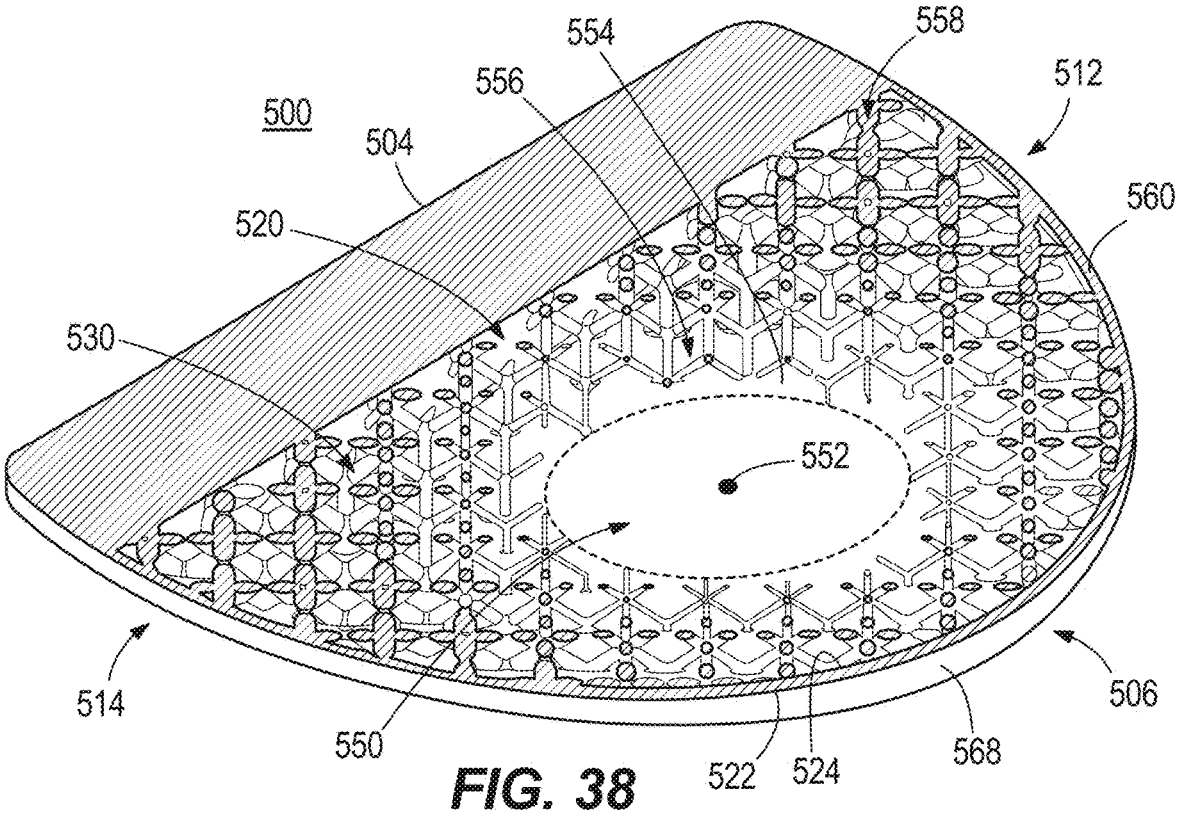
FIG. 38 illustrates a cross-sectional view of the putter-type club head of FIG. 33 taken along line K-K.

Referring to FIG. 38, in some embodiments, where the internal cavity 520 is only partially filled with the lattice structure 530, a reference shape 550 within the internal cavity 520 can be devoid of the lattice structure 530. This reference shape 550 (void or empty of a lattice) is often central, excluding mass from a center of the golf club head, resulting in more perimeter weighting. In some embodiments, the central reference shape 550 can be formed about a central reference point 552. The central reference point 552 can be at the geometric centerpoint (centroid) of the central reference shape 550. In some embodiments, the central reference point 552 can be located within the internal cavity 520, within the face 504, or behind the face 504 and in front of the boundary wall 525. The position of the central reference point 552 defines the position central reference shape 550, and subsequently the position of the lattice structure 530.

Figure 35:
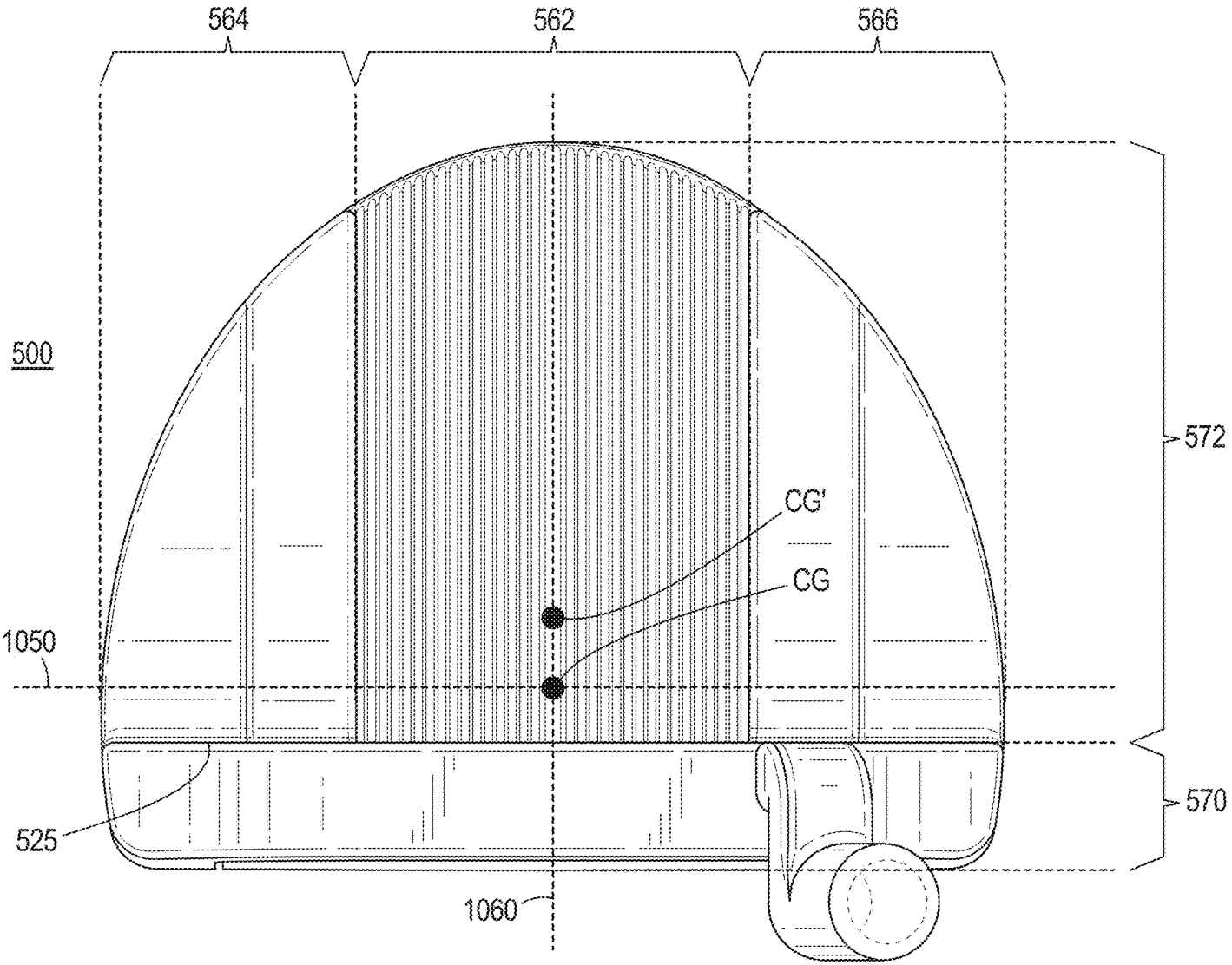
FIG. 35 illustrates a top view of the putter-type golf club head of FIG. 33.
Figure 36:
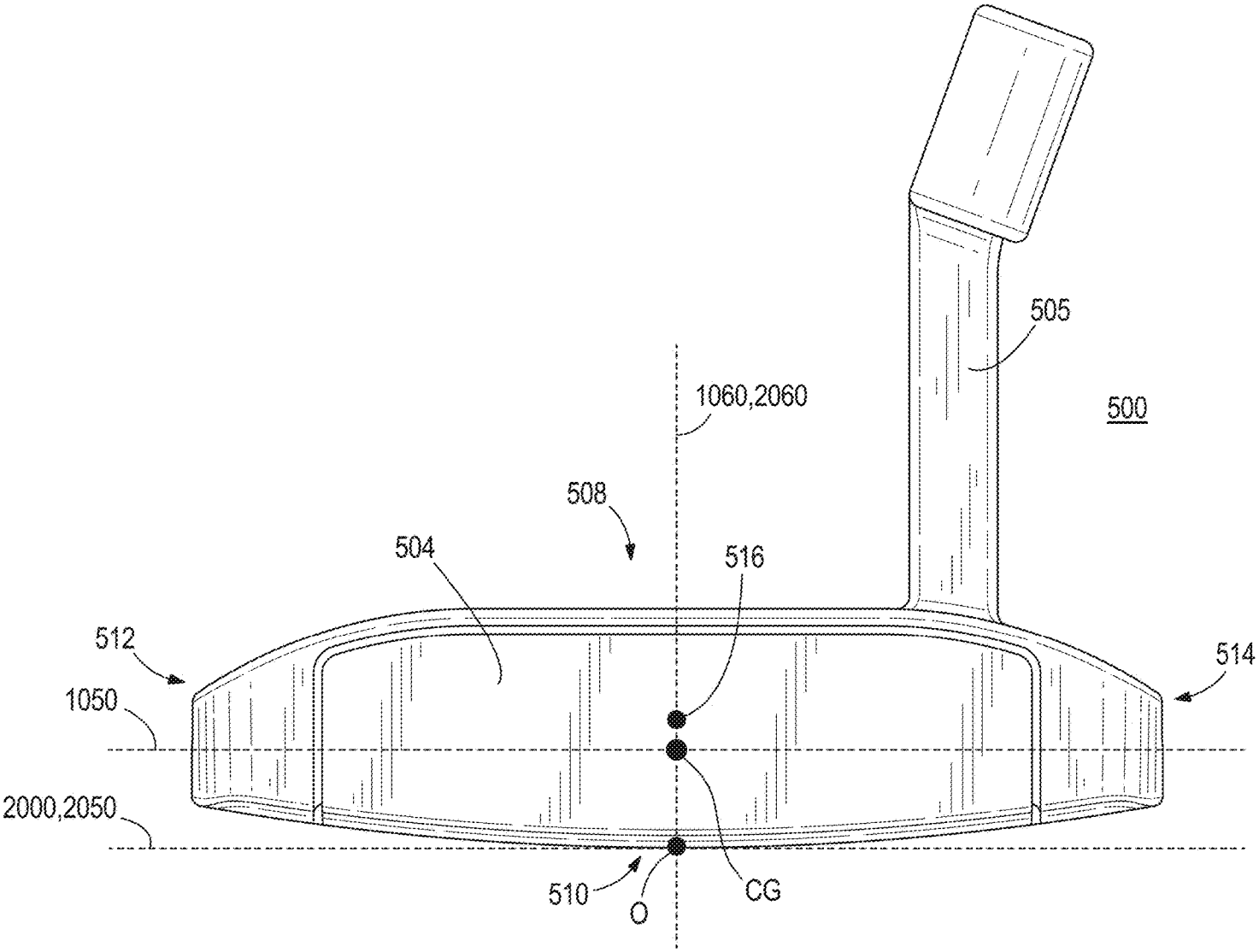
FIG. 36 illustrates a front view of the putter-type golf club head of FIG. 33.
Figure 37:
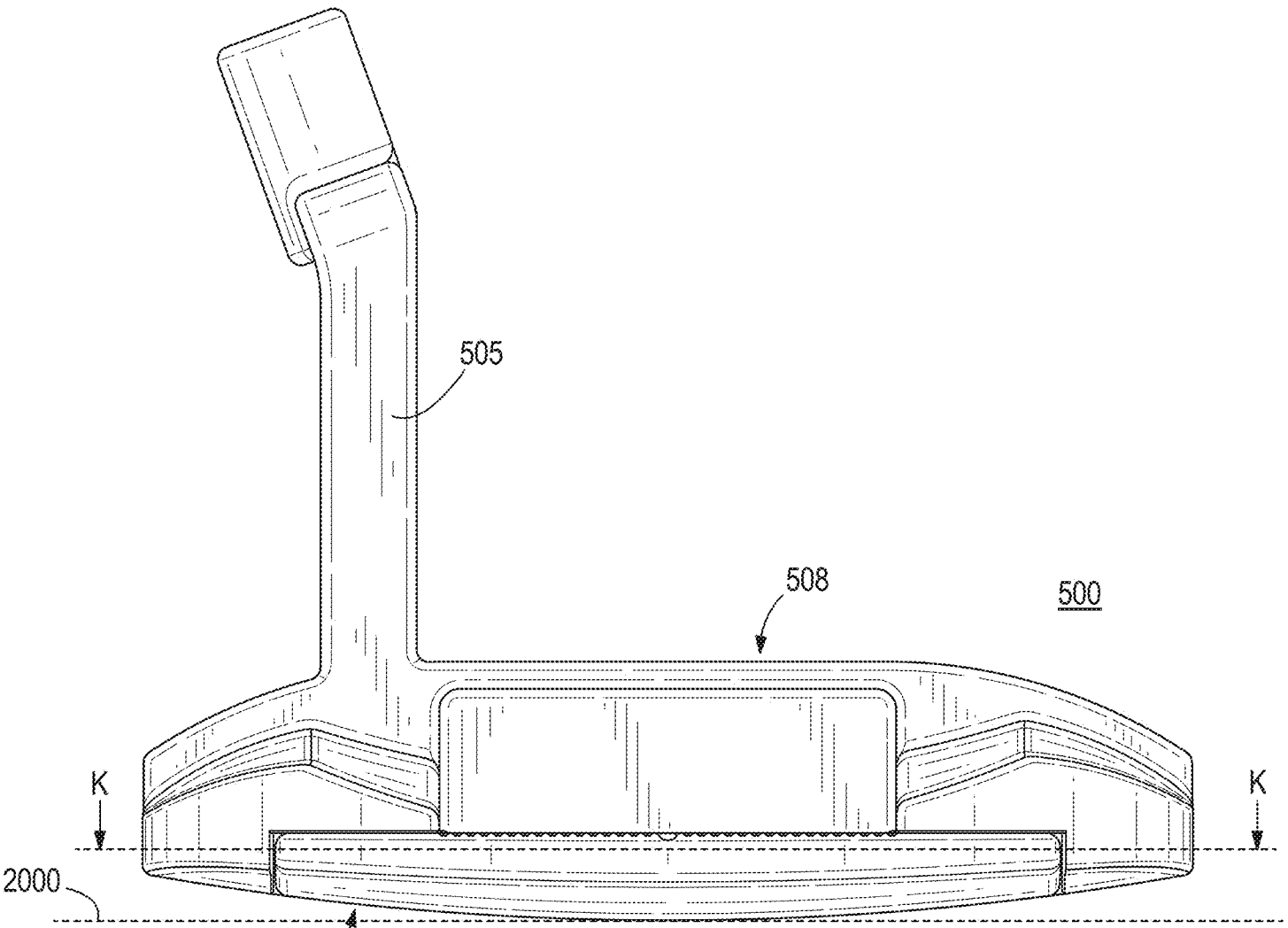
FIG. 37 illustrates a rear view of the putter-type golf club head of FIG. 33.

Referring to FIGS. 35 and 38, in some embodiments, the central reference point 552 can be positioned at the baseline center of gravity (CG') of the club head 500. Consequently, the central reference shape 550 can also be positioned about the baseline CG (CG') of the club head 500. Centering the lattice structure about the CG can raise the MOI without moving the CG of the club head 500. However, in many embodiments, the central reference point 552 can be offset from the CG to intentionally alter the CG location by the inclusion of the lattice structure 530.

The lattice structure 530 can extend radially or in a grid-like pattern away from the central reference point 552 towards the periphery of the club head 500. In embodiments with non-uniform lattice structure density, the density profile of the lattice structure 530 can vary with respect to a distance from the central reference point 552.

The central reference shape 550 can be a sphere, a cylinder, a polyhedron, a prism, a cube, or any other three-dimensional shape. The central reference shape 550 can comprise a border surface 554, which bounds a volume of the central reference shape 550. The border surface 554 of the central reference shape 550 can form an inner boundary of the latticed region 530. In embodiments with non-uniform lattice structure density, the density profile of the lattice structure 530 can vary with respect to a distance from the central reference shape 550. The MOI of the club head 500 is increased by excluding the lattice structure 530 from the central reference shape 550 and/or by optionally varying the lattice structure density profile.

When the central reference shape 550 is larger, the lattice structure 530 volume decreases. Furthermore, a larger central reference shape 550 can result in a higher total club head MOI, because the lattice structure 530 (and its inherent mass) is concentrated near or adjacent the periphery of the club head 500. In embodiments where the central reference shape 550 is a sphere shape, the central reference sphere 550 can comprise various diameter values. In some embodiments, the central reference sphere 550 can comprise a diameter between 0 inches and 3.0 inches (7.62 centimeters). In some embodiments the central reference sphere diameter can be between 0 inches and 1.5 inches (3.81 centimeters), 1.5 inches (3.81 centimeters) and 3.0 inches (7.62 centimeters), 0 inches and 1.0 inches (2.54 centimeters), 1.0 inch (2.54 centimeters) and 2.0 inches (5.08 centimeters), 2.0 inches (5.08 centimeters) and 3.0 inches (7.62 centimeters), 0.5 inch (1.27 centimeters) and 1.5 inch (3.81 centimeters), 0 inches and 0.5 inch (1.27 centimeters), 0.5 inch (1.27 centimeters) and 1.0 inch (2.54 centimeters), 1.0 inch (2.54 centimeters) and 1.5 inch (3.81 centimeters), 1.5 inch (3.81 centimeters) and 2.0 inch (5.08 centimeters), 2.0 inch (5.08 centimeters) and 2.5 inch (6.35 centimeters), or 2.5 inch (6.35 centimeters) and 3.0 inch (7.62 centimeters). Although the embodiment of FIGS. 35 and 38 depict a putter-type club head, the described lattice structure 130 can also be applied to an iron-type club head.

Materials

The golf club head 100 comprises a face material and a body material. In most embodiments, the strike face 104 comprises the face material, while the body comprises the body material. In most embodiments, the face material is different than the body material, however in some embodiments, the face material can be the same as the body material. In some embodiments, the body can comprise multiple metal materials.

The face material and the body material can comprise a metal alloy, such as a titanium alloy, a steel alloy, an aluminum alloy, an amorphous metal alloy, or any other metal or metal alloy. Examples of steels or steel alloys may include, but are not limited to: stainless steel, stainless steel alloy, C300, C350, Ni (Nickel)-Co (Cobalt)-Cr (Chromium)-Steel Alloy, 8620 alloy steel, S25C steel, 303 SS, 17-4 SS, carbon steel, maraging steel, 565 Steel, AISI type 304 stainless steel, and AISI type 630 stainless steel. Examples of titanium alloys may include, but are not limited to: Ti-6-4, Ti-3-8-6-4-4, Ti-10-2-3, Ti 15-3-3-3, Ti 15-5-3, Ti185, Ti 6-6-2, Ti-7s, Ti-9s, Ti-92, and Ti-8-1-1 Titanium alloy.

Iron

As discussed above, lattice structures 130 can be utilized in an iron-type golf club head 100 to optimize one or more mass properties of the club head 100, including increasing moments of inertia (MOI), products of inertia (POI), and CG positioning. Described below are embodiments of various iron-type golf club heads comprising lattice structures to improve the products of inertia and produce a reduction in sidespin of up to 40% of high or low mis-hits. Each club head 100 embodiment can comprise a face 104, a sole 110, a top rail 108, a toe end 112, a heel end 114, a hosel 105, an external surface 122, and an internal surface 124. The internal surface 124 bounds an interior cavity 120 (or hollow portion). The interior cavity 120 can be fully latticed, completely occupied by the lattice structure 130. Subsequent embodiments of the iron-type club head 200, 300, 400 can comprise similar features, labeled similarly to the first iron-type club head embodiment 100, but with a 200, 300, or 400 numbering scheme (i.e. club head 200 comprises a strike face 204, a sole 210, a top rail 208, etc.). The various club head embodiments 100, 200, 300, 400 are all similar but for the arrangement of the lattice structure 130, specifically the effective density profile of each particular lattice structure 130, and other features for the reallocation of mass.

Figure 7:
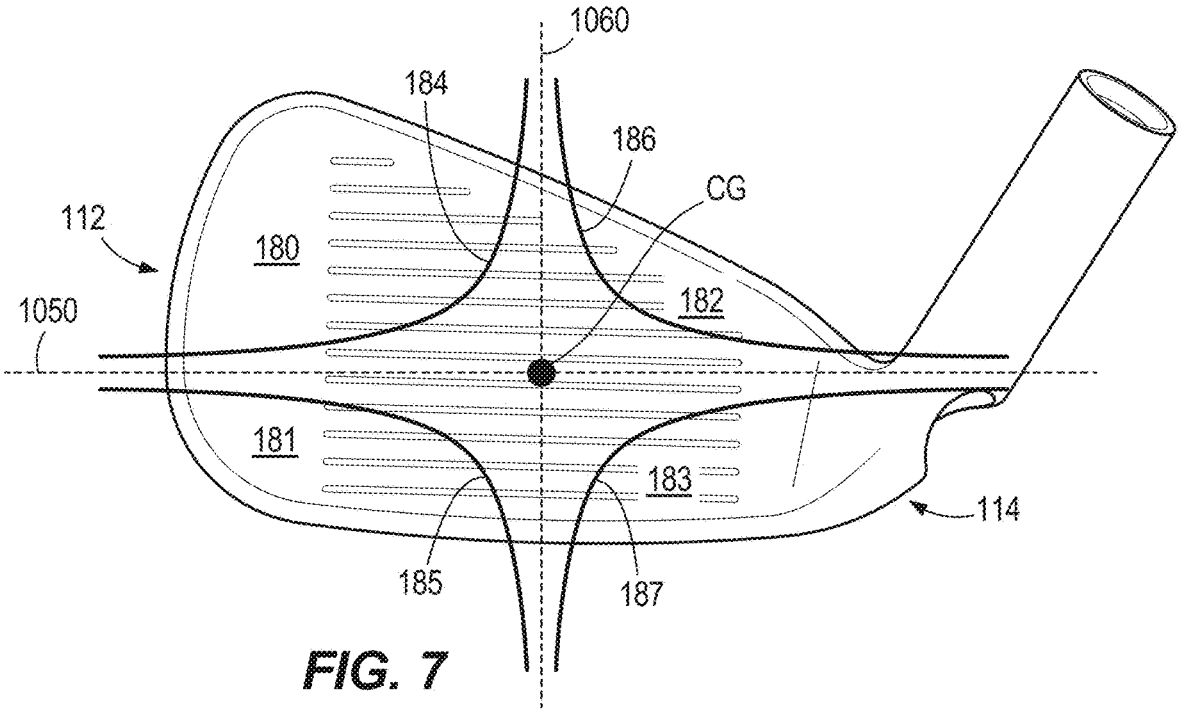
FIG. 7 illustrates a front view of the iron-type club head of FIGS. 1-4 designating regions of high and low density.
Figure 8:
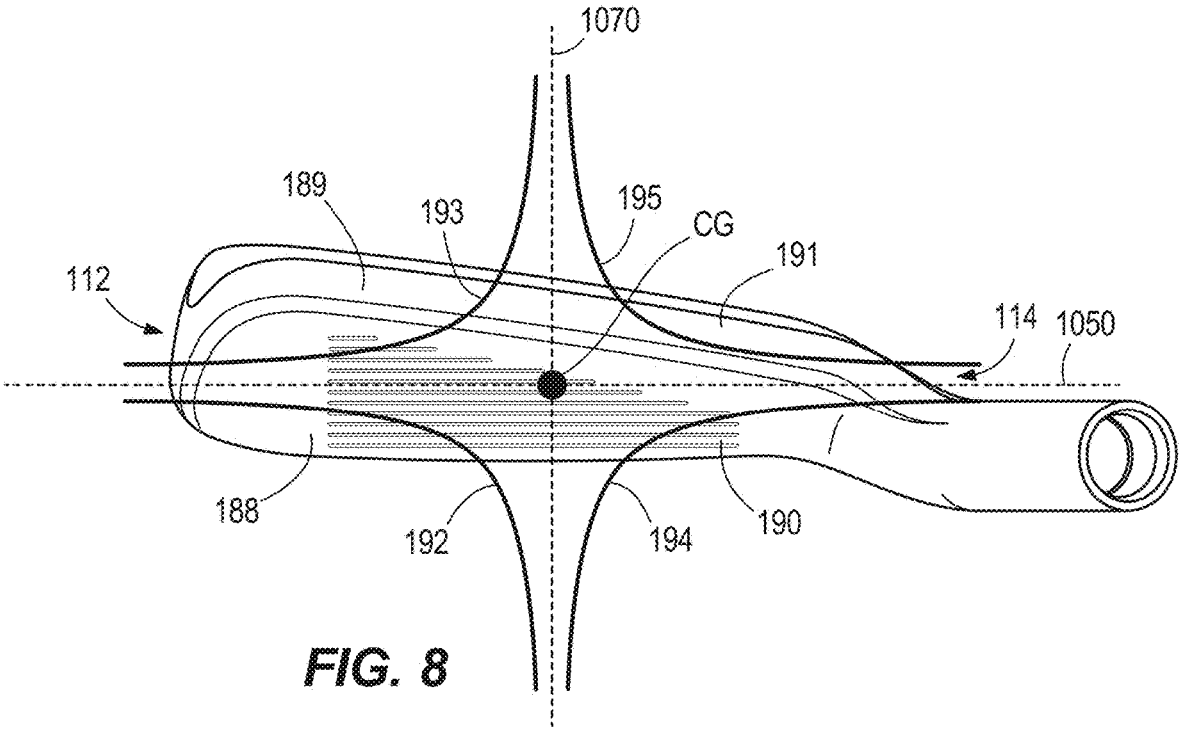
FIG. 8 illustrates a top view of the iron-type club head of FIGS. 1-4 designating regions of high and low density.
Figure 9:
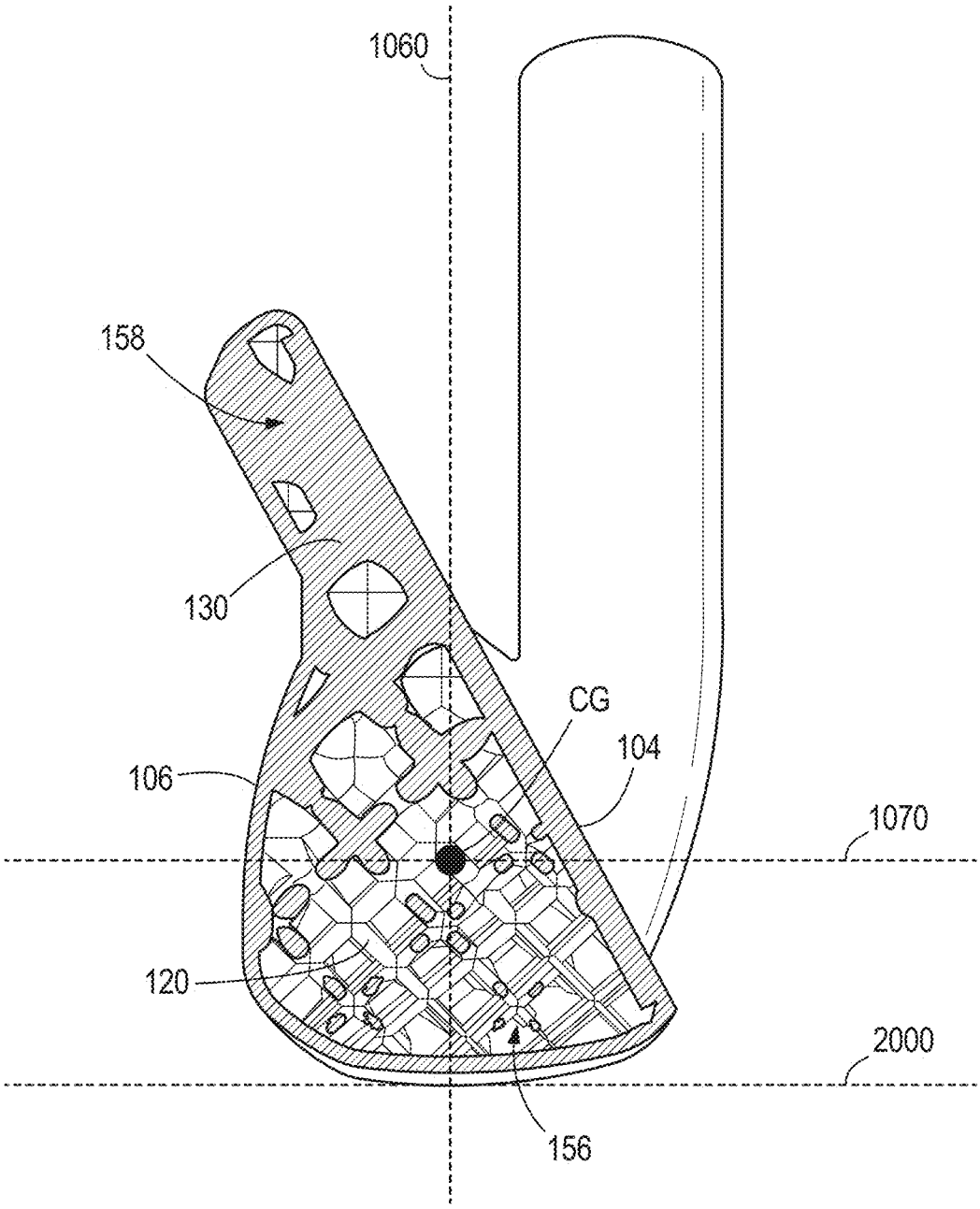
FIG. 9 illustrates a cross-sectional view taken along line F-F of the iron-type club head of FIG. 2 showing a lattice structure filling the internal cavity.

Referring to FIGS. 7 and 8, in many embodiments, lattice structures 130 are arranged to provide an iron-type club head 100 with a high effective density high-toe region 180 and low-heel region 183 and a low effective density low-toe region 181 and high-heel region 182. Similarly, in many embodiments, lattice structures 130 can be arranged to provide an iron-type club head 100 with a high effective density rear-toe region 189 and front-heel region 190 and a low effective density front-toe region 188 and rear-heel region 191. These particular arrangements result in increased products of inertia (POI) that minimize undesirable sidespin by up to 40% on shots hit above or below the center 116 of the strike face 104. Referring to FIGS. 7 and 8, various high and/or low regions of the club head 100 can be provided as added mass regions wherein mass is added to the region by the inclusion of the lattice structure 130, while other high and/or low regions can be provided as reduced mass regions wherein mass is reduced by mining out certain perimeter portions of the club head 100 (i.e. replacing previously solid material with a lattice structure 130 of a lower effective density). By adding mass in certain high and/or low regions and reducing mass in others, a club head 100 with a favorable asymmetry and improved POI is achieved.

Referring to FIG. 7, the iron-type club head 100 comprises a high-toe region 180, a low-toe region 181, a high-heel region 182, and a low-heel region 183 that provide potential regions of the club head 100 to increase or reduce mass. The high-toe region 180 can be located within the high-toe quadrant 174 and is delimited between a high-toe boundary line 184 and the perimeter of the club head 100. The low-toe region 181 can be located within the low-toe quadrant 175 and is delimited between a low-toe boundary line 185 and the perimeter of the club head 100. The high-heel region 182 can be located within the high-heel quadrant 176 and is delimited between a high-heel boundary line 186 and the perimeter of the club head 100. The low-heel region 183 can be located within the low-heel quadrant 177 and is delimited between a low-heel boundary line 187 and the perimeter of the club head 100. Each region is located toward the perimeter of the club head 100 and spaced away from the CG to preserve perimeter weighting and MOI as mass is added or removed from the various regions.

As mentioned above, the high-toe, low-toe, high-heel, and low-heel boundary lines 184, 185, 186, 187 delimit the high-toe, low-toe, high-heel, and low-heel regions 181, 182, 183, 184, respectively. In the embodiment of FIG. 7, the high-toe boundary line 184 and the low-heel boundary line 187 are defined by the following equation, with respect to position along the x-axis 1050 and the y-axis 1060:

$$y = \frac{0.35\ \text{in}}{x\ \text{in}}$$

Conversely, the low-toe boundary line 185 and the high-heel boundary line 186 are defined by the following equation, with respect to position along the x-axis 1050 and the y-axis 1060:

$$y = \frac{-0.35\ \text{in}}{x\ \text{in}}$$

In other embodiments, the shape and/or size of the various regions can change. For example, the factors with values "0.35" and "−0.35," in the equations above, can take various values, so long as the resulting regions remain suitable for creating favorable asymmetry and improving POI by adding or removing mass in such regions. In other words, the boundary lines can curve more or less sharply. The overall design of the club head 100 can affect the optimal regions for adding or removing mass to improve POI.

The POI about the x-axis 1050 and y-axis 1060 (hereafter "Ixy") of the iron-type club head 100 can be improved by increasing the amount of mass located within certain high and/or low regions and reducing the amount of mass in other high/and or low regions. The club head 100 comprises asymmetric weighting with respect to the x-axis 1050 and the y-axis 1060. In many embodiments, the high-toe region 180 and the low-heel region 183 comprise added mass regions, while the low-toe region 181 and the high-heel region 182 comprise reduced mass regions. The mass of each region can be increased or reduced by the inclusion of the lattice structure 130. The high-toe region 180 and the low-heel region 183 can comprise lattice structures 130 with relatively high effective densities to increase the overall amount of mass in said regions. Conversely, the low-toe region 181 and the high-heel region 182 can comprise lattice structures 130 with relatively low effective densities or no lattice structures at all, such that the mass in said regions is reduced. In some embodiments, the low-toe region 181 and the high-heel region 182 can comprise portions of the perimeter of the club head 100 that are mined out by the lattice structure 130, further reducing the mass in said regions.

The club heads 100, 200, 300, 400 comprise lattice structures 130 arranged to allocated high amounts of mass in the high-toe region 180 and low-heel region 183 and lower amounts of mass in the low-toe region 181 and the high-heel region 182. This specific arrangement accomplished by varying the effective density of the lattice structure 130 results in an increase Ixy that leads to a reduction in sidespin. In many embodiments, the high-toe region 180 and/or the low-heel region 183 can comprise an effective density greater than the low-toe region 181 and/or the high-heel region 182. In some embodiments, the effective density of the lattice structure 130, 230, 330, 430 in the high-toe region 180 and/or low-heel region 183 can range between approximately 0.006 g/mm$^3$ and approximately 0.0075 g/mm$^3$. In some embodiments, the effective density of the lattice structure 130 230, 330, 430 in the high-toe region 180 and/or the low-heel region 183 can range between 0.006 g/mm$^3$ and 0.00625 g/mm$^3$, between 0.00625 g/mm$^3$ and 0.00650 g/mm$^3$, between 0.00650 g/mm$^3$ and 0.00675 g/mm$^3$, between 0.00675 g/mm$^3$ and 0.007 g/mm$^3$, between 0.007 g/mm$^3$ and 0.00725 g/mm$^3$, or between 0.00725 g/mm$^3$ and 0.0075 g/mm$^3$. In some embodiments, the effective density of the lattice structure 130, 230, 330, 430 in the high-toe region 180 and/or the low-heel region 183 can range between 0.006 g/mm$^3$ and 0.00675 g/mm$^3$, between 0.00625 g/mm$^3$ and 0.007 g/mm$^3$, between 0.0065 g/mm$^3$ and 0.00725 g/mm$^3$, or between 0.00675 g/mm$^3$ and 0.0075 g/mm$^3$.

As discussed above, the effective density in the low-toe region 181 and/or the high-heel region 182 can be significantly less than the effective density in the high-toe region 180 and/or the low-heel region 183. In some embodiments, the effective density of the lattice structure 130, 230, 330, 430 in the low-toe region 181 and/or high-heel region 182 can range between approximately 0.0001 g/mm$^3$ and approximately 0.00075 g/mm$^3$. In some embodiments, the effective density of the lattice structure 130, 230, 330, 430 in the low-toe region 181 and/or the high-heel region 182 can range between 0.0001 g/mm$^3$ and 0.0002 g/mm$^3$, between 0.0002 g/mm$^3$ and 0.0003 g/mm$^3$, between 0.0003 g/mm$^3$ and 0.0004 g/mm$^3$, between 0.0004 g/mm$^3$ and 0.0005 g/mm$^3$, between 0.0005 g/mm$^3$ and 0.0006 g/mm$^3$, or between 0.0006 g/mm$^3$ and 0.00075 g/mm$^3$. In some embodiments, the effective density of the lattice structure 130, 230, 330, 430 in the low-toe region 181 and/or the high-heel region 182 can range between 0.0001 g/mm$^3$ and 0.0005 g/mm$^3$, between 0.0002 g/mm$^3$ and 0.0006 g/mm$^3$, between 0.0003 g/mm$^3$ and 0.0007 g/mm$^3$, or between 0.0004 g/mm$^3$ and 0.00075 g/mm$^3$.

The asymmetry caused by increasing the mass in the high-toe region 180 and low-heel region 183 while reducing mass in the low-toe region 181 and high-heel region 182 improves the Ixy of the club head 100. This specific asymmetry in the club head 100 is desirable for providing an increased (i.e. more positive or less negative) Ixy. As will be discussed in further detail below, a more positive Ixy generates less undesirable sidespin on shots mis-hit above or below center.

Referring to FIG. 8 and as discussed above, the lattice structures 130 can also be arranged to provide an iron-type club head 100 with a high effective density rear-toe region 189 and front-heel region 190 and a low effective density front-toe region 188 and rear-heel region 191. The iron-type club head comprises various front and/or rear regions that provide potential regions of the club head 100 to increase or decrease mass, including a front-toe region 188, a rear-toe region 189, a front-heel region 190, and a rear-heel region 191. The front-toe region 188 is delimited between a front-toe boundary line 192 and the external surface 122 of the club head 100 (i.e. the surface of the strikeface 104, the sole 110, etc.). The rear-toe region 189 is delimited between a rear-toe boundary line 193 and the external surface 122 of the club head 100 (i.e. the surface of the strikeface 104, the sole 110, the rear 106, the top rail 108, etc.). The front-heel region 190 is delimited between a front-heel boundary line 194 and the external surface 122 of the club head 100 (i.e. the surface of the strikeface 104, the sole 110, the hosel 105, etc.). The rear-heel region 191 is delimited between a rear-heel boundary line 195 and the external surface 122 of the club head 100 (i.e. the surface of the sole, the rear wall, the top rail, etc.). Each region is spaced away from the CG to preserve perimeter weighting and MOI as mass is added or removed from the various regions.

As mentioned above, the front-toe, rear-toe, front-heel, and rear-heel boundary lines 192, 193, 194, 195, delimit the front-toe, rear-toe, front-heel, and rear-heel regions 188, 189, 190, 191, respectively. In the embodiment of FIG. 8, the rear-toe boundary line 193 and the front-heel boundary line 194 are defined by the following equation, with respect to position along the x-axis 1050 and the z-axis 1070:

$$z = \frac{0.35 \text{ in}}{x \text{ in}}$$

Conversely, the front-toe boundary line 192 and the rear-heel boundary line 195 are defined by the following equation, with respect to position along the x-axis 1050 and the z-axis 1070:

$$z = \frac{-0.35 \text{ in}}{x \text{ in}}$$

In other embodiments, the shape and/or size of the various regions can change. For example, the factors with values "0.35" and "−0.35," in the equations above, can take various values, so long as the resulting regions remain suitable for improving POI by adding or removing mass in such regions. In other words, the boundary lines can curve more or less sharply. The overall design of the club head can affect the optimal regions for adding or removing mass to improve POI.

The POI about the x-axis 1050 and z-axis 1070 (hereafter "Ixz") of the iron-type club head 100 can be improved by increasing the amount of mass located within certain front and/or rear regions and reducing the amount of mass in other front and/or rear regions. The club head 100 comprises asymmetric weighting with respect to the x-axis 1050 and the z-axis 1070. In many embodiments, the front-toe region 188 and the rear-heel region 191 comprise added mass regions, while the rear-toe region 189 and the front-heel region 190 comprise reduced mass regions. The mass of each region can be increased or reduced by the inclusion of the lattice structure 130. The front-toe region 188 and the rear-heel region 191 can comprise lattice structures 130 with relatively high effective densities to increase the overall amount of mass in said regions. Conversely, the rear-toe region 189 and the front-heel region 190 can comprise lattice structures 130 with relatively low effective densities or no lattice structures at all, such that the mass in said regions is reduced. In some embodiments, the rear-toe region 189 and the front-heel region 190 can comprise portions of the perimeter of the club head 100 that are mined out by a lattice structure 130, further reducing the mass in said regions.

The asymmetry caused by increasing the mass in the front-toe region 188 and rear-heel region 191 and reducing mass in the rear-toe region 189 and front-heel region 190 improves the Ixz of the club head 100. Typically, club heads 100 comprise drastically negative Ixz values. This specific asymmetry in the club head 100 is desirable for providing an increased (i.e. less negative) Ixz that more closely matches an optimal target value. A more optimal Ixz generates less undesirable sidespin on shots mis-hit above or below center.

As can be seen from FIGS. 7 and 8, certain high and/or low regions overlap with certain front and/or rear regions. In some cases, the overlapping regions are complementary (i.e. both added mass regions or reduced mass regions), while in other cases, the overlapping regions are conflicting (i.e. one added mass region overlapping a reduced mass region). In order to improve both Ixy and Ixz in the same club head, the effective density of each overlapping region must be tailored with respect to requirements of each individual region. In many embodiments, the portions of the club head 100 wherein multiple added mass regions overlap can comprise a lattice structure 100 with the greatest effective density. For example, the portions of the club head 100 wherein the low-heel region 183 and the rear-heel region 191 overlap can comprise a lattice structure 130 with an effective density greater than the lattice structure 130 of any other portion of the club head 100. Conversely, portions of the club head 100 wherein multiple reduced mass regions overlap can comprise a lattice structure 130 with the lowest effective density in the club head 100. For example, the portions of the club head 100 wherein the low-toe region 181 and the rear-toe region 189 overlap can comprise lattice structures 130 comprising the lowest effective density of any lattice structure 130 in the club head 100. Such portions where multiple mass reduced regions overlap can comprise no lattice structure 130 at all, or can comprise perimeter portions of the club head 100 mined out by a lattice structure 130.

Further, at some portions of the club head 100, an added mass region and a reduced mass region can intersect. The effective density of such portions can be somewhere in between the lowest effective density and the highest effective density of the club head 100. For example, portions of the club head wherein the high-toe region 180 and the rear-toe region 189 intersect can comprise a lattice structure 130 with an effective density less than that of portions wherein the low-heel region 183 and the rear-heel region 191 intersect, yet greater than that of portions wherein the low-toe region 181 and the rear-toe region 189 intersect.

Mass can be increased in the high-toe, rear-toe, low-heel, and front heel regions and decreased in the low-toe, front-toe, high-heel, and rear-heel regions the club head 100 by the arrangement of a variable effective density lattice structure 130 to improve POI. In general, redistributing mass to create the necessary asymmetry for increasing Ixy and/or Ixz can have negative effects on other mass properties of the iron-type golf club head 100, such as MOI. However, the strategic arrangement of the lattice region 130 can increase Ixy and Ixz while retaining high MOI values about the X-axis (Ixx), the Y-axis (Iyy), and the Z-axis (Izz). Due to the location of the added mass regions being located away from the CG, the club head 100 retains high perimeter weighting, even as mass is redistributed. As such, the iron-type club head 100 comprising lattice structures 130 comprises increased Ixy and Ixz over a similar club head without such lattice structures, and yet comprises similar MOI compared to the club head without lattice structures.

For the sake of comparison, a club head similar to club head 100, but without lattice structures can comprise an MOI about the X-axis (Ixx) between approximately 100 g*in$^2$ and 120 g*in$^2$. In comparison, the iron-type club head 100, 200, 300, 400 comprising lattice structures 130, 230, 330, 430 can comprise an MOI about the X-axis (Ixx) greater than approximately 80 g*in$^2$, greater than approximately 85 g*in$^2$, greater than approximately 90 g*in$^2$, greater than approximately 95 g*in$^2$, greater than approximately 100 g*in$^2$, greater than approximately 105 g*in$^2$, greater than approximately 110 g*in$^2$, greater than approximately 115 g*in$^2$, or greater than approximately 120 g*in$^2$. In some embodiments, the club head 100, 200, 300, 400 comprises an Ixx value between approximately 80 g*in$^2$ and approximately 120 g*in$^2$. In some embodiments, the club head 100, 200, 300, 400 comprises an Ixx value between approximately 80 g*in$^2$ and 90 g*in$^2$, between approximately 85 g*in$^2$ and 95 g*in$^2$, between approximately 90 g*in$^2$ and 100 g*in$^2$, between approximately 95 g*in$^2$ and 105 g*in$^2$, between approximately 100 g*in$^2$ and 110 g*in$^2$, between approximately 105 g*in$^2$ and 115 g*in$^2$, or between approximately 110 g*in$^2$ and 120 g*in$^2$. In some embodiments, the Ixx value of the club head 100, 200, 300, 400 can be approximately 105 g*in$^2$, 106 g*in$^2$, 107 g*in$^2$, 108 g*in$^2$, 109 g*in$^2$, or 110 g*in$^2$.

For the sake of comparison, a club head similar to club head 100, but without lattice structures can comprise an MOI about the Y-axis (Iyy) between approximately 500 g*in$^2$ and 550 g*in$^2$. In comparison, the iron-type club head 100, 200, 300, 400 comprising lattice structures 130, 230, 330, 430 can comprise an MOI about the Y-axis (Iyy) greater than approximately 400 g*in$^2$, greater than approximately 425 g*in$^2$, greater than approximately 450 g*in$^2$, greater than approximately 475 g*in$^2$, greater than approximately 500 g*in$^2$, greater than approximately 525 g*in$^2$, or greater than approximately 550 g*in$^2$. In some embodiments, the club head 100, 200, 300, 400 comprises an Iyy value between approximately 400 g*in$^2$ and approximately 550 g*in$^2$. In some embodiments, the club head 100, 200, 300, 400 comprises an Ixx value between approximately 400 g*in$^2$ and 450 g*in$^2$, between approximately 425 g*in$^2$ and 475 g*in$^2$, between approximately 450 g*in$^2$ and 500 g*in$^2$, between approximately 475 g*in$^2$ and 525 g*in$^2$, or between approximately 500 g*in$^2$ and 550 g*in$^2$. In some embodiments, the Iyy value of the club head 100, 200, 300, 400 can be approximately 420 g*in$^2$, 430 g*in$^2$, 440 g*in$^2$, 450 g*in$^2$, 460 g*in$^2$, 470 g*in$^2$, 480 g*in$^2$, 490 g*in$^2$, 500 g*in$^2$, 510 g*in$^2$, 520 g*in$^2$, 530 g*in$^2$, 540 g*in$^2$, or 550 g*in$^2$.

For the sake of comparison, a club head similar to club head 100 but without lattice structures can comprise an MOI about the Z-axis (Izz) between approximately 550 g*in$^2$ and 600 g*in$^2$. In comparison, the iron-type club head 100, 200, 300, 400 comprising lattice structures 130, 230, 330, 430 can comprise an MOI about the Z-axis (Izz) greater than approximately 450 g*in$^2$, greater than approximately 475 g*in$^2$, greater than approximately 500 g*in$^2$, greater than approximately 525 g*in$^2$, greater than approximately 550 g*in$^2$, or greater than approximately 575 g*in$^2$. In some embodiments, the club head 100 comprises an Izz value between approximately 450 g*in$^2$ and approximately 575 g*in$^2$. In some embodiments, the club head 100, 200, 300, 400 comprises an Ixx value between approximately 450 g*in$^2$ and 500 g*in$^2$, between approximately 475 g*in$^2$ and 525 g*in$^2$, between approximately 500 g*in$^2$ and 550 g*in$^2$, or between approximately 525 g*in$^2$ and 575 g*in$^2$. In some embodiments, the Izz value of the club head 100, 200, 300, 400 can be approximately 450 g*in$^2$, 460 g*in$^2$, 470 g*in$^2$, 480 g*in$^2$, 490 g*in$^2$, 500 g*in$^2$, 510 g*in$^2$, 520 g*in$^2$, 530 g*in$^2$, 540 g*in$^2$, 550 g*in$^2$, 560 g*in$^2$, 570 g*in$^2$, or 575 g*in$^2$.

Iron Embodiment 1

Referring to FIGS. 1-4, a first iron embodiment 100 can comprise a lattice structure 130 with a higher effective density within the high-toe 174 and low-heel 177 quadrants and a lower effective density within the low-toe 175 and high-heel 176 quadrants. An effective density of the lattice structure 130 can vary in a sole-to-top rail direction.

Figure 4:
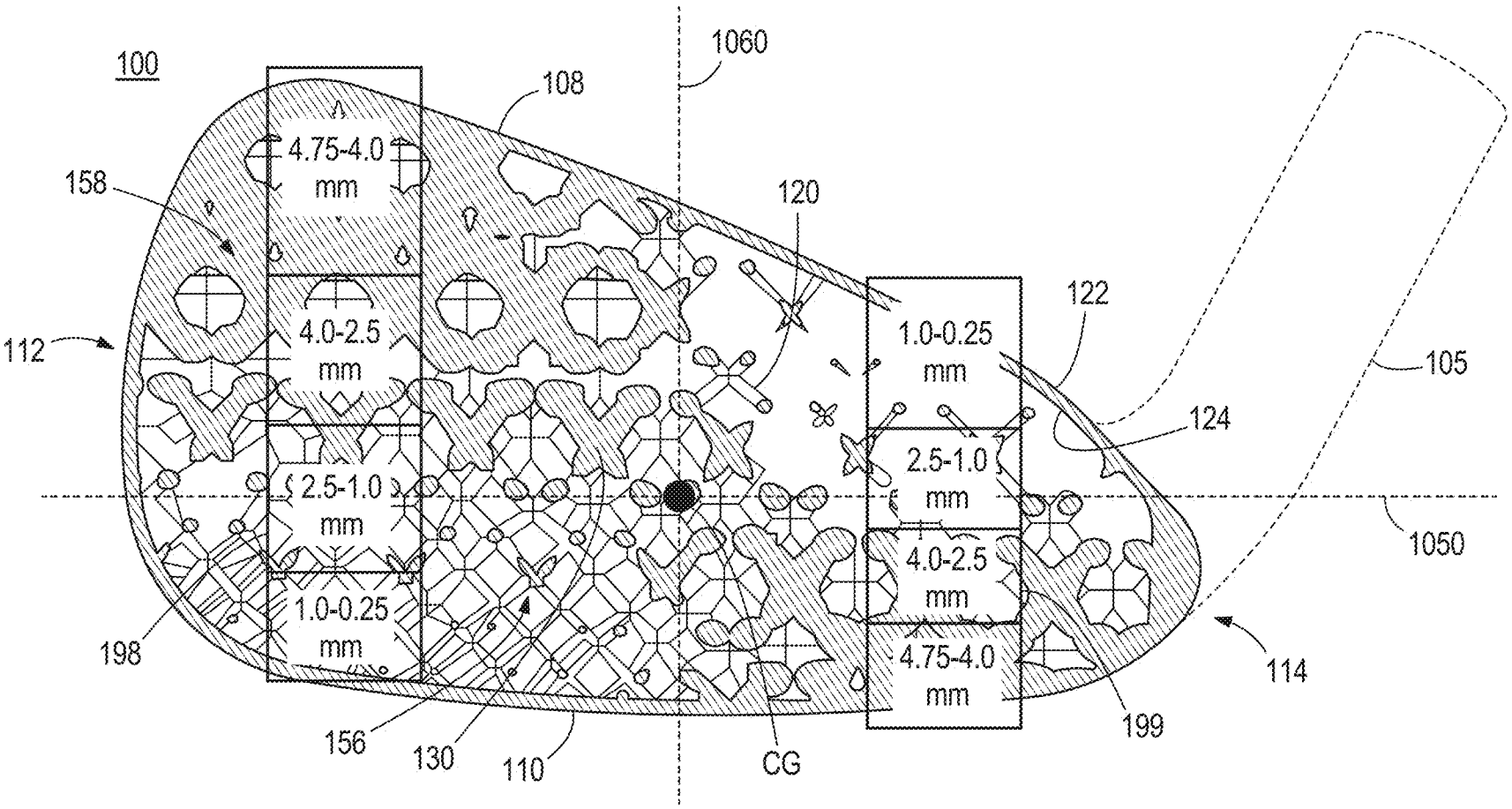
FIG. 4 illustrates a cross-sectional view taken along line I-I of the iron-type club head of FIG. 3 showing a lattice structure filling the internal cavity.

Referring to FIGS. 1-4 and 9, the maximum lattice density 158 can be located within the high-toe quadrant 174 and/or the low-heel quadrant 177. The minimum lattice density 156 can be located within the low-toe quadrant 175 and/or the high-heel quadrant 176. As illustrated in FIG. 4, the effective lattice density within a toe half (near the toe 112) of the club head 100, including the high and low toe quadrants 174, 175, can increase from the sole 110 towards the top rail 108. Conversely, the effective lattice density within a heel half (near the heel 114) of the club head 100, including the high and low heel quadrants 176, 177, can decrease from the sole 110 towards the top rail 108. In this embodiment, the effective density of the lattice can remain approximately uniform in a front-to-rear direction. For example, the high-toe quadrant 174 comprises a greater effective density than the low-toe quadrant 175 at every location along the Z-axis 1070. Similarly, the low-heel quadrant 177 can comprise a greater effective density than the high-heel quadrant 176 at every depth of the club head along the Z-axis 1070.

In the FIG. 4 cross section, ranges of beam thicknesses 144 are depicted for certain box regions (or reference boxes) of the cross-section. As discussed above with reference to FIG. 6, the beam thicknesses 144 determine the effective density of the lattice structure 130. For example, towards the toe 112, the beam thickness 144 range for box region 198 is 1.0 mm to 2.5 mm. This box region 198 is located partially within high-toe quadrant 174, and partially within the low-toe quadrant 175. The box region 198 can comprise beam thicknesses 144 greater than the box region below it and less than the box region above it. For further example, towards the heel 114, the beam thickness 144 range for box region 199 is 2.5 mm to 4.0 mm. This box region 199 is located fully within the low-heel quadrant 177. The box region 199 can comprise beam thicknesses 144 less than the box region below it and greater than the box region above it (and thus box region 199 comprises an effective density less than the box region below it and greater than the box region above it). As such, the lattice structure 130 is specifically tailored to provide a maximum effective density 158 within the high-toe quadrant 174 and the low-heel quadrant 177 and a minimum effective density 156 within the low-toe quadrant 175 and the high-heel quadrant 176.

Figure 10A:
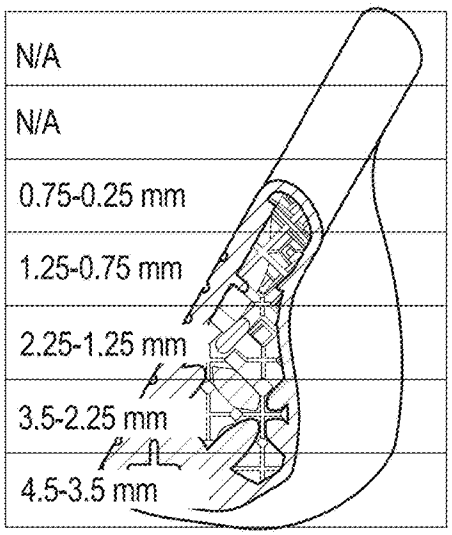
FIG. 10A illustrates a cross-sectional view taken along line A-A of the iron-type club head of FIG. 2 showing a lattice structure filling the internal cavity, along with beam thickness ranges.
Figure 10B:
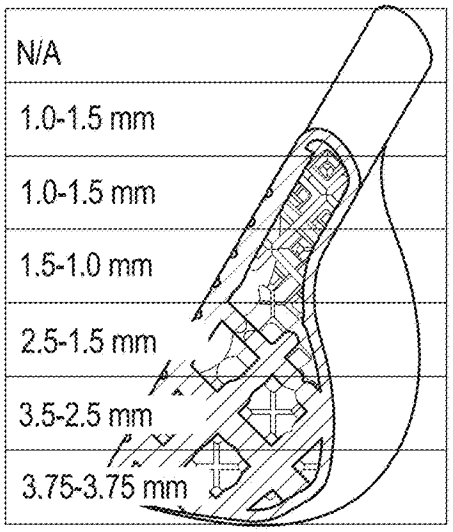
FIG. 10B illustrates a cross-sectional view taken along line B-B of the iron-type club head of FIG. 2 showing a lattice structure filling the internal cavity, along with beam thickness ranges.
Figure 10C:
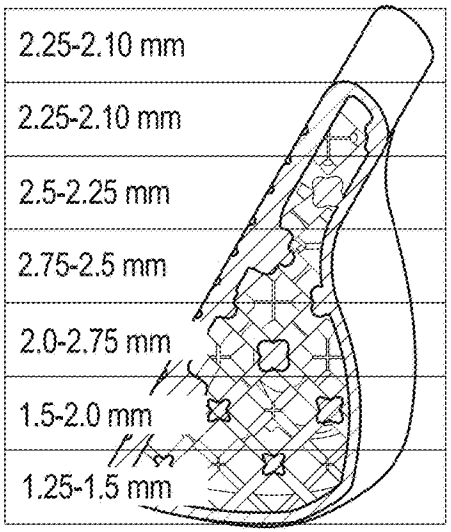
FIG. 10C illustrates a cross-sectional view taken along line C-C of the iron-type club head of FIG. 2 showing a lattice structure filling the internal cavity, along with beam thickness ranges.
Figure 10D:
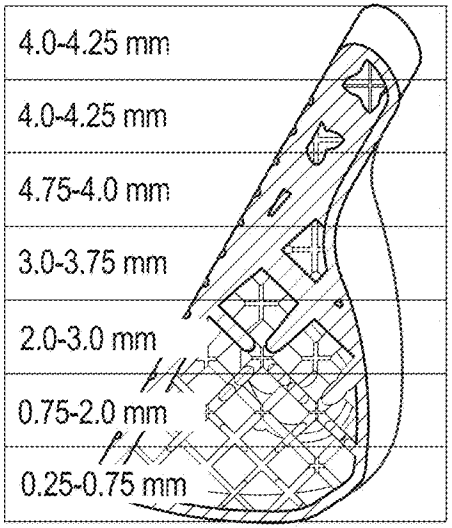
FIG. 10D illustrates a cross-sectional view taken along line D-D of the iron-type club head of FIG. 2 showing a lattice structure filling the internal cavity, along with beam thickness ranges.
Figure 10E:
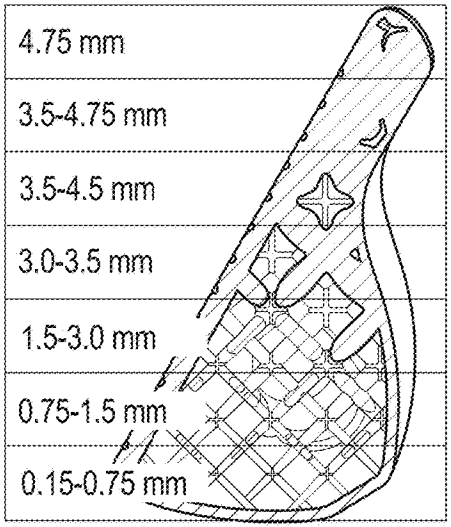
FIG. 10E illustrates a cross-sectional view taken along line E-E of the iron-type club head of FIG. 2 showing a lattice structure filling the internal cavity, along with beam thickness ranges.
Figure 11:
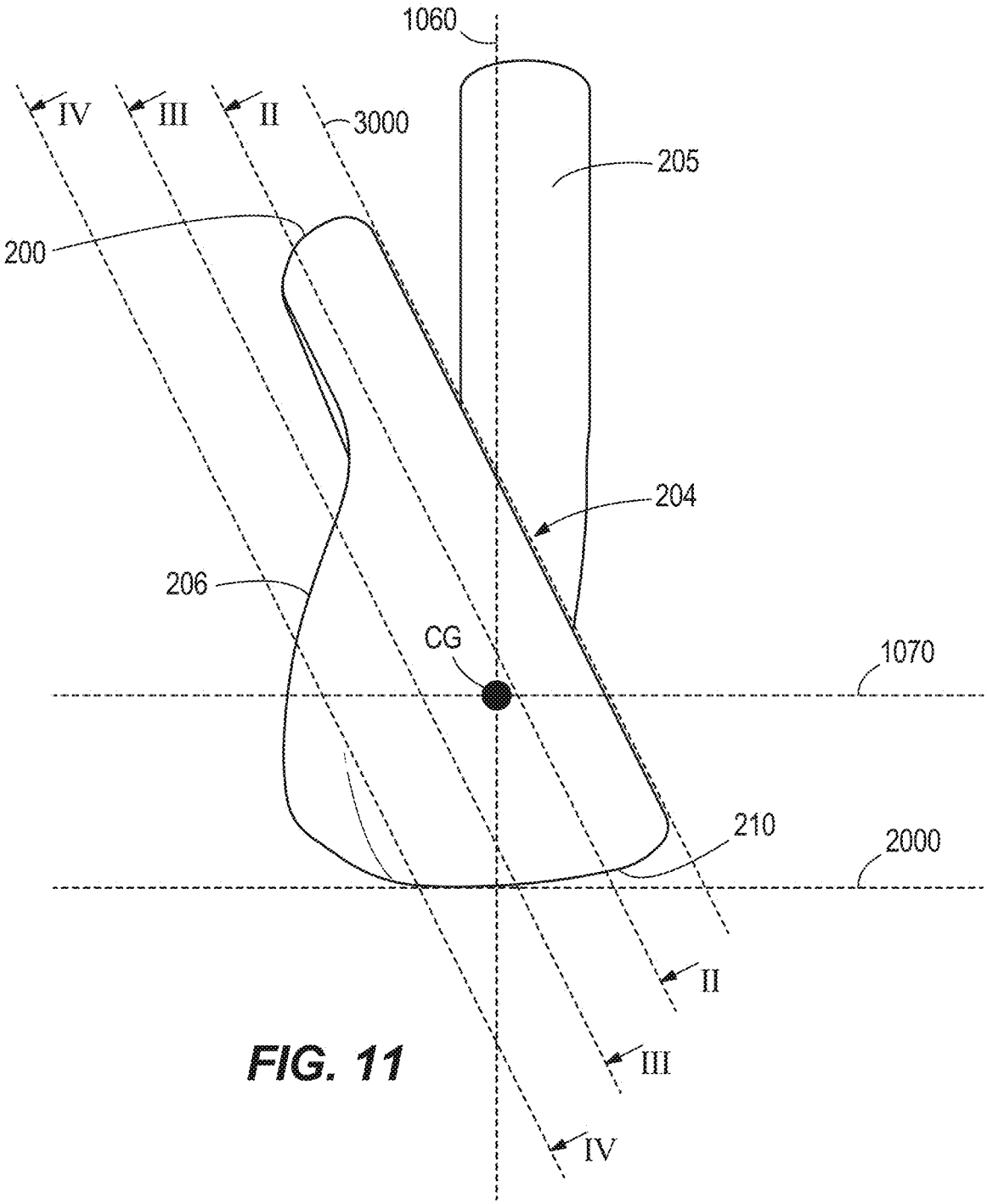
FIG. 11 illustrates a toe-side view of an iron-type club head comprising a lattice structure, according to one embodiment.

Referring to FIGS. 10A-10E, the beam thicknesses 144, and consequently the effective density, of the lattice structure 130 can vary in both a heel-to-toe direction and a crown-to-sole direction. In the cross sections of FIGS. 10A-10E, ranges of beam thicknesses 144 are depicted for certain box regions (or reference boxes). As shown in FIG. 10A, which is a cross section taken one inch towards the heel end 114 from the Y'-axis 2060, the beam thicknesses 144 can increase from the sole 110 to the top rail 108 adjacent the heel end 114. As shown in FIG. 10B, which is a cross section taken approximately half an inch towards the heel end 114 from the Y'-axis 2060, the beam thicknesses 144 can also increase from the sole 110 to the top rail 108, but less rapidly than within the cross section of FIG. 10A. As shown in FIG. 10C, which is a cross section taken along the Y'-axis 2060, the beam thicknesses 144 are relatively constant within a center of the club head 100. As shown in FIG. 10D, which is a cross section taken at half an inch towards the toe end 112 from the Y'-axis 2060, the beam thicknesses 144 begin to decrease from the sole 110 to the top rail 108. Finally, as shown in FIG. 10E, which is a cross section taken one inch towards the toe end 112 from the Y'-axis 2060, the beam thicknesses 144 also decreases from the sole 110 to the top rail 108, but more rapidly than within the cross section of FIG. 10D.

The effective density profile of the first iron club head 100 can result in favorable POI values, particularly Ixy. The asymmetric weighting with respect to the X-axis and the Y-axis is caused by increasing the mass within the high-toe quadrant 174 and low-heel quadrant 177, while simultaneously reducing mass within the low-toe quadrant 175 and the high-heel quadrant 176. This specific asymmetry in the club head 100 is desirable for providing an increased (i.e. more positive or less negative) Ixy. As will be discussed in further detail below, a more positive Ixy generates less undesirable sidespin on shots mis-hit above or below the face center.

Iron Embodiment 2

Referring to FIGS. 11-16, a second iron embodiment 200 can comprise a lattice structure 230 with an effective density that varies in a sole-to-top-rail direction, a heel-to-toe direction, and a front-to-rear direction.

Figure 15:
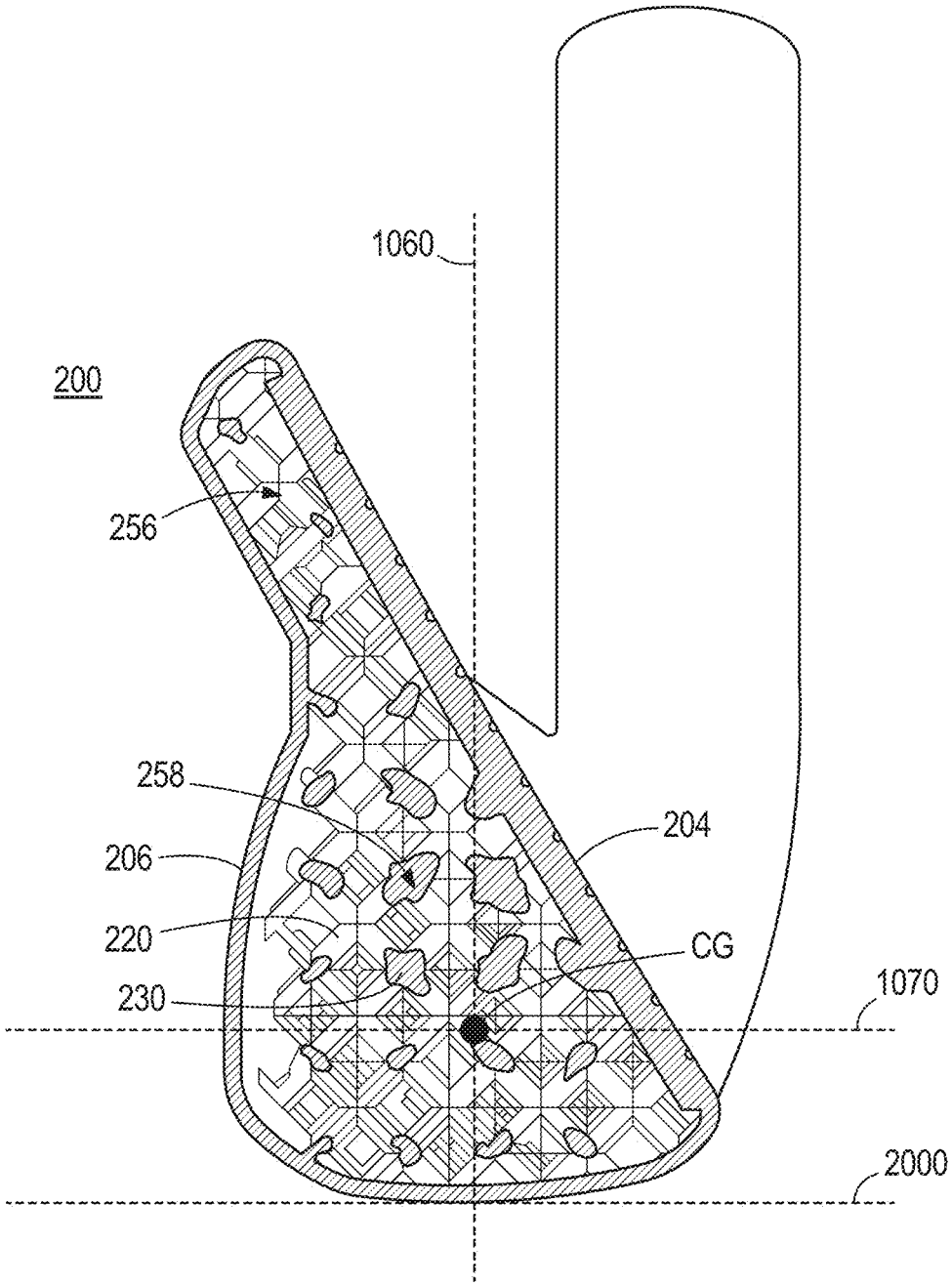
FIG. 15 illustrates a cross-sectional view of the iron-type golf club head of FIG. 11, taken along a line located in the same position as line D-D in FIG. 2, except taken in the opposite direction (i.e. a toe-view cross-section rather than a heel-view).
Figure 16:
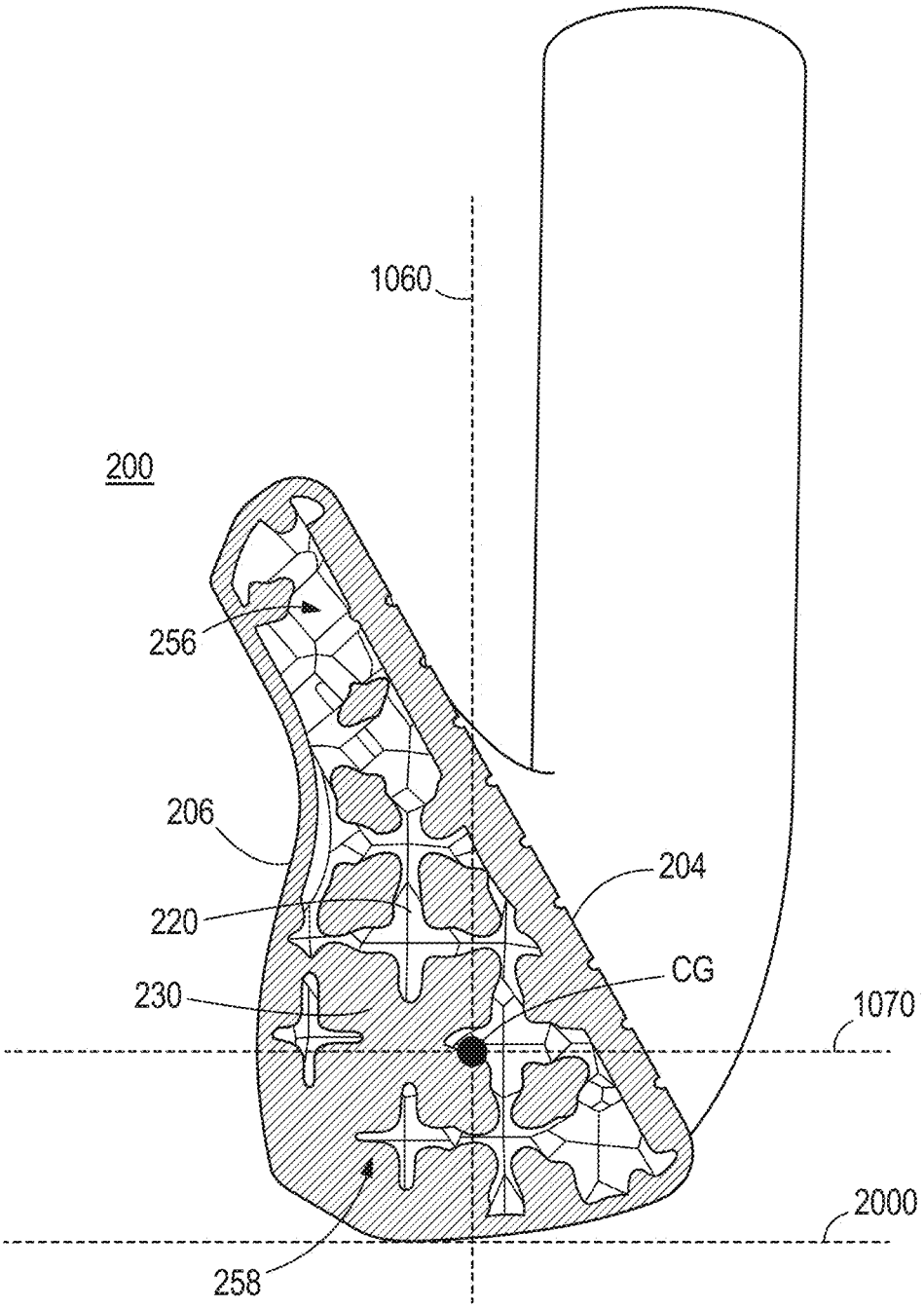
FIG. 16 illustrates a cross-sectional view of the iron-type golf club head of FIG. 11, taken along a line located in the same position as line B-B in FIG. 2, except taken in the opposite direction (i.e. a toe-view cross-section rather than a heel-view).

Referring to FIG. 15, in general, the second iron club head 200 comprises a lattice structure 230 whose effective density near the toe end 212 decreases from the strikeface 204 to the rear 206. Referring to FIG. 16, in general, the effective density near the heel end 214 increases from the strikeface 204 to the rear 206. More specifically, the effective density of the lattice structure 230 located within the high-heel quadrant 276 and the low-heel quadrant 277 can increase from the strikeface 204 to the rear 206, and the effective density of the lattice structure 230 located within the high-toe quadrant 274 and the low-toe quadrant 275 can decrease from the strikeface 204 to the rear 206.

Figure 12:
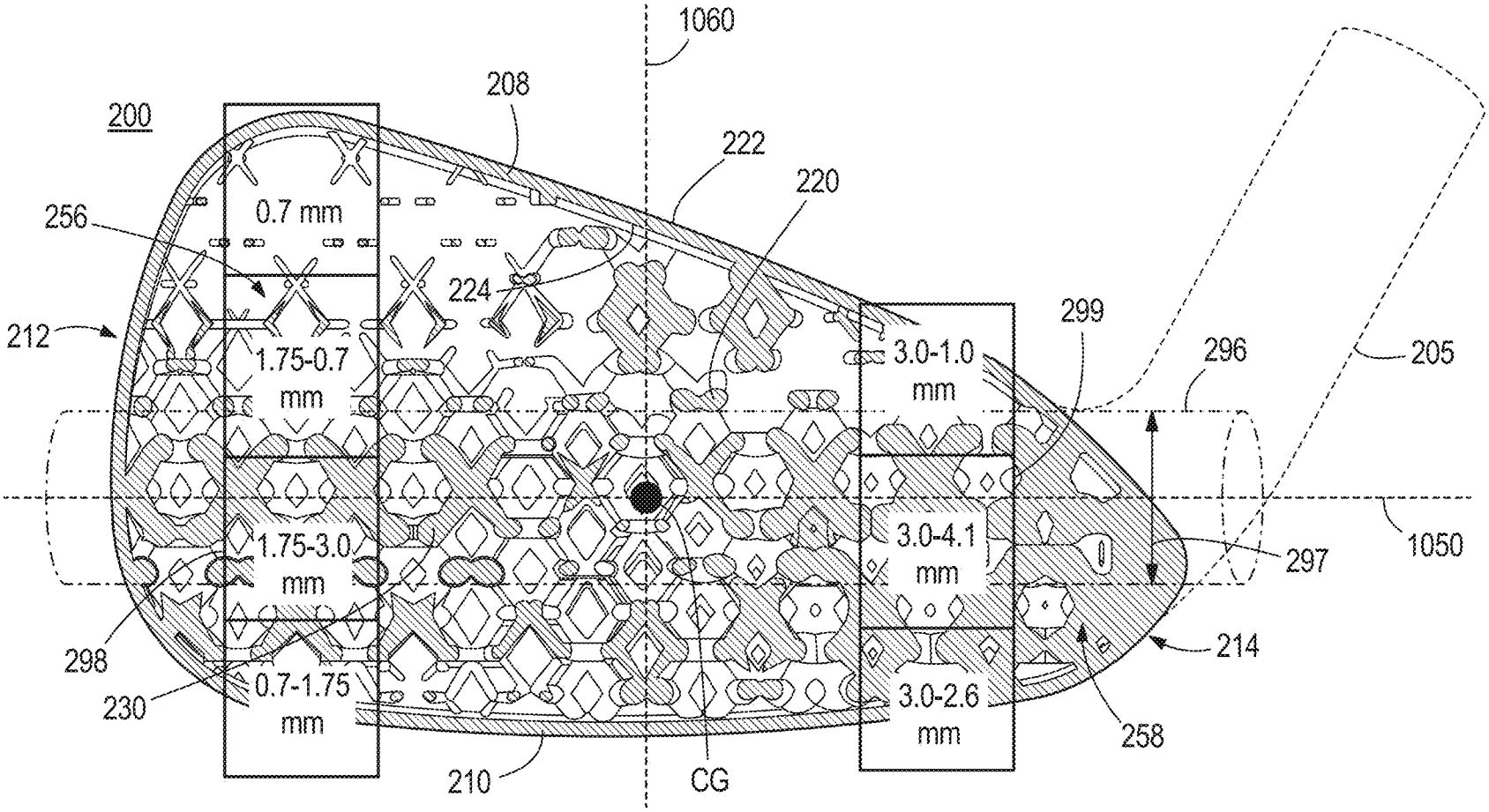
FIG. 12 illustrates a cross-sectional view of the iron-type golf club head of FIG. 11, taken along line II-II of FIG. 11.

Referring to FIG. 12, in some embodiments, the maximum effective density of the second iron club head 200 can be located within a horizontal reference cylinder 297 centered about and extending along the X-axis 1050. The horizontal reference cylinder 297 can be radiused about the X-axis 1050 and can extend all the way from the toe end 212 to the heel end 214. In many embodiments, the horizontal reference cylinder 297 comprises a radius ranging between 0.25 inches and 0.50 inches. In some embodiments, the radius of the horizontal reference cylinder 297 can be between 0.25 inches and 0.30 inches, between 0.30 inches and 0.35 inches, between 0.35 inches and 0.40 inches, between 0.40 inches and 0.45 inches, or between 0.45 inches and 0.50 inches. In some embodiments, the radius of the horizontal reference cylinder 297 can be between 0.25 inches and 0.35 inches, between 0.30 inches and 0.40 inches, between 0.35 inches and 0.45 inches, or between 0.40 inches and 0.50 inches.

Referring to FIGS. 11-14, the variable effective density of the second iron club head 200 can be described in relation to the effective density profiles of a plurality of cross sections (II, III, IV) taken parallel to the face 204 at different depths. As evident from the illustrated beam thicknesses, FIG. 12 shows the effective density profile of the second iron club head 200 at a plane II-II that is 0.25 inches rearward of the face 204. At 0.25 inches rearward of the face 204, the second iron club head 200 comprises a maximum effective density within the horizontal reference cylinder 297 and towards the heel 214 and a minimum effective density proximate the top rail 208 and toe 212. The effective density generally decreases from the horizontal reference cylinder 297 toward the sole 210 and the top rail 208.

Figure 13:
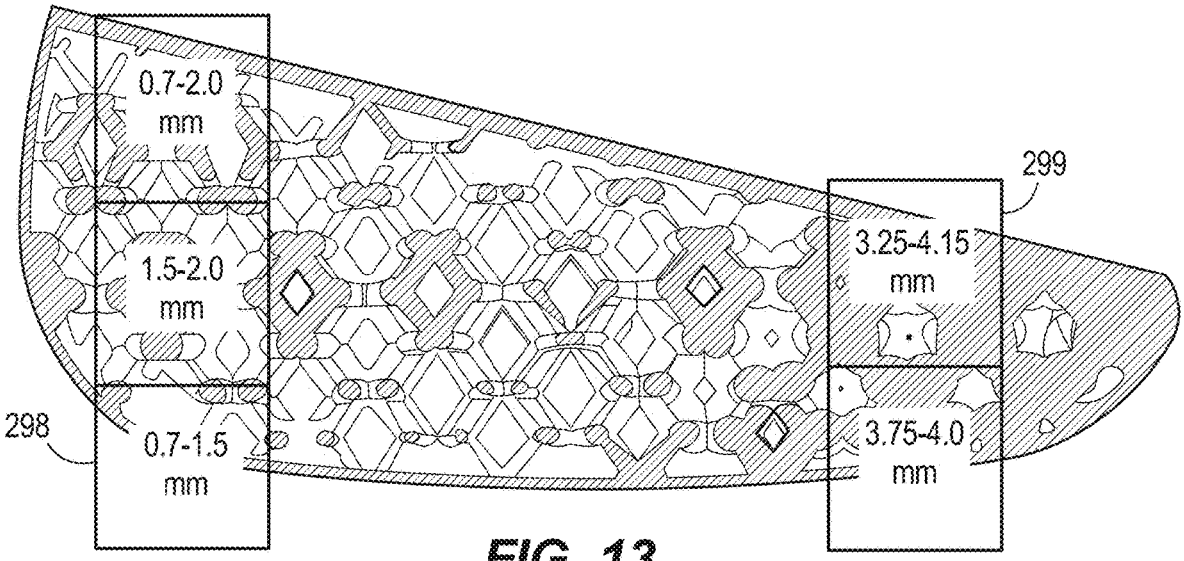
FIG. 13 illustrates a cross-sectional view of the iron-type golf club head of FIG. 11, taken along line of FIG. 11.

As evident from the illustrated beam thicknesses, FIG. 13 shows the effective density profile of the second iron club head 200 at a plane III-III that is 0.5 inches rearward of the face 204. Along this plane III-III, the second iron club head 200 comprises a maximum effective density proximate the sole 210 (and near the extreme heel end 214) and a minimum effective density proximate the sole 210 (and near the toe end 212). The effective density generally decreases from the horizontal reference cylinder 297 toward the sole 210 and the top rail 208. Further, the effective density at 0.5 inches rearward of the face 204 generally decreases from the heel end 214 to the toe end 212. The effective density near the toe end 212 at 0.5 inches rearward of the face is less than the effective density near the toe end 212 at 0.25 inches rearward of the face 204. The effective density near the heel end 214 at 0.5 inches rearward of the face 204 is greater than the effective density near the heel end 212 at 0.25 inches rearward of the face 204.

Figure 14:
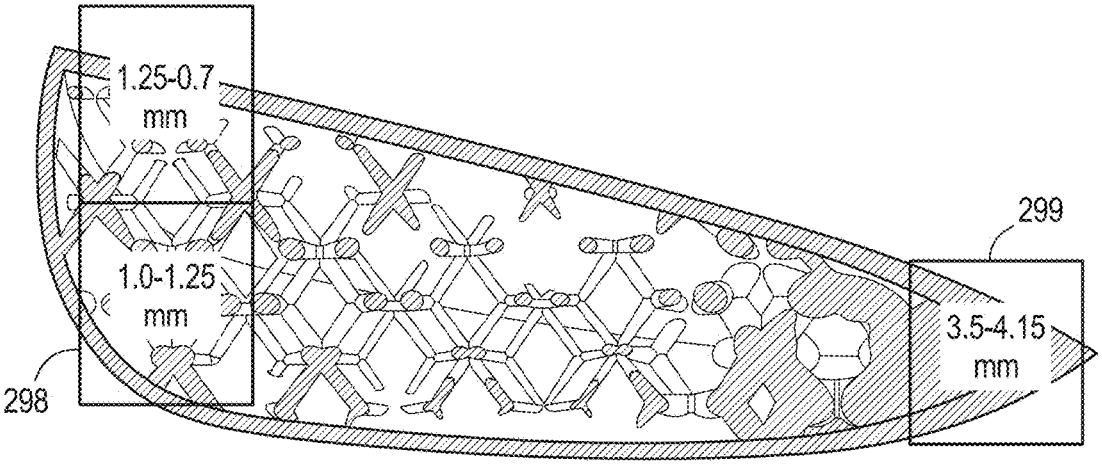
FIG. 14 illustrates a cross-sectional view of the iron-type golf club head of FIG. 11, taken along line IV-IV of FIG. 11.

As evident from the illustrated beam thicknesses, FIG. 14 shows the effective density profile of the second iron club head 200 at a plane IV-IV that is 0.75 inches rearward of the face 204. At 0.75 inches rearward of the face 204, the second iron club head 200 comprises a maximum effective density proximate the sole 210 (and near the extreme heel end 214) and a minimum effective density proximate the toe 212 and near an upper perimeter of the club head 200. The effective density at 0.75 inches rearward of the face 204 decreases drastically from the heel end 214 to the toe end 212. The effective density near the toe end 212 at 0.75 inches rearward of the face 204 is less than the effective density near the toe end 212 at 0.25 inches and 0.5 inches rearward of the face. The effective density near the heel end 214 at 0.75 inches rearward of the face 204 is greater than the effective density near the heel end 212 at 0.25 and 0.5 inches rearward of the face 204.

The varying density profile in a front-to-rear direction can be further described in relation to box regions (or reference boxes). FIGS. 12-14 depict box regions showing ranges of beam thickness 144 within each region. As described above with reference to FIG. 6, beam thickness 144 correlates to effective density. Therefore, the variations in beam thicknesses 144 shown in FIGS. 12-14 correlate to changes in the effective density profile of the second iron club head 200.

The box regions correspond to one another throughout FIGS. 12-14. For example, the box region 298 in FIG. 12 positionally corresponds to the box region 298 in FIGS. 13 and 14. Referring to FIGS. 12-14, a toe box region 298 can be defined partially within high-toe quadrant 174, partially within the low-toe quadrant 175, and within an area between the toe end 112 and the y-axis 1060. At 0.25 inch behind the face 204 (FIG. 12, taken along plane II-II), the toe box region 298 can comprise beam thicknesses between 1.75 mm and 3.0 mm. At 0.5 inch behind the face 204 (FIG. 13, taken along plane III-III), the toe box region 298 can comprise beam thicknesses 144 between 1.5 mm and 2.0 mm. At 0.75 inch behind the face, the toe box region 298 can comprise beam thicknesses 144 between 1.0 mm and 1.25 mm. The beam thicknesses 144 within the toe box region 298 can generally decrease, lowering effective density, from the face 204 towards the rear 206 of the club head 200.

Referring to FIGS. 12-14, a heel box region 299 can be defined partially within high-heel quadrant 176, partially within the low-heel quadrant 177, and within an area between the heel end 214 and the y-axis 1060. At 0.25 inch behind the face 204 (FIG. 12, taken along plane II-II), the heel box region 299 can comprise beam thicknesses between 3.0 mm and 4.1 mm. At 0.5 inch behind the face 204 (FIG. 13, taken along plane III-III), the heel box region 299 can comprise beam thicknesses 144 between 3.25 mm and 4.15 mm. At 0.75 inch behind the face, the heel box region 299 can comprise beam thicknesses 144 between 3.5 mm and 4.15 mm. The beam thicknesses 144 within the heel box region 299 can generally decrease, lowering effective density, from the face 204 towards the rear 206 of the club head 200.

The effective density profile of the second iron club head 200 creates asymmetric weighting with respect to the X-axis, the Y-axis, and the Z-axis. Such asymmetric weighting is caused by increasing the mass toward the rear on the heel side 214 and decreasing the mass toward the rear on the toe side 212, all while retaining a relatively high mass in the low-heel 177 and/or high-toe 174 quadrants. This specific asymmetry in the club head 200 is desirable for providing an increased (i.e. more positive or less negative) Ixy and Ixz with respect to similar club head lacking lattice structures. As will be discussed in further detail below, increasing both Ixy and Ixz values with respect to a similar club creates less undesirable sidespin on shots mis-hit above or below face center C.

Iron Embodiment 3

Figure 17:
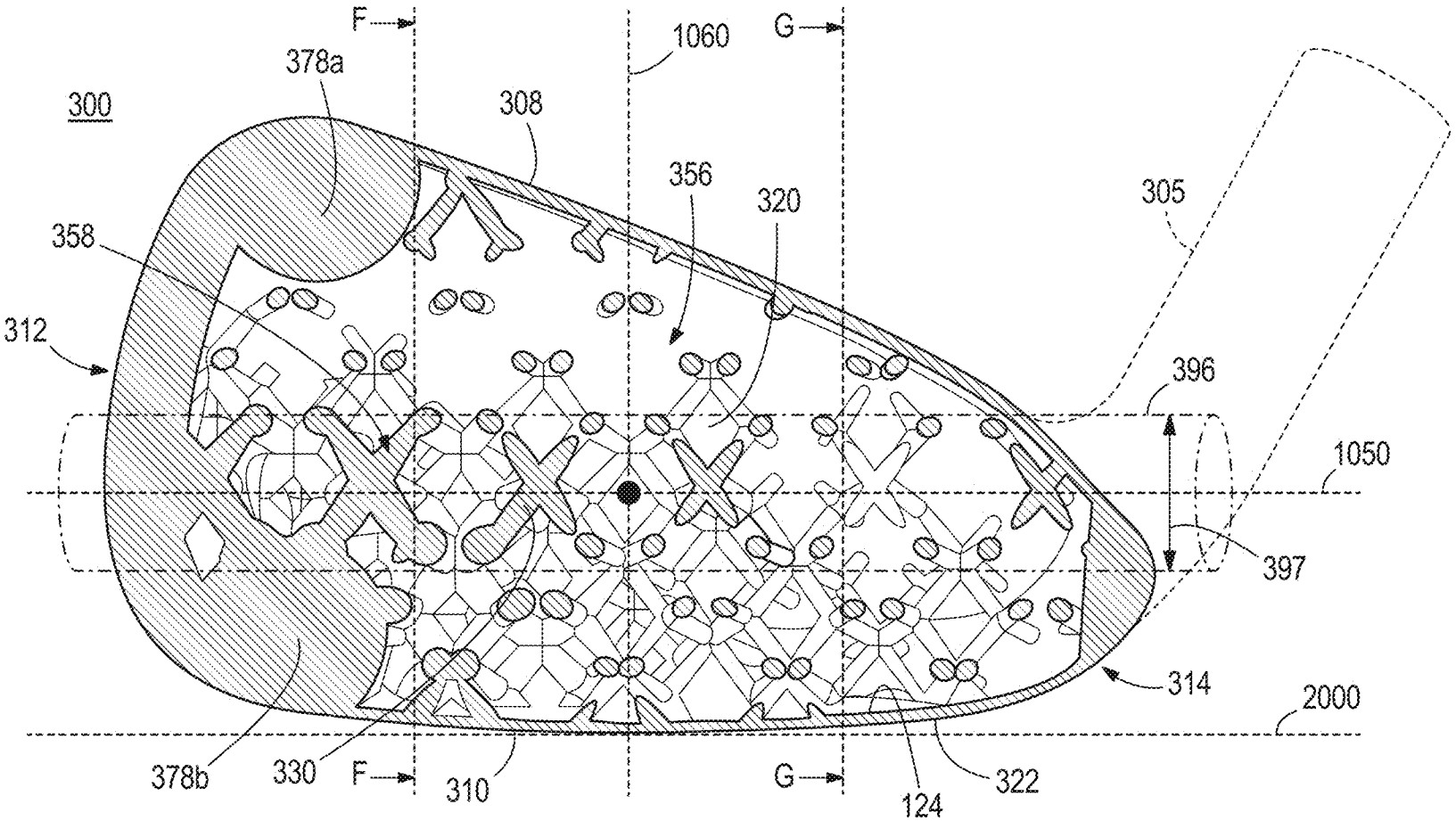
FIG. 17 illustrates a cross-sectional view of an iron-type golf club head comprising a lattice structure, according to one embodiment, taken along a line in the same position as line I-I of FIG. 3.
Figure 19:
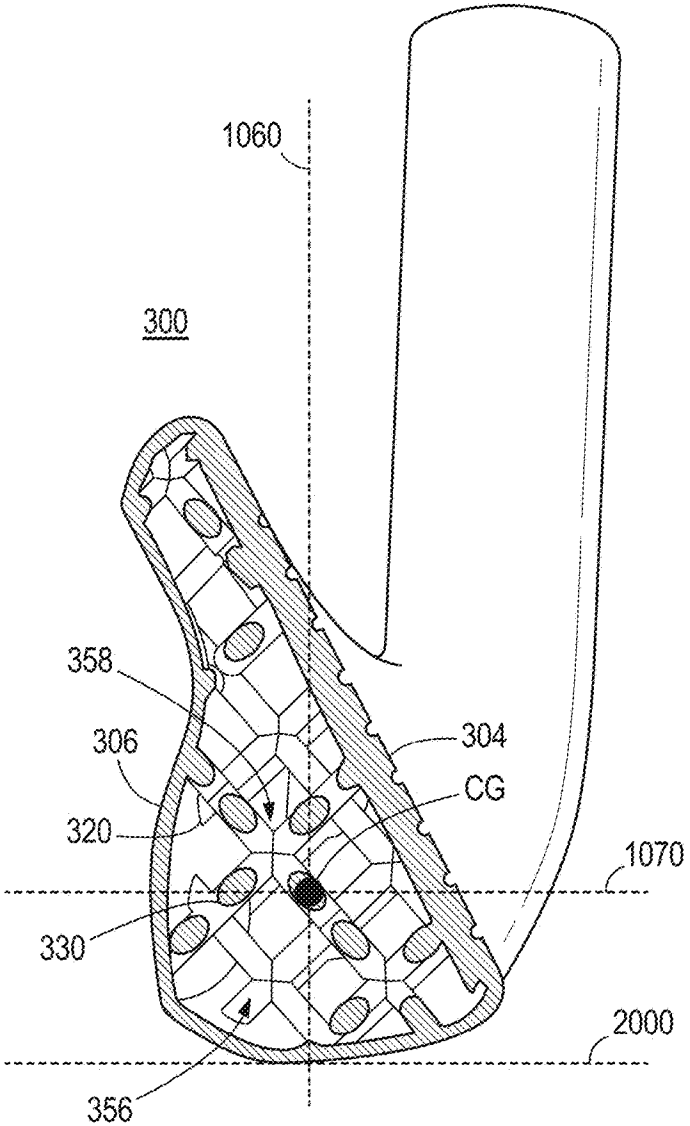
FIG. 19 illustrates a cross-sectional view of the iron-type golf club head of FIG. 17, taken along a line located in the same position as line B-B in FIG. 2, except taken in the opposite direction (i.e. a toe-view cross-section rather than a heel-view).
Figure 18:
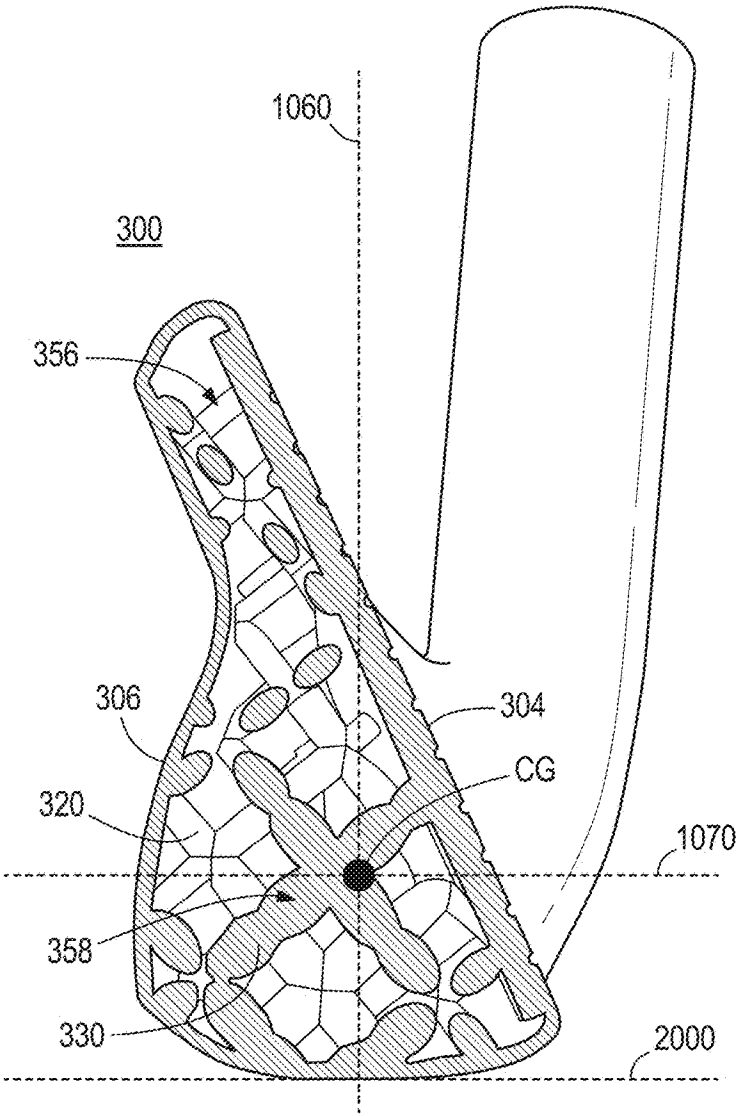
FIG. 18 illustrates a cross-sectional view of the iron-type golf club head of FIG. 17, taken along a line located in the same position as line D-D in FIG. 2, except taken in the opposite direction (i.e. a toe-view cross-section rather than a heel-view).

Referring to FIG. 17-19, a third iron embodiment 300 can comprise a lattice structure 330 with an effective density that varies in a sole-to-top-rail direction. The third iron club head 300 can further comprise a plurality of internal weight members 378 located proximate the toe. The plurality of internal weight members 378 were included to shift the club head 300 CG position closer to the toe end 312 while also increasing Ixy.

As illustrated by FIG. 17, the maximum effective density lattice structure 330 can be located within a horizontal reference cylinder 397 centered about and extending along the X-axis 1050. The horizontal reference cylinder 397 can be identical to horizontal reference cylinder 297 of the second iron club head 200 and can be similarly radiused. The effective density of the lattice structure 330 can generally decrease moving away from the horizontal reference cylinder 397 and toward the top rail 308 and the sole 310. In this embodiment, the effective density of the lattice 330 can remain approximately uniform in a front-to-rear direction.

In addition to the lattice structure 330, mass can be distributed by the plurality of internal masses 378. The plurality of internal masses 378 can be integrally formed with the club head 300 and can protrude from the internal surface 324 and into the interior cavity 320. The plurality of internal masses 378 can be made of the same material as the remainder of the club head 300. The plurality of internal masses 378 can be solid masses of material and can comprise an effective density greater than the effective density of any portion of the lattice structure 330. As illustrated in FIG. 17, the third iron club head 300 comprises a first internal mass 378*a* and a second internal mass 378*b*. The first internal mass 378*a* can be located proximate the top rail 308 and the toe end 312, while the second internal mass 378*b* can be located proximate the sole 310 and the toe end 312.

Although the maximum effective density 358 of the lattice structure 330 alone is located within the horizontal reference cylinder 397, the effective density within the interior cavity 320 as a whole is influenced by internal masses 378. Thus, the overall greatest effective density within the interior cavity 320 is located in the high-toe quadrant 174 and/or the low-toe quadrant 175. The minimum effective density within the interior cavity 320 is located within the high-heel quadrant 176 and/or the low-heel quadrant 177, specifically in areas of the high-heel quadrant 176 and low-heel quadrant 177 that are not located within the horizontal reference cylinder 397.

The density profile of the third iron club head 300 can result in increased POI values, particularly Ixy and Ixz, over a club head with no lattice structure or internal masses. The asymmetric weighting with respect to the X-axis, the Y-axis, and the Z-axis is caused by providing a relatively high effective density in the high-toe quadrant 174 and a relatively low effective density in the high-heel quadrant 176. This specific asymmetry in the club head 100 leads to increased (i.e. more positive or less negative) Ixy and Ixz. As will be discussed in further detail below, increasing both Ixy and Ixz values creates less undesirable sidespin on shots mis-hit above or below face center C.

The intent of the third club head embodiment 300 was to improve POI and move the CG position simultaneously. The inclusion of the internal weight members 378 was designed to produce a CG position toe-ward of the previously described embodiments 100, 200. Additional arrangements of the lattice structure 330 and/or the internal weight members 378 can achieve a combined balance of improved POI at a desirable CG position.

Iron Embodiment 4

Figure 20:
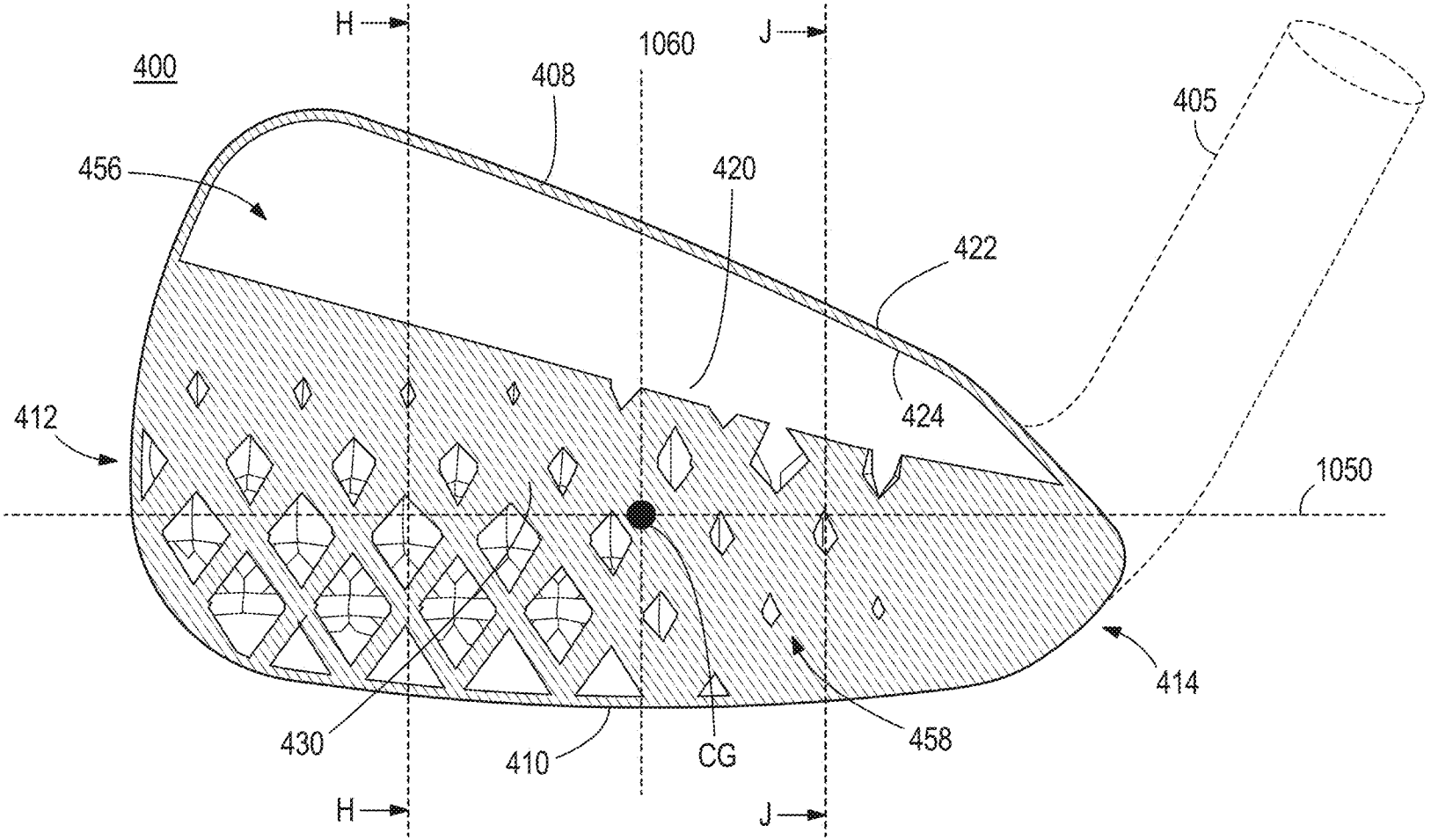
FIG. 20 illustrates a cross-sectional view of an iron-type golf club head comprising a lattice structure, according to one embodiment, taken along a line in the same position as line I-I of FIG. 3.
Figure 22:
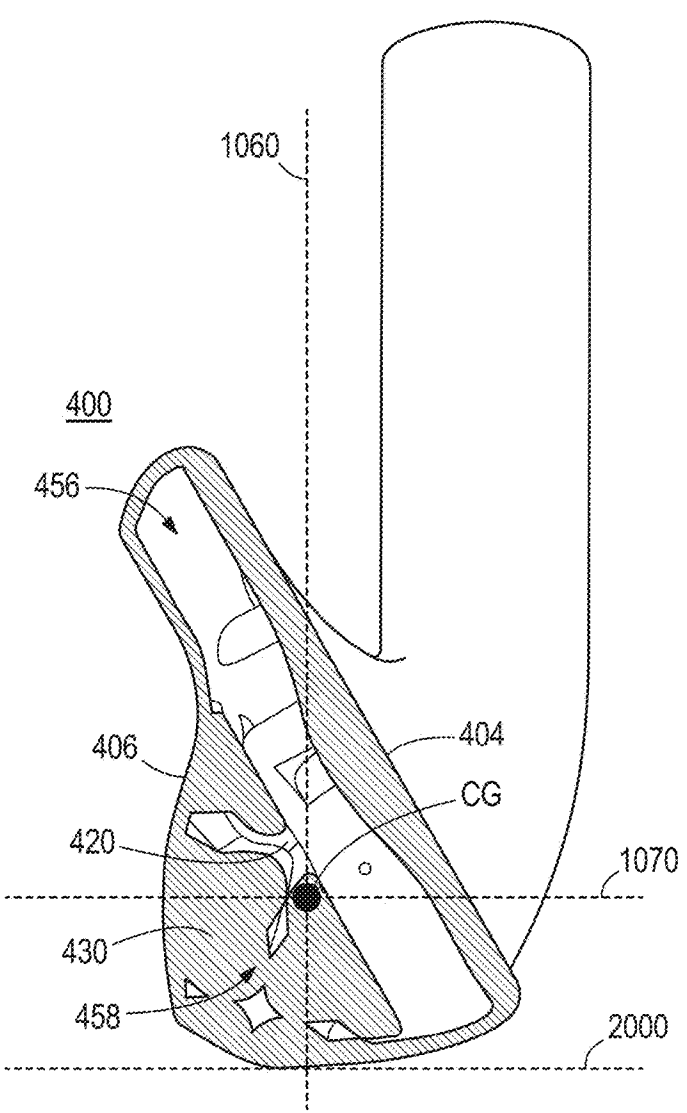
FIG. 22 illustrates a cross-sectional view of the iron-type golf club head of FIG. 20, taken along a line located in the same position as line B-B in FIG. 2, except taken in the opposite direction (i.e. a toe-view cross-section rather than a heel-view).
Figure 21:
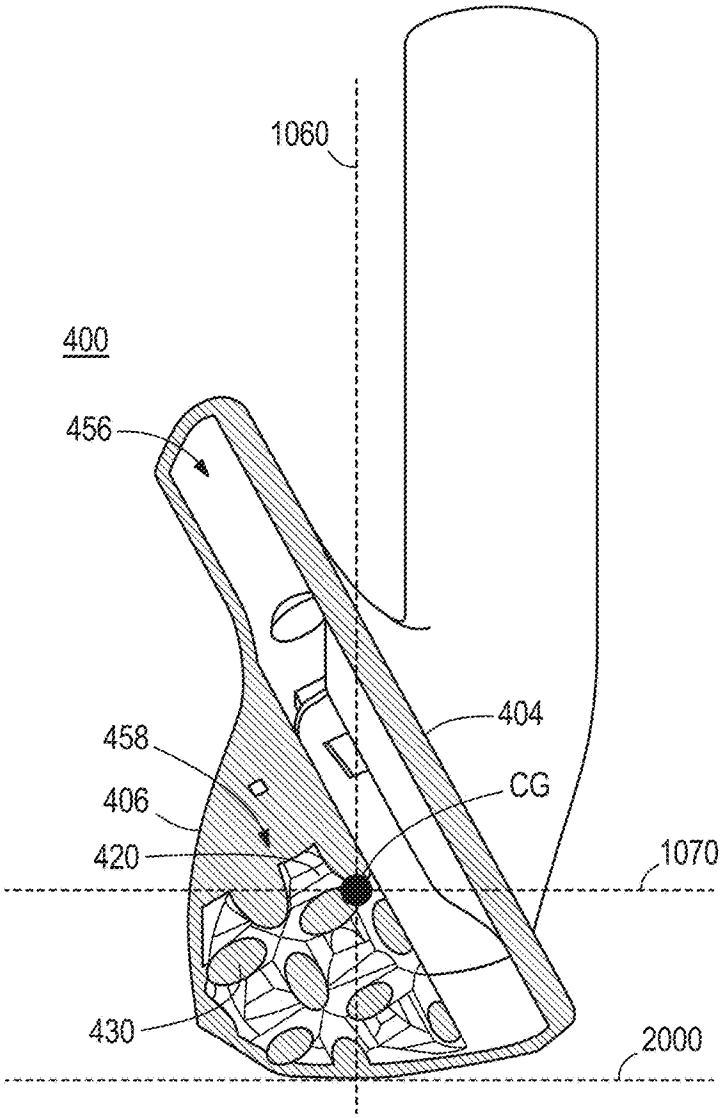
FIG. 21 illustrates a cross-sectional view of the iron-type golf club head of FIG. 20, taken along a line located in the same position as line D-D in FIG. 2, except taken in the opposite direction (i.e. a toe-view cross-section rather than a heel-view).

Referring to FIG. 20-22, a fourth iron embodiment 400 can comprise a lattice structure 430 that does not contact the strike face. The lattice structure 430 of the fourth iron embodiment 400 is spaced rearwardly from the face 404 such that the lattice structure 430 is housed only within a portion of the interior cavity 420 near the rear 406. Within the lattice structure 430, the maximum lattice density 458 can be located within the high-toe quadrant 174 and/or the low-heel quadrant 177. The lattice structure 430 effective density can be reduced within the low-toe quadrant 175 and/or the high-heel quadrant 176. The overall minimum effective density 456 occurs in the portion of the interior cavity 420 proximate the face 404, wherein the minimum effective density 456 is zero and the portion of interior cavity 420 proximate the face 404 is devoid of the lattice structure 430. The effective density of the lattice structure 430 within the toe half (i.e. towards the toe end 412) of the club head 400, including the high and low toe quadrants 174, 175, can increase from the sole 410 towards the top rail 408. Conversely, the effective density of the lattice structure 430 within the heel half (i.e. towards the heel end 414) of the club head 400, including the high and low heel quadrants 176, 177, can decrease from the sole 410 towards the top rail 408. In this embodiment, the effective density of the lattice structure 430 can remain approximately uniform in a front-to-rear direction.

The effective density profile of the fourth iron club head 400 can result in favorable POI values, particularly Ixy, while allowing for the maximized deflection of the face 404 upon impact with a golf ball. The asymmetric weighting with respect to the X-axis 1050 and the Y-axis 1060 is caused by increasing the mass within the high-toe quadrant 174 and low-heel quadrant 177, while simultaneously reducing mass within the low-toe quadrant 175 and the high-heel quadrant 176. This specific asymmetry in the club head 400 is desirable for providing an increased (i.e. more positive or less negative) Ixy. As will be discussed in further detail below, a more positive Ixy creates less undesirable sidespin on shots mis-hit above or below face center. Further, the space between the face 404 and the lattice structure 400 allows the face to flex more upon impact with a golf ball, compared to a similar lattice structure that contacts the face 404. By allowing for maximum flexure of the face 404, the club head 400 retains high ball speeds while also possessing the benefit of improved Ixy due to the density profile of the lattice structure 430.

Iron Advantages

The lattice structures 130 advantageously allow for the redistribution of mass to provide an iron-type club head 100 with improved products of inertia (POI). Improvement of the products of inertia (POI) can lead to improved performance in the iron-type club head 100, such as a reduction or negation of the sidespin imparted to the golf ball upon impact above or below the center C of the face 104. The iron-type club head embodiments 100, 200, 300, 400 described above follow the principles described below relating to negation of sidespin on high and low mis-hits by the improvement of iron-type club head products of inertia.

The iron-type golf club head 100 comprises an inertia tensor. The inertia tensor for the club head 100 is represented by equation (1) below. Generally, for greatest performance, the inertia tensor principal axis (Ixx, Iyy, Izz) is maximized. The tensors along the inertia tensor principal axis are referred to as the club head's moments of inertia (MOT) about the x-axis (Ixx), the y-axis (Iyy), and the z-axis (Izz). The greater the MOT, the less likely it is for the club head 100 to experience rotation when a torque is applied (i.e., not striking the golf ball in the geometric centerpoint 116 of the strike face 104). It is often assumed that if the MOT of the club head 100 is maximized, and the golf ball is struck near the face center C, the golf ball will fly straight. However, the golf club head 100 still experiences three main rotational effects due to the dynamics of an individual's golf swing that effect the trajectory of the ball.

$$I = \begin{bmatrix} I_{xx} & I_{xy} & I_{xz} \\ I_{xy} & I_{yy} & I_{yz} \\ I_{xz} & I_{yz} & I_{zz} \end{bmatrix} \quad (1)$$

Figure 23C:
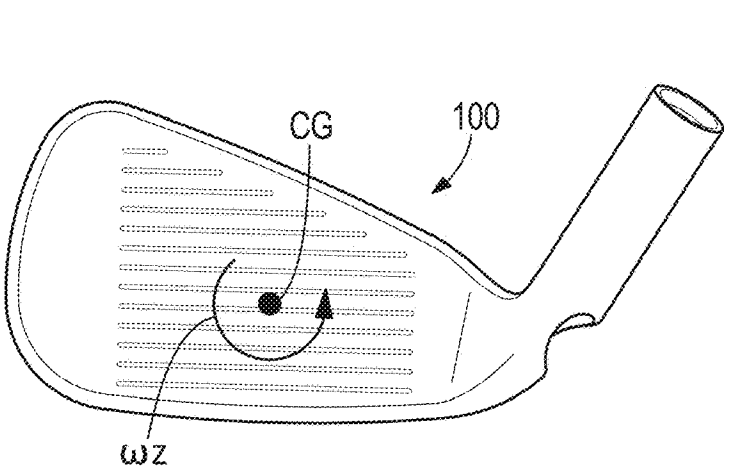
FIG. 23C illustrates the natural drooping rotation of a club head that occurs throughout a golf swing.
Figure 23B:
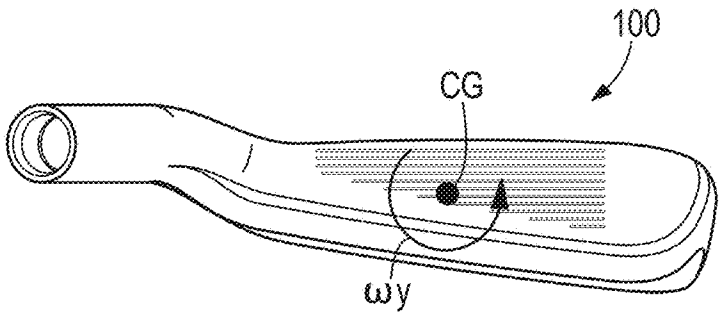
FIG. 23B illustrates the natural closing rotation of a club head that occurs throughout a golf swing.
Figure 23A:
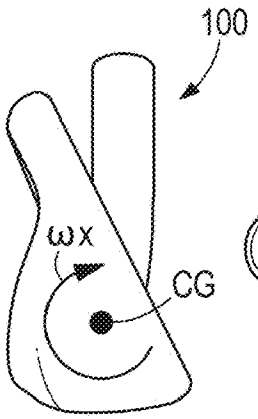
FIG. 23A illustrates the natural lofting rotation of a club head that occurs throughout a golf swing.

Referring to FIGS. 23A-23C, there are three main rotational effects that the golf club head 100 experiences through impact that are user generated (inherently caused by the golfer swinging the golf club). In reference to FIG. 23A, the first effect, the lofting rate, is the time rate of change of the loft angle $\alpha$ of the golf club head 100. The lofting rate is the velocity of a lofting rotation $\omega_x$ about the x-axis 1050 of the golf club head 100. In reference to FIG. 23B, the closure rate is the time rate of change of a face angle of the golf club head 100. The closure rate is the velocity of a closing rotation $\omega_y$ about the y-axis 1060 of the golf club head 100. Finally, in reference to FIG. 23C, the third effect, the drooping rate, is the time rate of change of a lie angle of the golf club head 100 at impact. The drooping rate is the velocity of a drooping rotation $\omega_z$ about the z-axis 1070 of the golf club head 100.

Further, in addition to the three main user generated rotational effects, a path the golf club 100 is swung on and a face angle of the golf club head 100 at impact are also user generated dynamics of an individual's swing that affect the amount of spin imparted to the golf ball. The face angle of the golf club 100 at impact is the angle formed between a target line (a line formed from the golf ball to the desired end point of the golf ball) and a face line (a direction vector extending perpendicularly from the center C of the strike face 104, when projected onto the ground plane). The golf club path is the angle formed between the target line and a velocity vector of the golf club head 100, at the point of impact with the golf ball. Any difference between face angle and club path generates unwanted sidespin. The greater the difference in face angle and club path, the greater the sidespin generated.

Referring to FIGS. 23A-23C, when the golfer strikes the golf ball above or below the center C of the strike face 104, the closing rotation $\omega_y$ and the drooping rotation $\omega_z$ of the club head 100 causes sidespin to be generated. Referring back to FIG. 3, the strike face 104 of the golf club head 100 is positioned at a loft angle $\alpha$. Consequently, the Y-axis 1060 intersects the strike face in such away that certain impact locations 101, such as impacts below the CG, occur forward of the Y-axis 1060 (i.e. forward of the CG in the Z direction). Other impacts, such as any impacts above the CG and located outside of the center region 10, occur rearward of the Y-axis 1060 (i.e. rearward of the CG in the Z direction). Because the closing rotation $\omega_y$ occurs about the Y-axis 1060, every point on the strike face 104 located forward of the Y-axis 1060 moves toward the heel end 114 of the club head 100 at impact and every point on the strike face 104 located rearward of the Y-axis 1060 moves toward the toe end 112 of the club head 100 at impact. Similarly, referring to FIG. 23C, for a positive drooping rate, the drooping rotation $\omega_z$ causes every point of the strike face 104 located below the CG (i.e. located below the Z-axis 1070) to move toward the heel end 114 at impact. Conversely, for a positive drooping rate, the rotation about the Z-axis 1070 in a toe-down direction causes every point on the strike face 104 located above the CG (i.e. located above the Z-axis 1070) to move toward the toe end 112. Thus, given desirable delivery parameters (i.e. delivery of the club head 100 that would produce a straight shot if impacted at center C), the closing rotation $\omega_y$ and the drooping rotation $\omega_z$ influence golf shots struck above center C to draw. Conversely, the closing rotation $\omega_y$ and the drooping rotation $\omega_z$ influence golf shots struck below center C to fade. The further above or below center C the ball is struck, the more sidespin is generated.

In addition to the sidespin generated by the natural closing rotation $\omega_y$ and drooping rotation $\omega_z$ of the club head 100, sidespin is also generated by angular accelerations experienced by the club head 100 at impact. Such angular accelerations are generated by moments associated with the force of impact between the ball and the club head 100 on an off-center strike. When a golfer strikes the ball just below or just above the center C of the strike face 104 (in a top rail 108 to sole 110 direction), the force of impact between the ball and the club head 100 imparts a lofting moment ($-M_x$), a closing moment ($M_y$), and a drooping moment ($M_z$) on the club head 100 that create a lofting acceleration $-\alpha_x$ (or de-lofting acceleration ax), a closing acceleration $\alpha_y$ (or opening acceleration $-\alpha_y$), and a drooping acceleration $\alpha_z$ (or a toe-up acceleration $-\alpha_z$). The angular accelerations experienced by the club head 100 when struck just above or below center C can be represented by equations (2), (3), and (4) below. These angular accelerations create a gearing effect between the ball and the strike face 104 that influences the amount of spin imparted to the ball. Assuming the golf ball is being struck above or below the x-axis 1050, but on (contacting) the y-axis 1060, the moments applied about the y-axis 1060 and z-axis 1070 are approximately zero ($M_y \approx 0$, $M_z \approx 0$), and thus are not illustrated. The moment applied about the x-axis 1050 ($M_x$) is directly proportional to how far the impact location of the golf ball is above or below face center (i.e., the farther above center C the ball is struck the greater the moment about the x-axis $M_x$).

$$\alpha_x \approx \frac{M_x}{I_{xx}} \tag{2}$$

$$\alpha_y \approx -\frac{I_{xy} M_x}{I_{xx} I_{yy}} \tag{3}$$

$$\alpha_z \approx -\frac{I_{xz} M_x}{I_{xx} I_{zz}} \tag{4}$$

In order to minimize angular accelerations of the golf club head 100 at impact, the moment of inertia about the x-axis 1050, y-axis 1060, and z-axis 1070 can be increased, subsequently increasing the forgiveness of the golf club head 100, since the golf club head 100 better resists rotational moments about the principal axes (x-axis, y-axis, z-axis). If the golf club head 100 better resists rotational moments about the principal axes, the club head 100 is more forgiving for off-center impacts. However, even when MOI is maximized and a golf ball is struck above or below center C (with desirable delivery parameters), the golf ball will still have unwanted sidespin due to the natural closing rotation $\omega_y$ and drooping rotation $\omega_z$ of the club head 100.

In general, prior art club heads seek to minimize the angular accelerations experienced by the club head at impact in an attempt to produce straight shots. However, simply minimizing the angular accelerations does not take into account the sidespin generated by the natural closing rotation ωy and drooping rotation $\omega_z$ of the club head. Rather than simply minimizing the angular acceleration in the club head 100, the present club head 100 products of inertia (POI) can be optimized to strategically manipulate the angular accelerations at impact. Specifically, the present club head 100 comprises a lattice structure 130 that increases Ixy and Ixz relative to a similar club head without such lattice structures by providing a maximum effective density 158 in the high-toe and low-heel quadrants 174, 177. The improved products of inertia (POI) can cause the moment $M_x$ about the X-axis 1050 to create favorable angular accelerations at impact about the Y-axis 1060 and the Z-axis 1070. These favorable angular accelerations counteract the unwanted sidespin from the natural closing rotation $\omega_y$ and drooping rotation $\omega_z$ for high and low face hits, while maintaining forgiveness in a heel 114 to toe 112 direction. The POI of the club head 100 can be optimized by the strategic inclusion of lattice structures 130 to create favorable angular accelerations that influence the ball to spin opposite the direction of the sidespin caused by the closing rotation $\omega_y$ and drooping rotation $\omega_z$ on a high or low mis-hit. Thus, the influence on sidespin due to the favorable angular accelerations at impact and the sidespin due to the natural closing rotation $\omega_y$ and drooping rotation $\omega_z$ of the club head 100 can counteract each other. Therefore, the sidespin caused by the POI of the club head 100 can minimize or negate the overall sidespin on a high or low mis-hit.

Optimally, the iron-type club head 100 can comprise Ixy and Ixz products of inertia that are both non-zero. Referring to FIGS. 7 and 8, both Ixy and Ixz can be simultaneously optimized by a lattice structure 130 with high effective density in the high-toe, low-heel, front-toe, and/or rear-heel regions 180, 183, 188, 191 and low effective density in the low-toe, high-heel, rear-toe, and/or front-heel regions 181, 182, 189, 190 to produce an iron-type club head 100 with minimal sidespin on high and low mis-hits. As will be discussed in greater detail below, sidespin on high and low mis-hits in an iron-type club head 100 cannot be completely negated by manipulating only Ixy or only Ixz individually. Rather, sidespin on high and low mis-hits is negated by an optimal combination of Ixy and Ixz values.

Figure 24A:
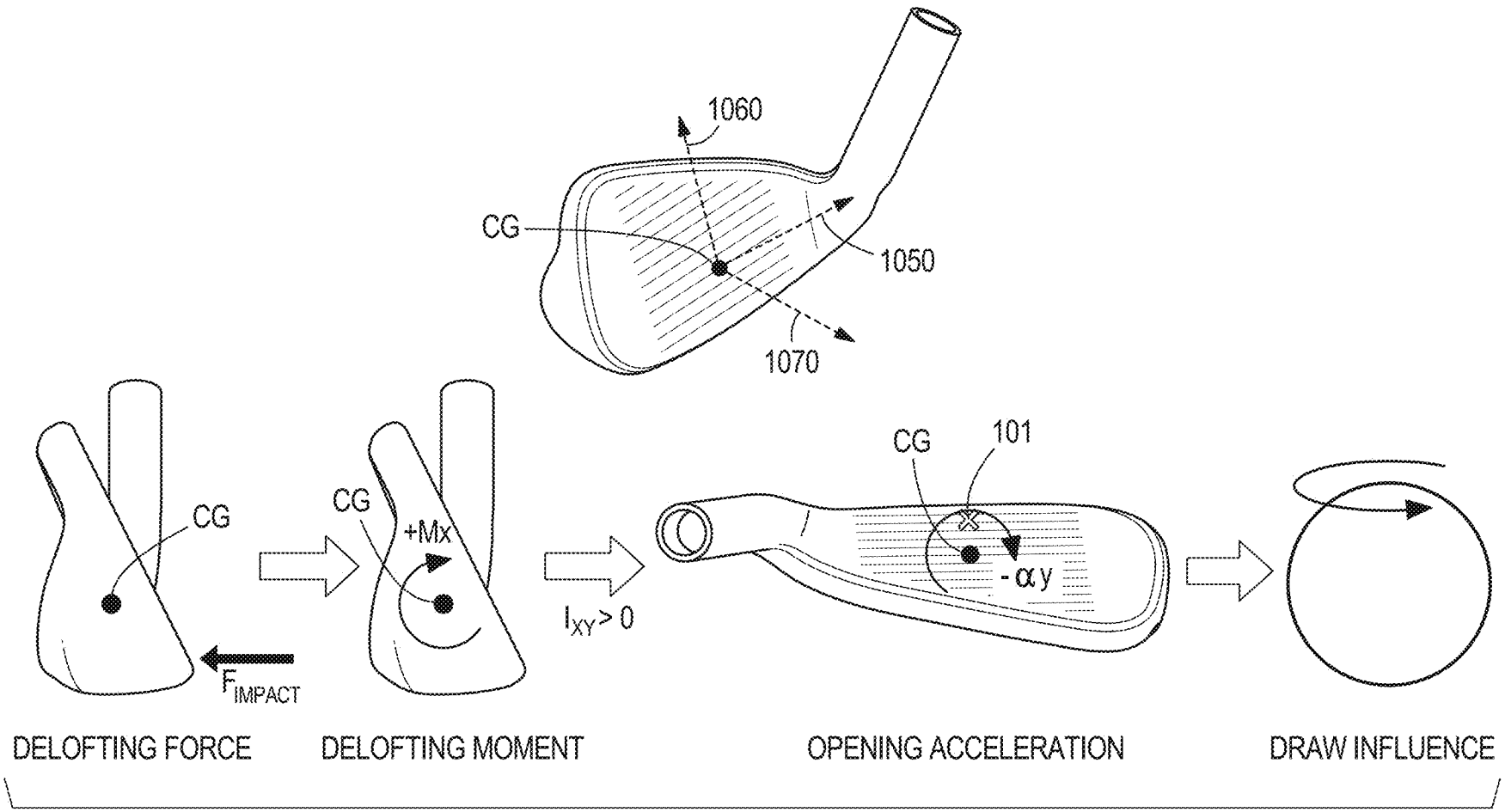
FIG. 24A illustrates an effect of a product of inertia Ixy that is greater than zero when a golf ball strikes below-center on the iron-type club head of FIG. 1.
Figure 24B:
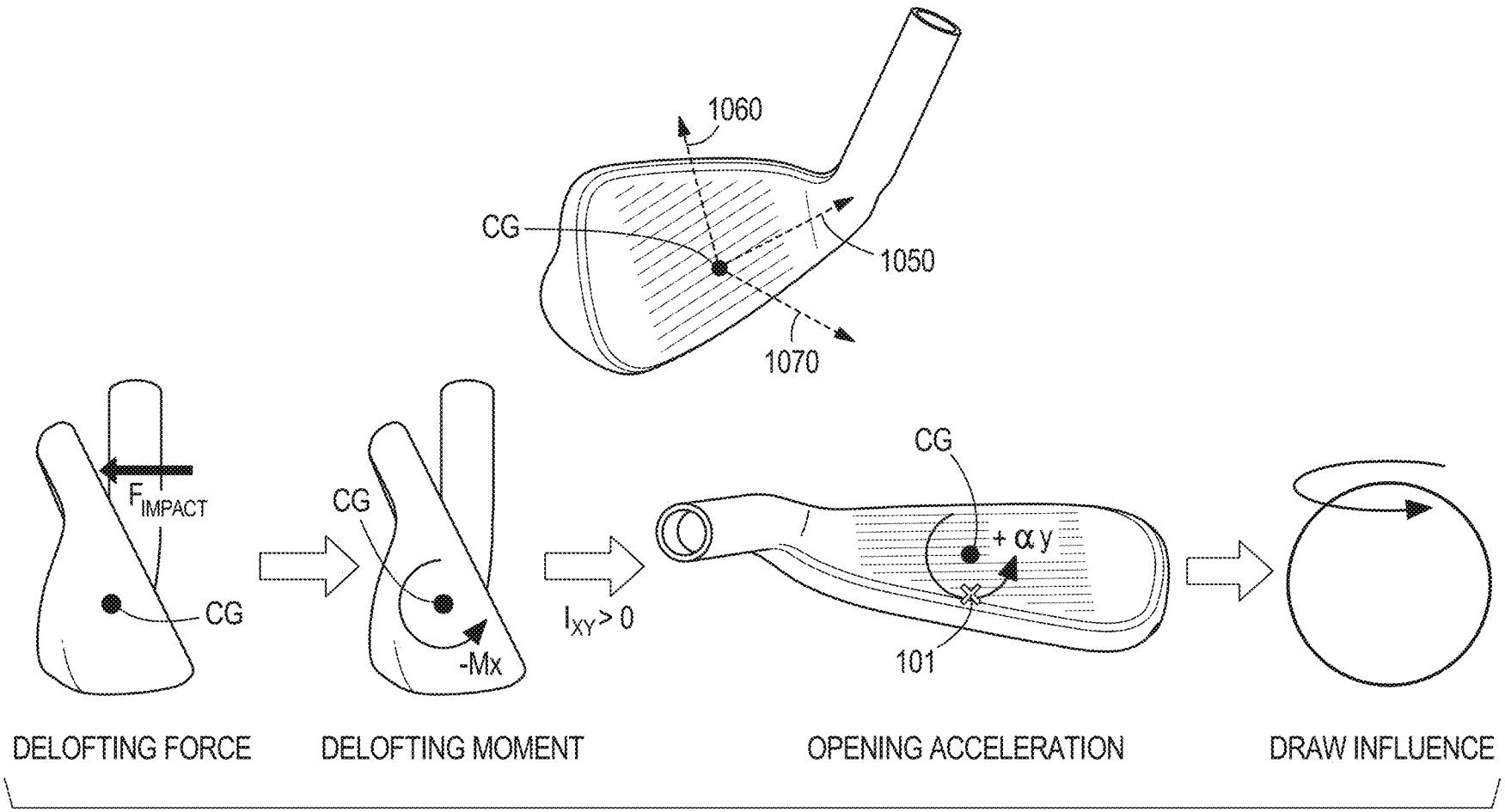
FIG. 24B illustrates an effect of a product of inertia Ixy that is greater than zero when a golf ball strikes above-center on the iron-type club head of FIG. 1.

FIGS. 24A and 24B illustrate the effects that a non-zero, positive Ixy has on sidespin for low and high mis-hits. Referring to FIG. 24A, when the golf club head 100, with a positive Ixy due to, is struck below the center C of the strike face 104, the club head 100 experiences a de-lofting moment ($+M_x$) about the X-axis 1050, which creates an opening acceleration $-\alpha_y$ about the Y-axis 1060. Due to the lofted face 104 of the iron-type club head 100, most low impacts occur forward of the CG in the Z direction (with the exception of impacts within the center region 10). At this impact location 101, the opening acceleration $-\alpha_y$ of the club head 100 influences the ball to draw, because any point on the face 104 forward of the CG accelerates toward the toe end 112. Referring to FIG. 24B, when the golf club head 100, with a positive Ixy, is struck above the center C of the strike face, the club head 100 experiences a lofting moment ($-M_x$) about the X-axis 1050, which creates a closing acceleration $\alpha_y$ about the Y-axis 1060. Due to the lofted face 104 of the iron-type club head 100, most high impacts occur rearward of the CG (with the exception of impacts within the center region 10). At such impact locations 101, the closing acceleration $\alpha_y$ of the club head 100 also influences the ball to draw, because any point on the face rearward of the CG accelerates toward the toe end 112.

Figure 25A:
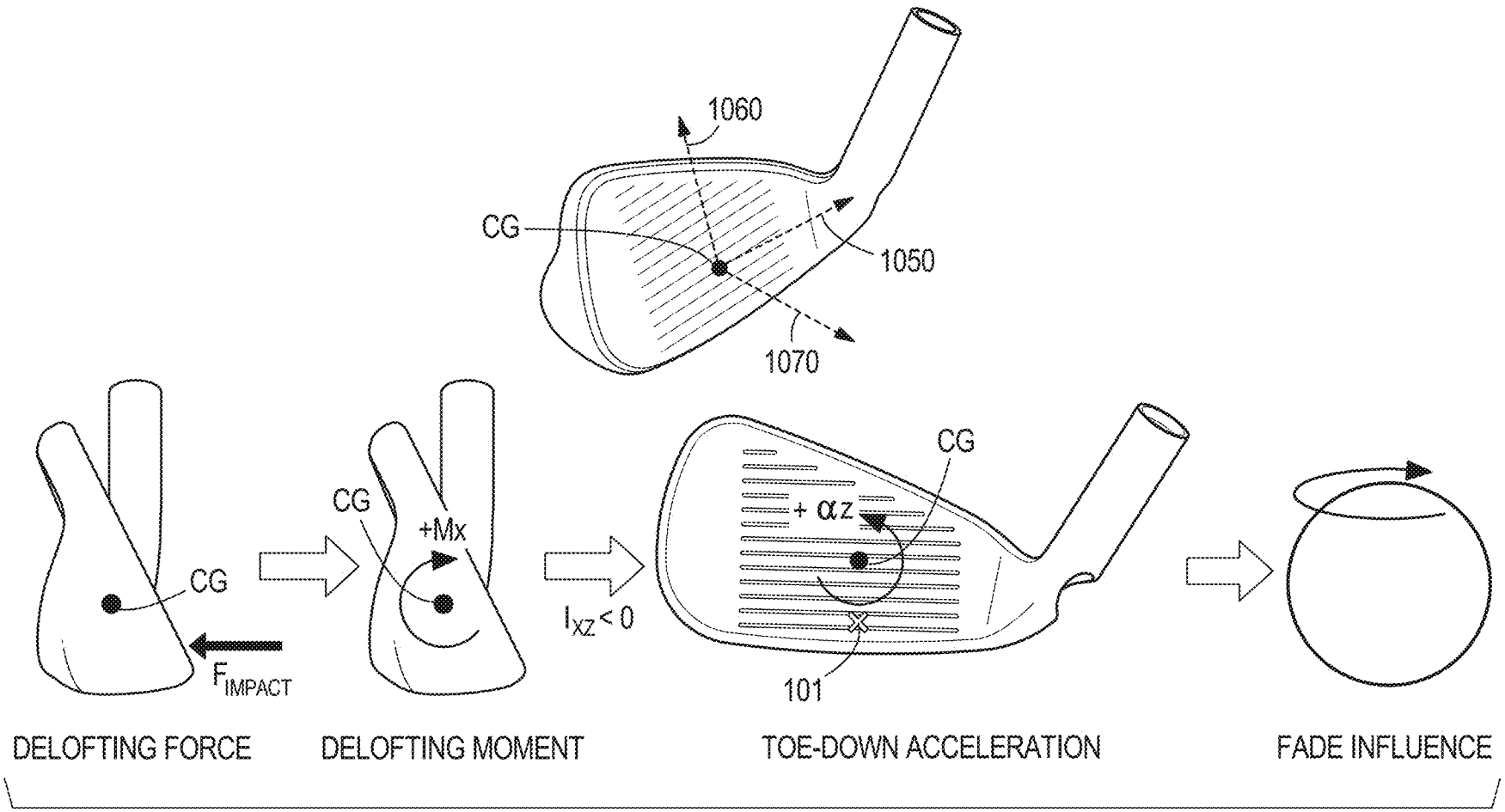
FIG. 25A illustrates an effect of a product of inertia Ixz that is less than zero when a golf ball strikes below-center on the iron-type club head of FIG. 1.
Figure 25B:
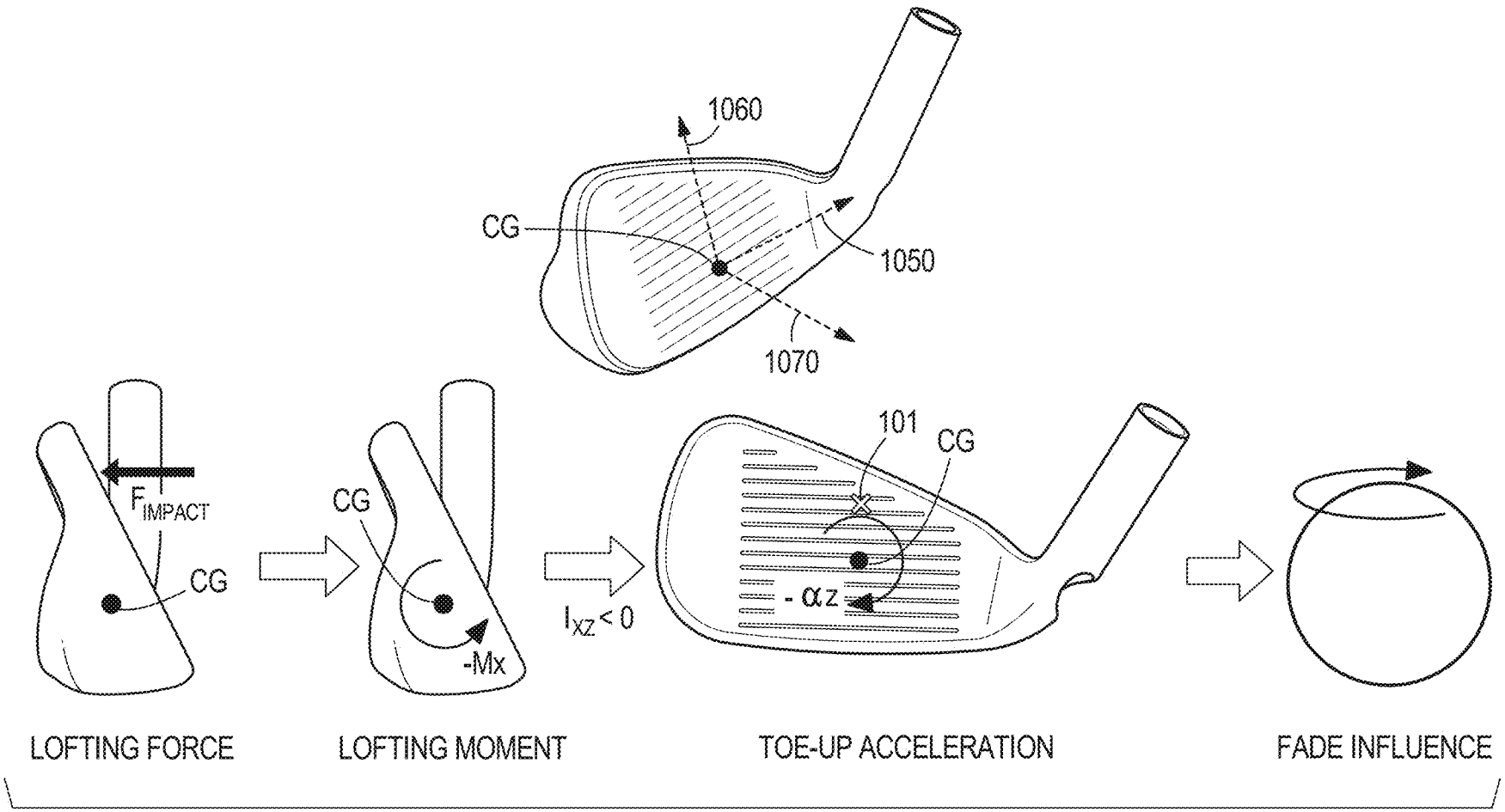
FIG. 25B illustrates an effect of a product of inertia Ixz that is less than zero when a golf ball strikes above-center on the iron-type club head of FIG. 1.

FIGS. 25A and 25B illustrate the effects that a non-zero, negative Ixz has on spin for low and high mis-hits. Referring to FIG. 25A, when the golf club head 100, with a negative Ixz, is struck below the center C of the strike face 104, the club head 100 experiences a de-lofting moment ($+M_x$) about the X-axis 1050, which creates a toe-down acceleration $\alpha_z$ about the Z-axis 1070. For an impact low on the face 104, the toe-down acceleration $\alpha_z$ influences the ball to fade, because as the toe 112 of the club head 100 rotates down, every point on the face 104 below the CG accelerates toward the heel end 114. Referring to FIG. 25B, when the golf club head 100 is struck above the center C of the strike face 104, and Ixz is negative, the club head 100 experiences a lofting moment ($-M_x$) about the X-axis 1050, which causes a toe-up acceleration $-\alpha_z$ about the Z-axis 1070. For an impact low on the face 100, the toe-up acceleration also influences the ball to fade, because as the toe 112 of the club head 100 rotates up, every point on the face 104 above the CG accelerates toward the heel end 114.

As discussed above, the effects of Ixy or Ixz individually are not sufficient to eliminate sidespin on high or low mis-hits. As illustrated by FIGS. 24A and 24B, a positive Ixy value in an iron-type club head 100 influences the ball to draw on both high and low mis-hits. This draw influence is favorable in counteracting sidespin on low mis-hits, as low mis-hits naturally tend to fade due to the natural closing rotation $\omega_y$ and drooping rotation $\omega_z$ of the club head 100. However, the draw influence of a positive Ixy value is not favorable on high mis-hits, because the draw influence will accentuate the natural draw spin created on high mis-hits by the closing rotation $\omega_y$ and drooping rotation $\omega_z$ of the club head 100. Conversely, as illustrated by FIGS. 25A and 25B, a negative Ixz value in an iron-type club head 100 influences the ball to fade on both high and low mis-hits. This fade influence is favorable in counteracting sidespin on high mis-hits, as high mis-hits naturally tend to draw due to the closing rotation $\omega_y$ and drooping rotation $\omega_z$ of the club head 100. However, the fade influence of a positive Ixz value is not favorable on low mis-hits, because the fade influence will actually accentuate the natural fade spin created on low mis-hits by the closing rotation $\omega_y$ and drooping rotation $\omega_z$ of the club head 100.

To negate sidespin caused by high or low mis-hits, a combination of a positive Ixy and a negative Ixz is required. An optimal combination of a positive Ixy value and a negative Ixz value must be achieved that not only negates the sidespin imparted to the ball due by the closing rotation $\omega_y$ and drooping rotation $\omega_z$ of the club head 100, but also balances the negative influences of Ixy and Ixz on certain shots (i.e. the draw influence of a positive Ixy on a high mis-hit and the fade influence of a negative Ixz on a low mis-hit).

It should be noted that the need for a positive, non-zero Ixy and a negative, non-zero Ixz for negating sidespin on high and low mis-hits is specific to iron-type club heads. For example, driver-type, fairway wood-type, and hybrid-type golf club heads all comprise undesirable sidespin on high and low mis-hits due to the closing rotation $\omega_y$ and the drooping rotation $\omega_z$ of the club head at impact, just like iron-type club heads do. However, to counteract such undesirable sidespin, driver-type, fairway wood-type, and hybrid-type club heads simply require a positive non-zero Ixy value. In other words, there is no need to achieve a non-zero Ixz value to balance the Ixy value.

Figure 26A:
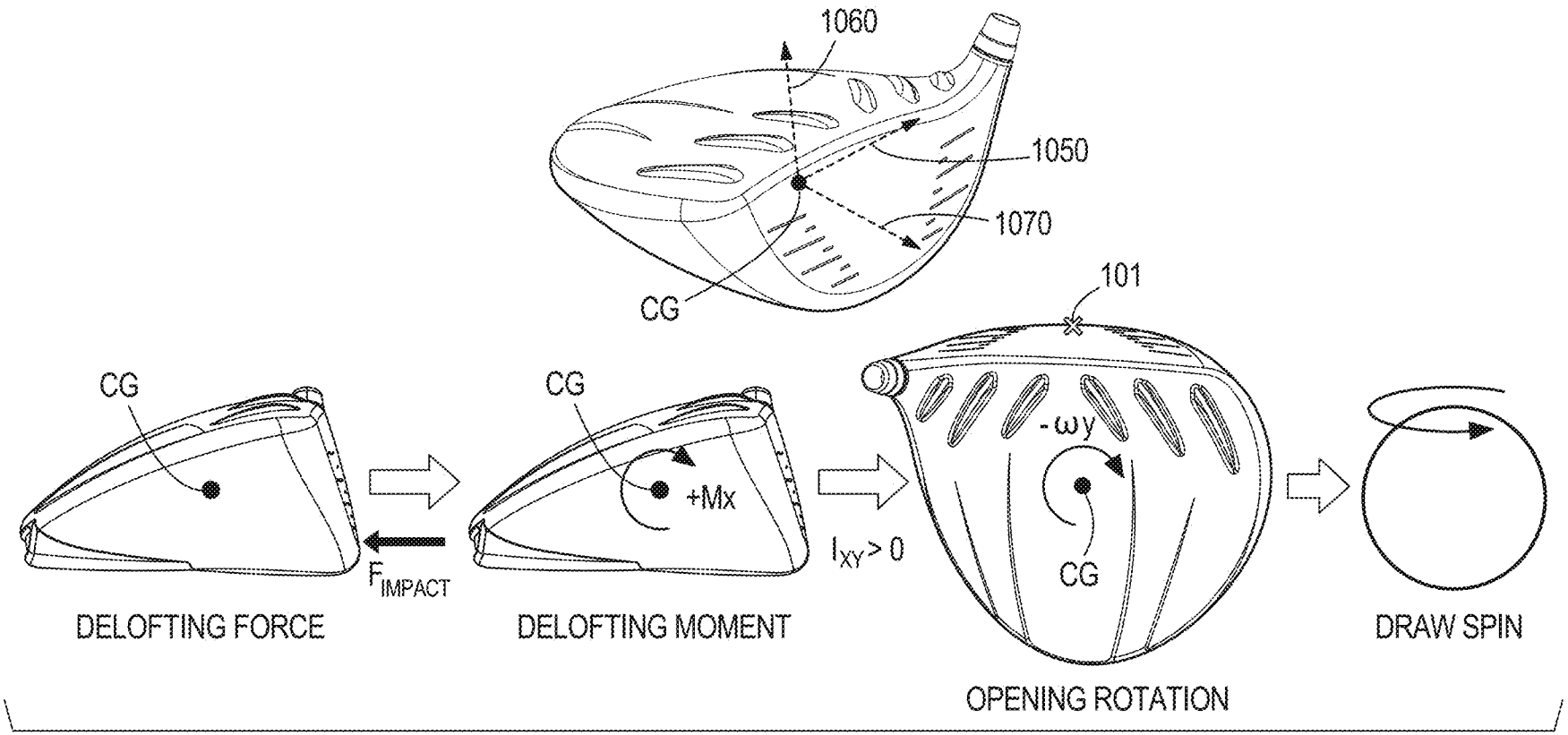
FIG. 26A illustrates an effect of a product of inertia Ixy that is greater than zero when a golf ball strikes below-center on a driver-type club head, for comparison.
Figure 26B:
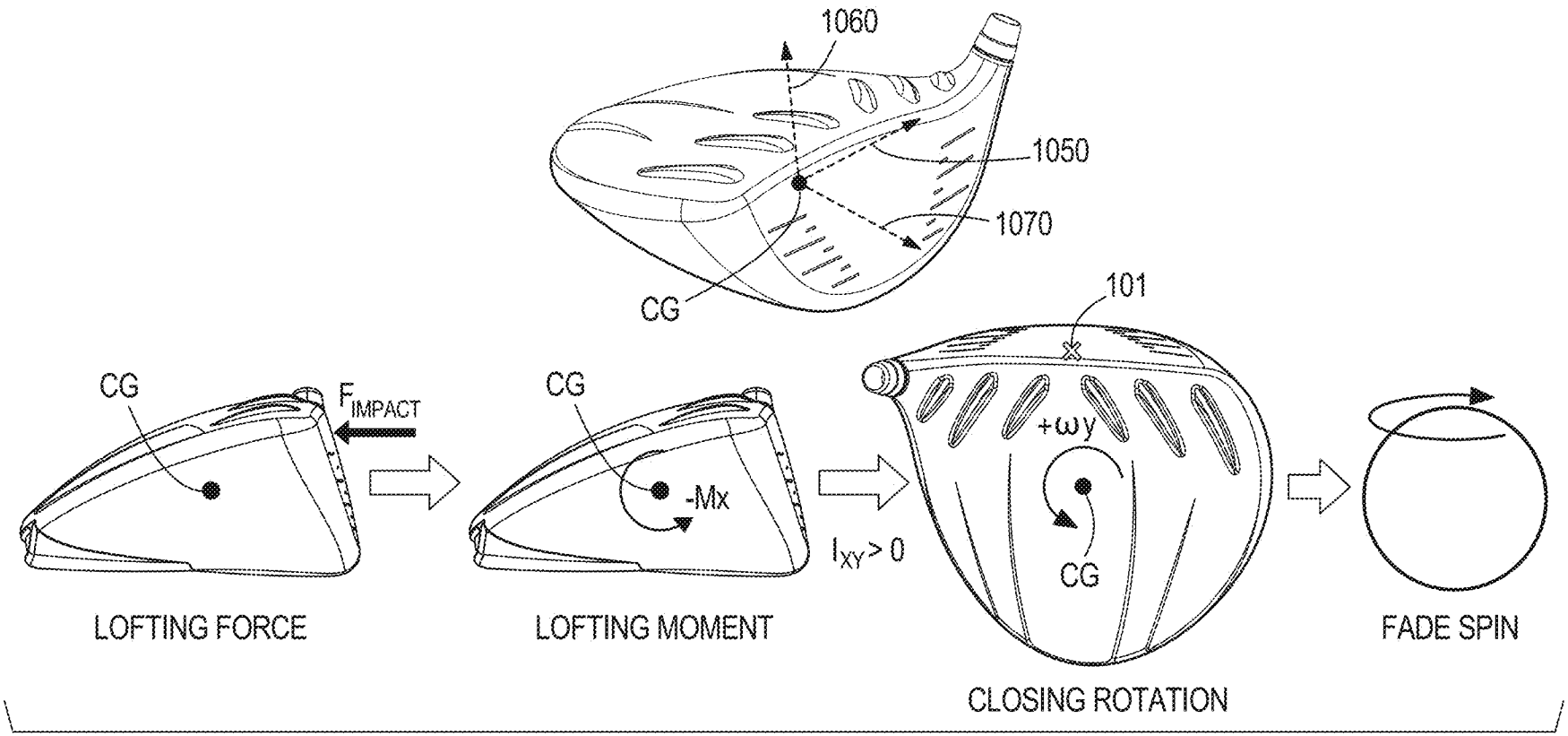
FIG. 26B illustrates an effect of a product of inertia Ixy that is greater than zero when a golf ball strikes above-center on a driver-type club head, for comparison.

Referring to FIGS. 26A and 26B, a driver-type club head is illustrated as an example of a wood-type club head with no need for a non-zero Ixz. Since the CG of a driver-type club head is located a good amount rearward of the face and because the face is not highly lofted, the impact location of both high mis-hits and low mis-hits occurs forward of the CG in the Z direction. As shown in FIG. 26A, this means that for a low mis-hit, which causes an opening acceleration $-\alpha_y$ due to a positive Ixy value, the entire face moves toward the toe end, influencing the ball to draw. Because low mis-hits tend to generate fade spin, the drawing influence caused by the positive Ixy value is sufficient in negating sidespin on a low mis-hit. Similarly, as shown in FIG. 26B, for a high mis-hit, which causes a closing acceleration $\alpha_y$ due to a positive Ixy value, the entire face moves toward the heel end, influencing the ball to fade. Because high mis-hits tend to generate draw spin, the fading influence caused by the positive Ixy value is sufficient in negating sidespin on a high mis-hit.

Therefore, due to the fact that a driver-type club head comprising a positive Ixy can influence a low mis-hit to draw and a high mis-hit to fade, the sidespin on a high or low mis-hit can be negated by only having a positive Ixy. Thus, for driver-type club heads, it is not necessary to provide a negative Ixz. In fact, in driver-type club heads, it is desirable to minimize Ixz (i.e. provide Ixz as close to zero as possible) in order to minimize any other angular accelerations. In contrast, as discussed above, the iron-type golf club head comprises both a positive Ixy and a negative Ixz that work in combination to negate sidespin caused by high and low mis-hits.

Figure 27:
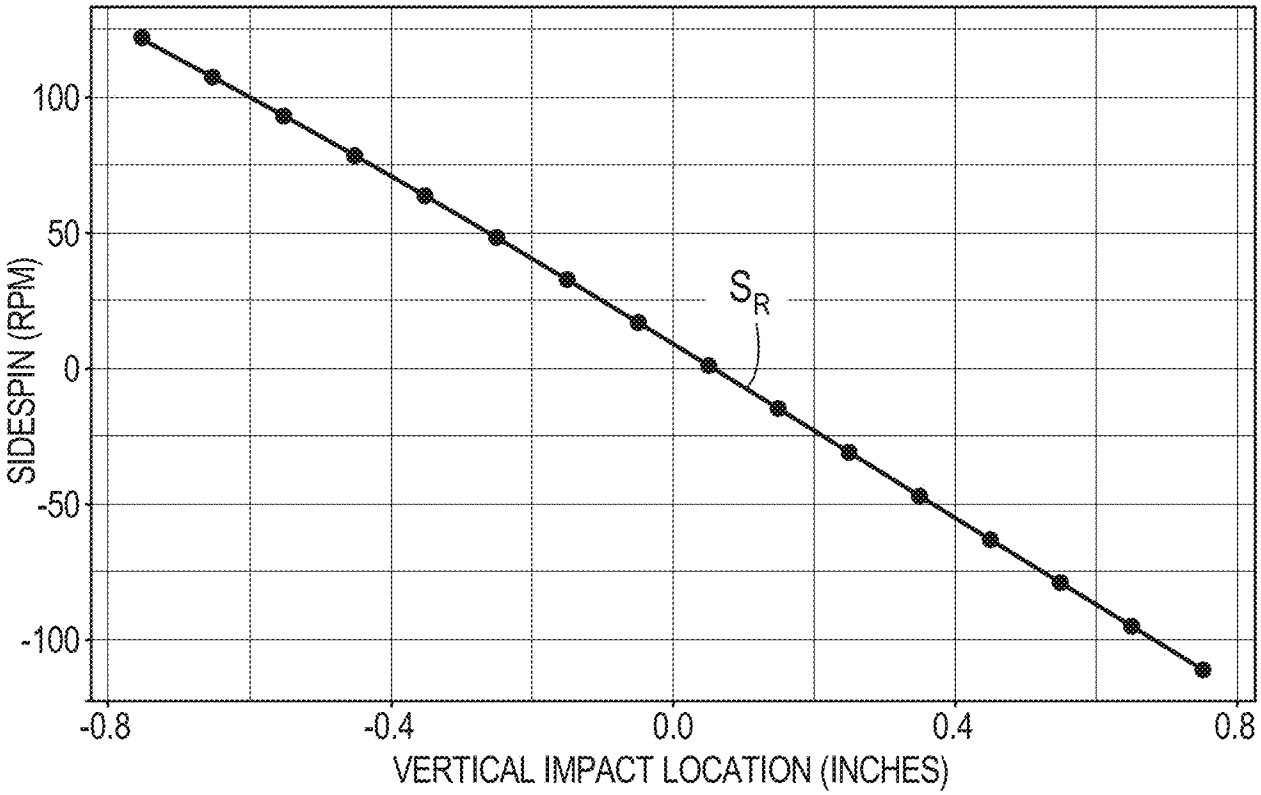
FIG. 27 is a graphical representation of the relationship between vertical impact location and sidespin caused by the natural rotation a club head throughout a golf swing.

FIGS. 27-30 illustrate the ability of a non-zero, positive Ixy (created by a high effective density in the high-toe and low-heel regions 174, 177) and a non-zero, negative Ixz (created by a high effective density in the front-toe and rear-heel regions 189, 190) to, in combination, counteract the sidespin generated by the closing rotation $\omega_y$ and drooping rotation $\omega_z$ in an iron-type golf club head 100. FIG. 27 illustrates the sidespin generated on high and low mis-hits due only to the closing rotation $\omega_y$ and drooping rotation $\omega_z$ at impact, wherein positive values correlate to fade spin and negative values correlate to draw spin. As can be seen, the sidespin varies approximately linearly with respect to the impact location on the Y-axis 1060. In other words, the sidespin ($S_R$) generated by the closing rotation $\omega_y$ and drooping rotation $\omega_z$ at every impact height (h) can be described by equation (5) presented below:

$$S_R = b_R h \tag{5}$$

wherein $b_R$ is the slope of the linear response.

Figure 28:
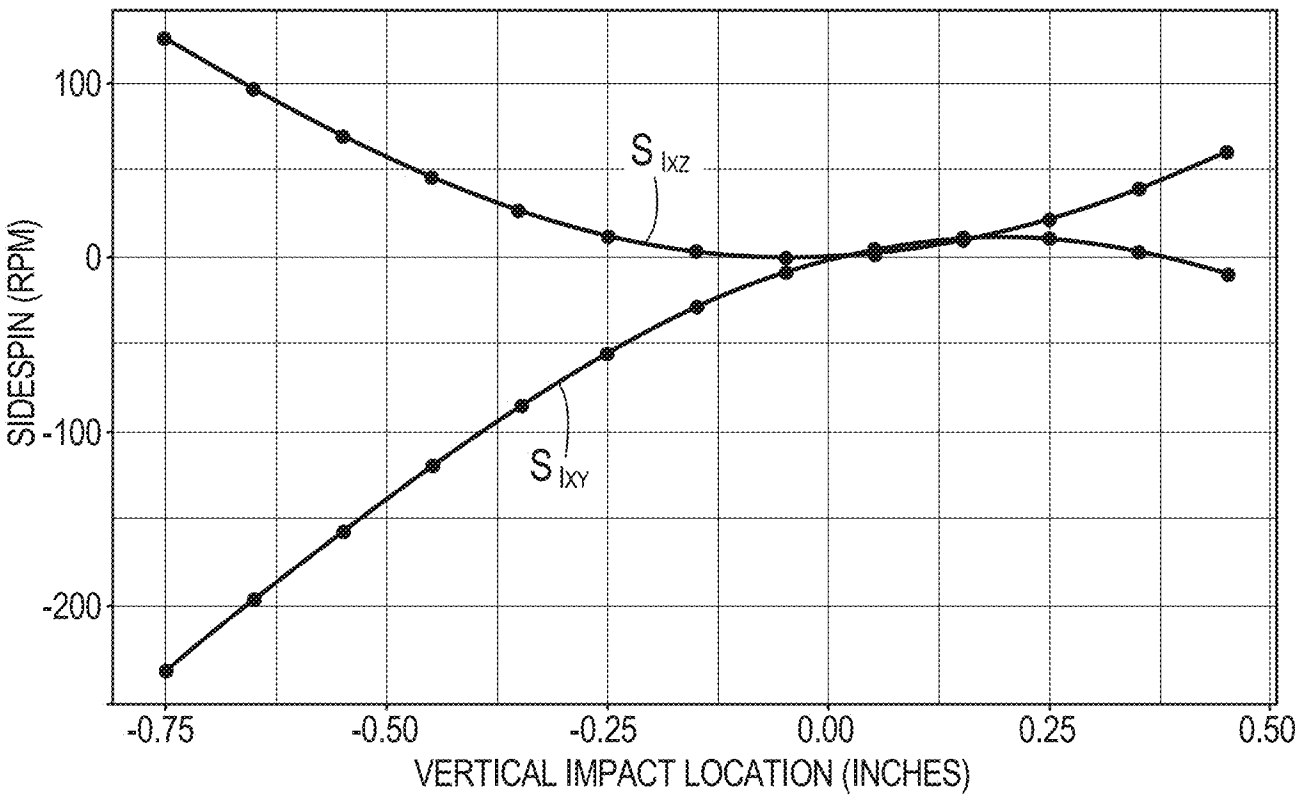
FIG. 28 is a graphical representation of the relationship between vertical impact location and sidespin caused by a product of inertia Ixy greater than zero and a product of inertia Ixz less than zero individually.

FIG. 28 illustrates the influence a positive, non-zero Ixy and a negative, non-zero Ixz have on sidespin at different impact locations along the y-axis 1060, independent of any spin generated by the closing rotation $\omega_y$ and drooping rotation $\omega_z$. Due to the relative locations of the CG and the strike face 104, as described above, the sidespin influence of Ixy and Ixz are each parabolic in nature. The sidespin ($S_{Ixy}$) generated by Ixy alone at every impact height (h) is represented by curve $S_{Ixy}$ in FIG. 28 and can be described by equation (6) presented below:

$$S_{Ixy} = a_{xy} h^2 + b_{xy} h \tag{6}$$

wherein $a_{xy}$ and $b_{xy}$ are coefficients of the parabolic response determined by the magnitude of Ixy. Increasing the magnitude of Ixy creates a steeper parabola, while decreasing the magnitude of Ixy creates a shallower parabola.

Figure 29:
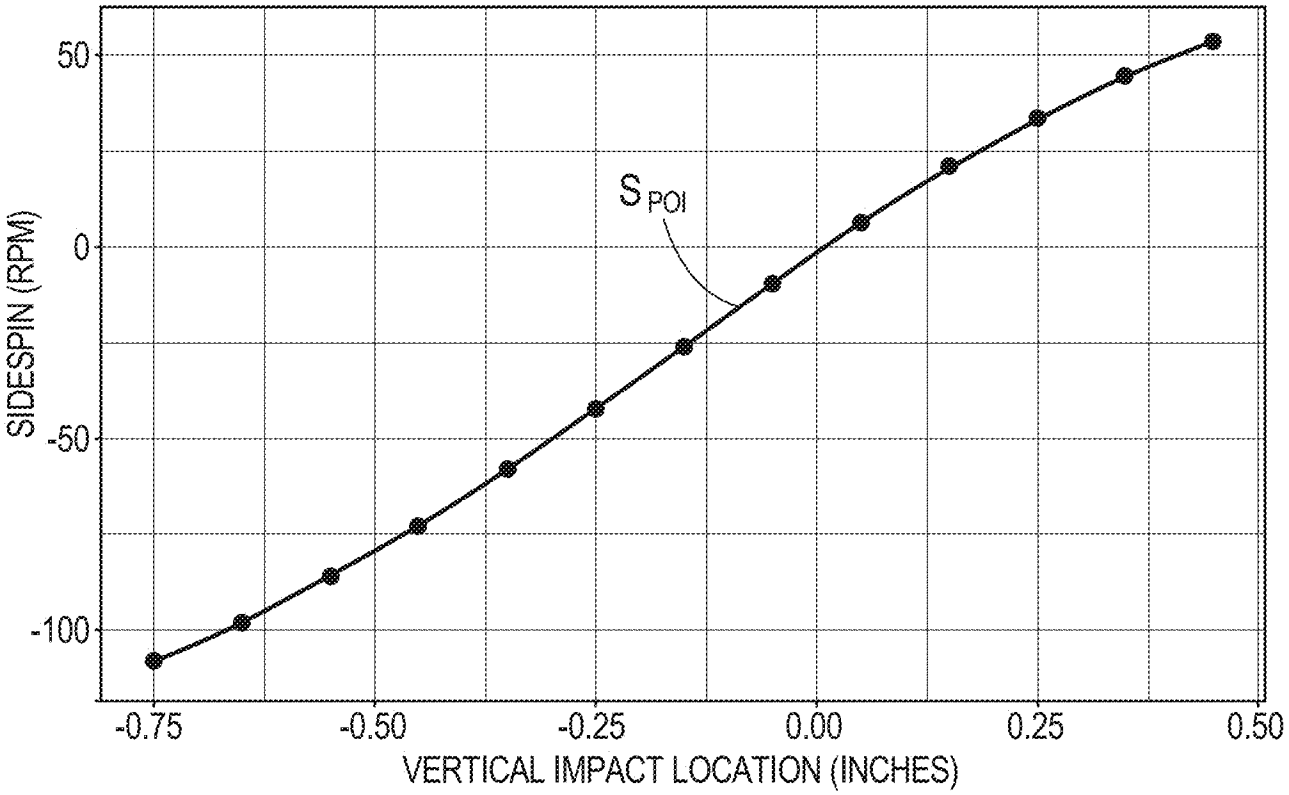
FIG. 29 is a graphical representation of the relationship between vertical impact location and sidespin caused by the combination of the products of inertia Ixy and Ixz of FIG. 28.

Similarly, the sidespin ($S_{Ixz}$) generated by Ixz alone at every impact height (h) is represented by curve $S_{Ixz}$ in FIG. 28 and can be described by equation (6) presented below:

$$S_{Ixz} = a_{xz} h^2 + b_{xz} h \tag{7}$$

wherein $a_{xz}$ and $b_{xz}$ are coefficients of the parabolic response determined by the magnitude of Ixz. Similar to Ixy, increasing the magnitude of Ixz creates a steeper parabola, while decreasing the magnitude of Ixz creates a shallower parabola. By the principle of superposition, equations (6) and (7) can be added together, as illustrated in FIG. 29. Through the optimization of Ixy and Ixz, the sum of the parabolic responses $S_{Ixy}$, $S_{Ixz}$ can result in a combined POI sidespin response $S_{POI}$ that is approximately linear and counteracts the sidespin generated by the closing rotation ωy and drooping rotation ωz. The combined POI sidespin response can be the mirror image of the sidespin response $S_R$ of the closing rotation ωy and drooping rotation ωz in order to perfectly counteract the unwanted natural sidespin. As can be seen from the plot, the combined POI sidespin response $S_{POI}$ influences the ball to draw on low mis-hits and to fade on high mis-hits. The combined POI sidespin response $S_{POI}$ can be added to the sidespin response $S_R$ of the closing rotation ωy and drooping rotation ωz to result in zero spin at every impact height (h).

In order for the Ixy and Ixz sidespin responses $S_{Ixy}$, $S_{Ixz}$ to counteract the sidespin of the closing rotation $\omega_y$ and drooping rotation $\omega_z$ and create zero sidespin on high and low mis-hits (given desirable delivery characteristics), the sum of equations (5), (6), and (7) must equal zero for all impact heights (h). Equation (8) characterizes the solution to the sum of equations that produce zero sidespin on high and low mis-hits:

$$b_R=2a_{xy}(m_{xy}-m_{xz}) \tag{8}$$

Referring back to FIG. 3, $m_{xy}$ is a location on the strike face 104 exactly midway between an intersection 169 of the Y-axis 1060 and center C (hereafter "midpoint $m_{xy}$") and $m_{xz}$ is a location on the strike face 104 midway between an intersection 171 of the Z-axis 1070 and center C (hereafter "midpoint $m_{xz}$").

Figure 30:
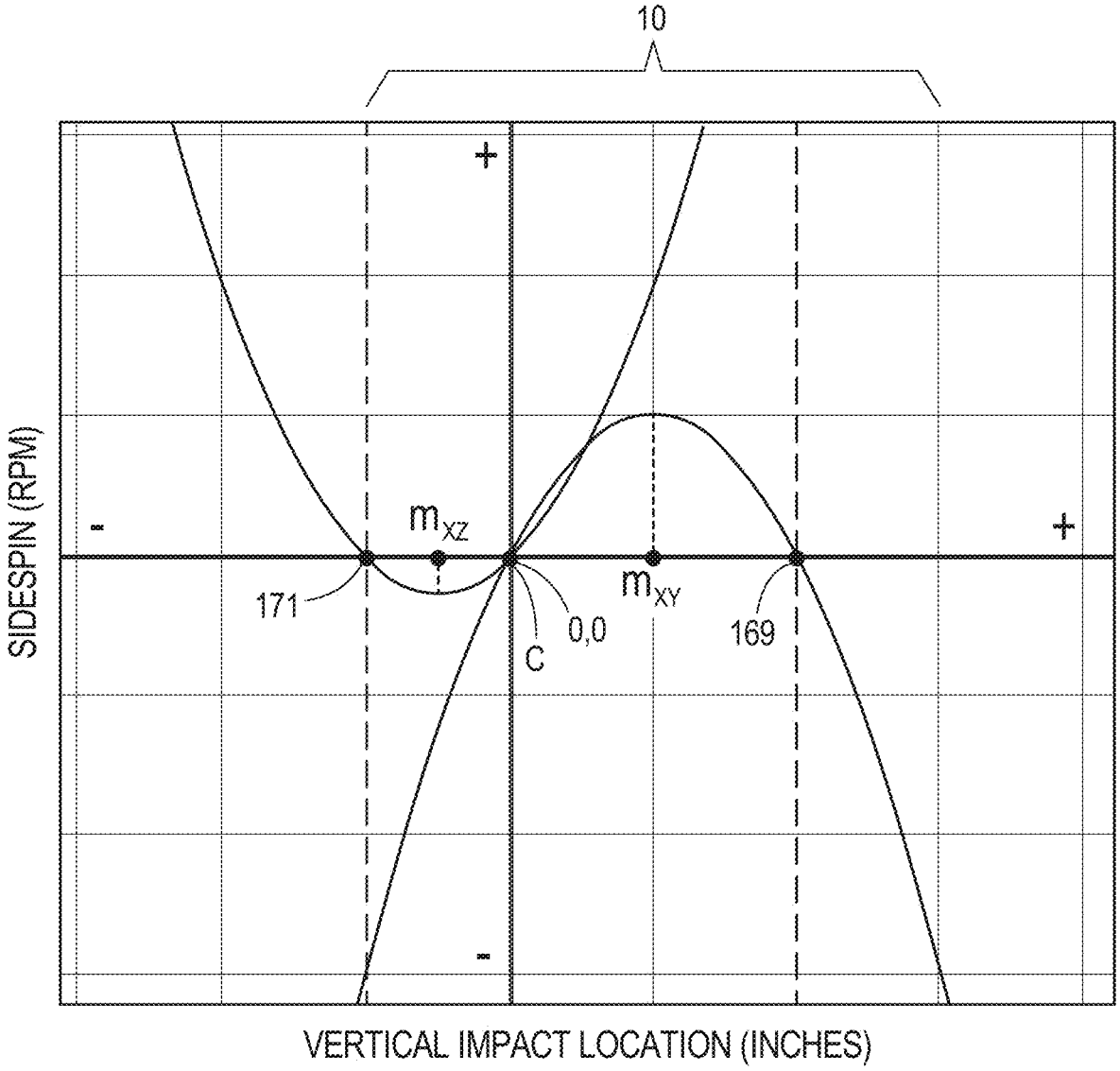
FIG. 30 is an exaggerated graphical representation of the relationship between vertical impact location and sidespin caused by another product of inertia Ixy greater than zero and another product of inertia Ixz less than zero individually.

FIG. 30 is an exaggerated illustration (i.e. intentionally not drawn to scale for the purpose of illustration) that shows the Ixy and Ixz sidespin response parabolas $S_{Ixy}$, $S_{Ixz}$ in relation to various vertical locations of the strike face 104 for a non-zero, positive Ixy and a negative, non-zero Ixz. As shown in the plot, the maximum of the Ixy response parabola $S_{Ixy}$ occurs at midpoint $m_{xy}$. Similarly, the minimum of the Ixz response parabola $S_{Ixz}$ occurs at midpoint $m_{xz}$. It should be noted that for impacts within the center region 10, the influence for Ixy and Ixz changes. As shown in FIG. 30, Ixy actually influences the ball to fade at locations on the strike face 104 between the Y-axis intersection 169 and center C, while Ixz influences the ball to draw at locations on the strike face 104 between the Z-axis intersection 171 and center C.

Figure 31:
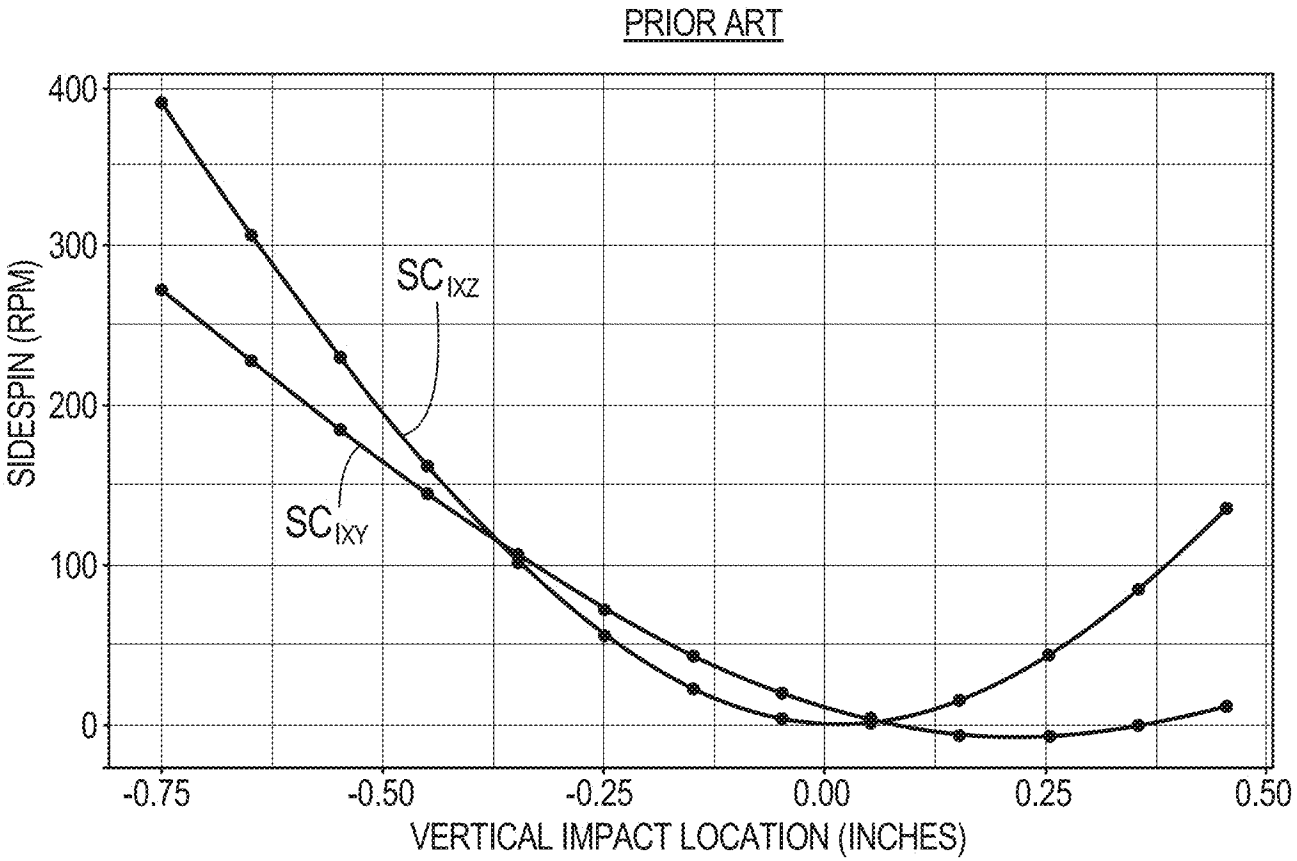
FIG. 31 is a graphical representation of the relationship between vertical impact location and sidespin by a product of inertia Ixy less than zero and a product of inertia Ixz less than zero individually in a typical prior art club head.
Figure 32:
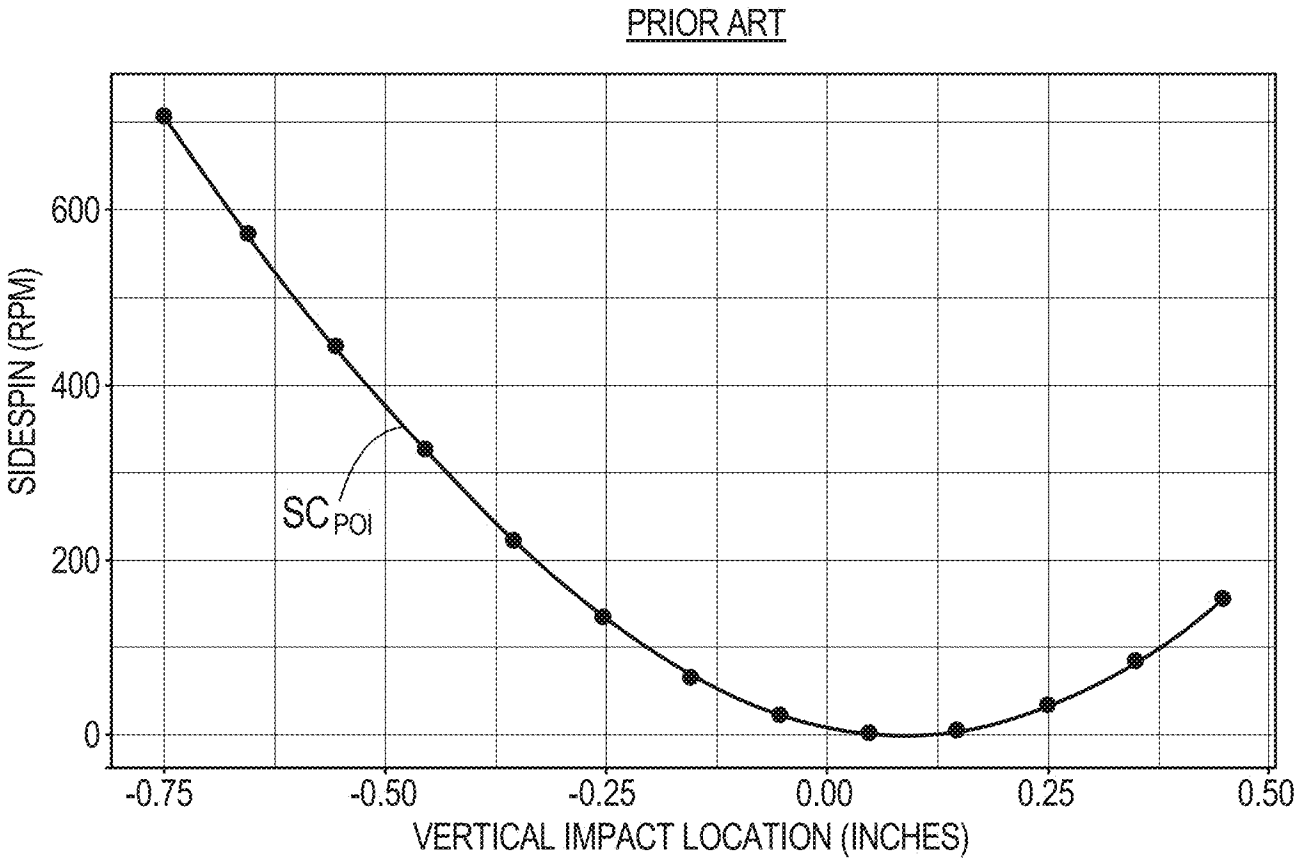
FIG. 32 is a graphical representation of the relationship between vertical impact location and sidespin caused by the combination of the products of inertia Ixy and Ixz of FIG. 31.
Figure 33:
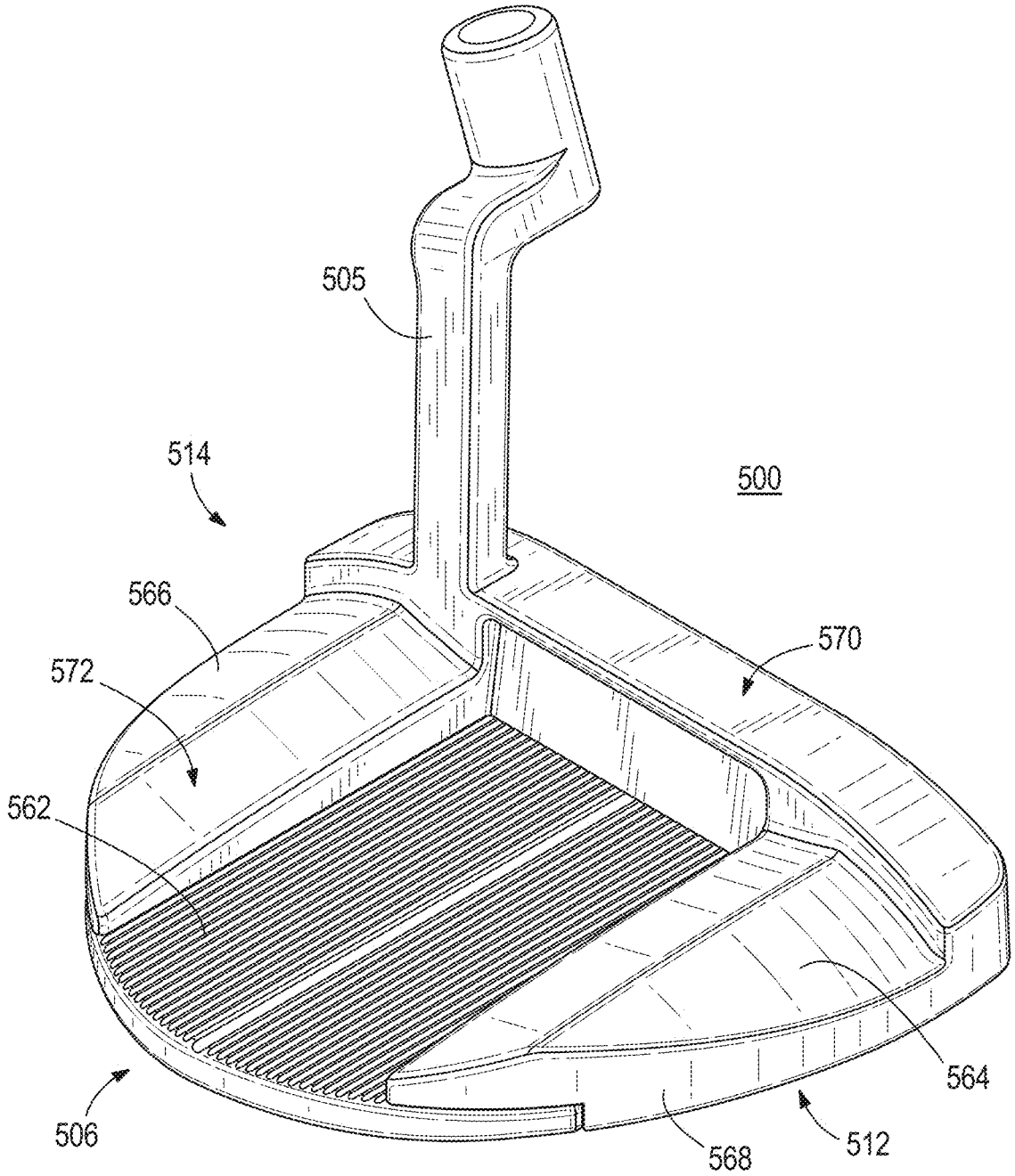
FIG. 33 illustrates a top perspective view of a putter-type golf club head comprising a lattice structure, according to one embodiment.
Figure 34:
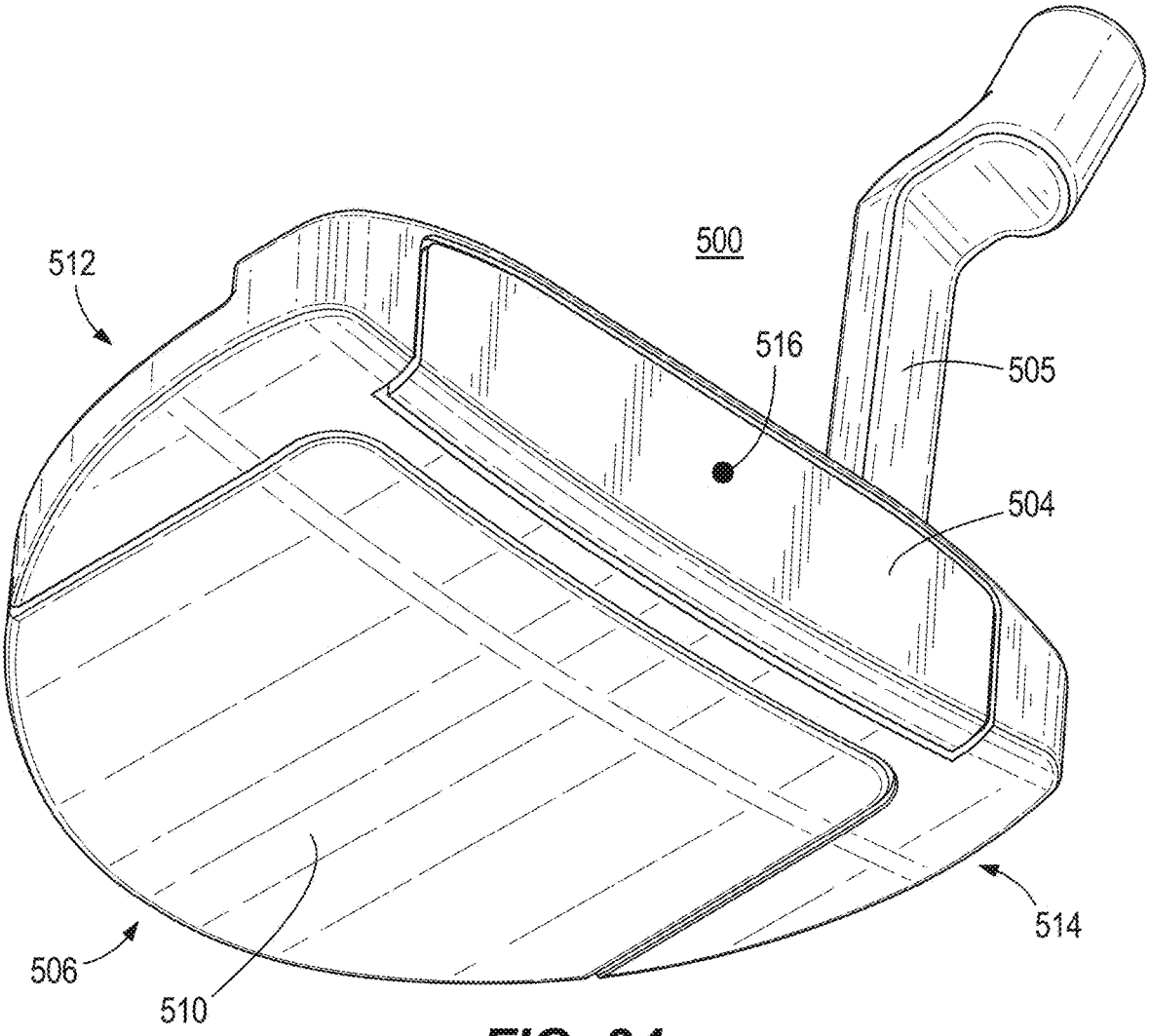
FIG. 34 illustrates a bottom perspective view of the putter-type golf club head of FIG. 33.

FIG. 31 illustrates the Ixy and Ixz sidespin responses $SC_{Ixy}$, $SC_{Ixz}$ for the typical prior art club head. It is typically very difficult to achieve a positive value of Ixy, due to the drastic asymmetry required to produce such a positive Ixy value. As such, prior art iron-type club heads generally comprise Ixy values and Ixz values that are both significantly negative. The addition of the prior art Ixy and Ixz sidespin responses $SC_{Ixy}$, $SC_{Ixz}$ results in a combined parabolic spin response $SC_{POI}$ that is convex, as shown in FIG. 32. Comparing FIGS. 27 and 32, the combined parabolic spin response $SC_{POI}$ of the prior art club head is not capable of negating the linear sidespin response $S_R$ of the closing rotation $\omega_y$ and drooping rotation $\omega_z$. As shown, the significantly negative Ixy and Ixz combine to create a fade response on all locations of the face, including high amounts of fade influence on low impact locations. The primary goal in optimizing POI to reduce sidespin is to create a club head with a significantly positive Ixy value. Thus, many embodiments of the iron-type club head 100 comprising lattice structures 130 can be focused on increasing Ixy by providing increased mass in the high-toe region 180 and low-heel region 183. Even if a positive Ixy value cannot be reasonably achieved given other various design constraints of the golf club head 100, an increase in Ixy (i.e. making Ixy less negative relative to the prior art) can reduce the amount of sidespin on high and low mis-hits. Increasing Ixy shallows the Ixy sidespin response $S_{Ixz}$, and thus the combined sidespin response $S_{POI}$ can more closely resemble a mirror image of the sidespin response $S_R$ of the closing rotation $\omega_y$ and drooping rotation $\omega_z$.

The iron-type golf club head 100 can comprise a "target" value for both Ixy and Ixz. The target values for Ixy and Ixz are the values that, in combination, represent the optimal POI for the club head 100 in terms of reducing sidespin on high and low mis-hits. A club head 100 comprising the target values for both Ixy and Ixz will comprise negligible sidespin on high and low mis-hits, given desirable delivery parameters and average swing characteristics (i.e. average swing speed, average closure rate, etc.). It is generally very difficult to achieve the optimal Ixy and Ixz products of inertia, while retaining other desirable mass properties (MOI, CG location, etc.). However, the closer the Ixy and Ixz products of inertia in a golf club are to the target value, the greater the reduction in sidespin.

The iron-type club head 100, 200, 300, 400 comprises a target Ixy value that is non-zero and positive. In many embodiments, the target Ixy can be between approximately 20 $g\cdot in^2$ and approximately 130 $g\cdot in^2$. In some embodiments, the target Ixy is between 20 $g\cdot in^2$ and 40 $g\cdot in^2$, between 30 $g\cdot in^2$ and 50 $g\cdot in^2$, between 40 $g\cdot in^2$ and 60 $g\cdot in^2$, between 50 $g\cdot in^2$ and 70 $g\cdot in^2$, between 60 $g\cdot in^2$ and 80 $g\cdot in^2$, between 80 $g\cdot in^2$ and 100 $g\cdot in^2$, between 100 $g\cdot in^2$ and 120 $g\cdot in^2$, between 110 $g\cdot in^2$ and 130 $g\cdot in^2$. In some embodiments, the target Ixy can be approximately 20 $g\cdot in^2$, approximately 25 $g\cdot in^2$, approximately 30 $g\cdot in^2$, approximately 35 $g\cdot in^2$, approximately 40 $g\cdot in^2$, approximately 45 $g\cdot in^2$, approximately 50 $g\cdot in^2$, approximately 55 $g\cdot in^2$, approximately 60 $g\cdot in^2$, approximately 65 $g\cdot in^2$, approximately 70 $g\cdot in^2$, approximately 75 $g\cdot in^2$, or approximately 80 $g\cdot in^2$. In some embodiments, the target Ixy can be greater than approximately 0 $g\cdot in^2$, greater than approximately 5 $g\cdot in^2$, greater than approximately 10 $g\cdot in^2$, greater than approximately 15 $g\cdot in^2$, greater than approximately 20 $g\cdot in^2$, greater than approximately 25 $g\cdot in^2$, greater than approximately 30 $g\cdot in^2$, greater than approximately 35 $g\cdot in^2$, greater than approximately 40 $g\cdot in^2$, greater than approximately 45 $g\cdot in^2$, greater than approximately 50 $g\cdot in^2$, greater than approximately 60 $g\cdot in^2$, greater than approximately 70 $g\cdot in^2$, greater than approximately 80 $g\cdot in^2$, greater than approximately 90 $g\cdot in^2$, greater than approximately 100 $g\cdot in^2$, greater than approximately 110 $g\cdot in^2$, or greater than approximately 120 $g\cdot in^2$.

The iron-type club head 100, 200, 300, 400 comprises a target Ixz value that is non-zero and negative. In many embodiments, the target Ixz can be between approximately −10 $g\cdot in^2$ and approximately −40 $g\cdot in^2$. In some embodiments, the target Ixz is between −10 $g\cdot in^2$ and −15 $g\cdot in^2$, between −15 $g\cdot in^2$ and −20 $g\cdot in^2$, between −20 $g\cdot in^2$ and −25 $g\cdot in^2$, between −25 $g\cdot in^2$ and −30 $g\cdot in^2$, between −30 $g\cdot in^2$ and −35 $g\cdot in^2$, or between −35 $g\cdot in^2$ and −40 $g\cdot in^2$. In some embodiments, the target Ixz can be approximately −10 $g\cdot in^2$, approximately −15 $g\cdot in^2$, approximately −20 $g\cdot in^2$, approximately −25 $g\cdot in^2$, approximately −30 $g\cdot in^2$, approximately −35 $g\cdot in^2$, or approximately −40 $g\cdot in^2$.

In many embodiments, the target Ixz product of inertia is less than approximately −5 $g\cdot in^2$, less than approximately −10 $g\cdot in^2$, less than approximately −15 $g\cdot in^2$, less than approximately −20 $g\cdot in^2$, less than approximately −25 $g\cdot in^2$, less than approximately −30 $g\cdot in^2$, less than approximately −35 $g\cdot in^2$, or less than approximately −40 $g\cdot in^2$.

In many functional embodiments of the iron-type club head 100, 200, 300, 400 comprising lattice structures 130, 230, 330, 430, the iron-type club head 100, 200, 300, 400 can comprise an Ixy product of inertia between −10 $g\cdot in^2$ and −40 $g\cdot in^2$. In some embodiments, the iron-type club head 100, 200, 300, 400 comprising lattice structures can comprise an Ixy product of inertia between −10 $g\cdot in^2$ and −20 $g\cdot in^2$, between −20 $g\cdot in^2$ and −30 $g\cdot in^2$, or between −30 $g\cdot in^2$ and −40 g·in$^2$. In some embodiments, the iron-type club head 100, 200, 300, 400 comprising lattice structures can comprise an Ixy product of inertia between −10 g·in$^2$ and −30 g·in$^2$, between −15 g·in$^2$ and −35 g·in$^2$, or between −20 g·in$^2$ and −40 g·in$^2$. In some embodiments, the club head 100, 200, 300, 400 comprises an Ixy product of inertia is greater than approximately −50 g·in$^2$, greater than approximately −45 g·in$^2$, greater than approximately −40 g·in$^2$, greater than approximately −35 g·in$^2$, greater than approximately −30 g·in$^2$, greater than approximately −25 g·in$^2$, greater than approximately −20 g·in$^2$, greater than approximately −15 g·in$^2$, greater than approximately −10 g·in$^2$, or greater than approximately −5 g·in$^2$.

In many functional embodiments of the iron-type club head 100, 200, 300, 400 comprising lattice structures 130, 230, 330, 430, the iron-type club head 100, 200, 300, 400 comprises an Ixz product of inertia between −45 g·in$^2$ and −65 g·in$^2$. In some embodiments, the iron-type club head 100, 200, 300, 400 comprising lattice structures 130, 230, 330, 430 comprises an Ixz product of inertia between −45 g·in$^2$ and −50 g·in$^2$, between −50 g·in$^2$ and −55 g·in$^2$, between −55 g·in$^2$ and −60 g·in$^2$, or between −60 g·in$^2$ and −65 g·in$^2$. In some embodiments, the iron-type club head 100, 200, 300, 400 comprising lattice structures 130, 230, 330, 430 comprises an Ixz product of inertia between −45 g·in$^2$ and −55 g·in$^2$, between −50 g·in$^2$ and −60 g·in$^2$, between −55 g·in$^2$ and −65 g·in$^2$, between −45 g·in$^2$ and −60 g·in$^2$, or between −50 g·in$^2$ and −65 g·in$^2$. In some embodiments, the golf club head 100, 200, 300, 400 can comprise a Ixz product of inertia that is less than approximately −45 g·in$^2$, less than approximately −50 g·in$^2$, less than approximately −45 g·in$^2$, less than approximately −50 g·in$^2$, less than approximately −55 g·in$^2$, less than approximately −60 g·in$^2$, or less than approximately −65 g·in$^2$.

In many embodiments, the iron-type club head 100, 200, 300, 400 comprising lattice structures 130, 230, 330, 430 has products of inertia much nearer to the optimal target values than similar club heads lacking such lattice structures 130, 230, 330, 430. In many embodiments, a club head similar to iron-type club head 100, but lacking lattice structures comprises an Ixy product of inertia between approximately −50 g·in$^2$ and −70 g·in$^2$. In many embodiments, the Ixy product of inertia of the iron-type club head 100, 200, 300, 400 comprising lattice structures 130, 230, 330, 430 is between 15% and 50% closer to the target Ixy product of inertia than a similar club head lacking such lattice structures 130. In some embodiments, the Ixy product of inertia of the iron-type club head 100, 200, 300, 400 comprising lattice structures 130, 230, 330, 430 can be closer to the target Ixy product of inertia, than a similar club head lacking such lattice structures, by between 15% and 25%, between 25% and 35%, between 35% and 45%, between 45% and 50%, between 15% and 35%, between 20% and 40%, between 25% and 45%, or between 30% and 50%.

In many embodiments, a club head similar to iron-type club head 100, but lacking lattice structures comprises an Ixz product of inertia between approximately −75 g·in$^2$ and −90 g·in$^2$. In many embodiments, the Ixz product of inertia of the iron-type club head 100, 200, 300, 400 comprising lattice structures 130, 230, 330, 430 is between 5% and 45% closer to the target Ixz product of inertia than a similar club head lacking such lattice structures 130. In some embodiments, the Ixz product of inertia of the iron-type club head 100, 200, 300, 400 comprising lattice structures 130, 230, 330, 430 can be closer to the target Ixz product of inertia, than a similar club head lacking such lattice structures, by between 5% and 15%, between 15% and 25%, between 25% and 35%, between 35% and 40%, between 40% and 45%, between 5% and 25%, between 10% and 30%, between 15% and 35%, between 20% and 40%, or between 25% and 45%.

The target values for Ixy and Ixz can vary for iron-type club heads 100 designed for different categories of players. Because the natural closure rate and drooping rate can change from player to player, the amount of sidespin generated by the closing rotation $\omega_y$ and drooping rotation $\omega_z$ on high and low mis-hits can vary for different types of players. For example, clubs designed for players with slow swing speeds (who typically have lower closure rates) can comprise target values for Ixy and Ixz that differ from the target values of club heads 100 designed for players with higher swing speeds. The target value for Ixy moves closer to zero as the swing speed increases, because the effect of Ixy is more pronounced at higher impact speeds. In other words, a positive target Ixy value decreases as swing speed increases. Conversely, the target value for Ixz moves closer to zero as swing speed increases, because the effect of Ixz is more pronounced at higher impact speeds. In other words, a negative target Ixz value increases as swing speed increases. The difference in target values for Ixy and Ixz makes up for the difference in spin imparted for such players on high and low mis-hits due to the closing rotation $\omega_y$ and drooping rotation $\omega_z$ of the club head.

In many embodiments, iron-type golf club heads 100, 200, 300, 400 designed for players with slow swing speeds (i.e. swing speeds between 60 and 75 mph when swinging an iron-type club head) can comprise a slow-swing-speed Ixy target between approximately 75 g·in$^2$ and 130 g·in$^2$. In some embodiments, iron-type golf club heads 100, 200, 300, 400 designed for players with slow swing speeds can comprise an Ixy target between approximately 75 g·in$^2$ and 85 g·in$^2$, 85 g·in$^2$ and 95 g·in$^2$, 95 g·in$^2$ and 115 g·in$^2$, or 115 g·in$^2$ and 130 g·in$^2$. Iron-type club heads with different loft angles $\alpha$ can target slightly different ranges of Ixy values, for a given swing-speed player. For example, 7-iron golf club heads 100, 200, 300, 400 designed for players with slow-swing speeds can comprise an Ixy target between approximately 90 g·in$^2$ and 127 g·in$^2$, whereas 4-iron golf club heads 100, 200, 300, 400 designed for players with slow-swing speeds can comprise an Ixy target between approximately 77 g·in$^2$ and 108 g·in$^2$.

In many embodiments, iron-type golf club heads 100, 200, 300, 400 designed for players with slow swing speeds (i.e. swing speeds between 60 and 75 mph when swinging an iron-type club head) can comprise a slow-swing-speed Ixz target between approximately −70 g·in$^2$ and −30 g·in$^2$. In some embodiments, iron-type golf club heads 100, 200, 300, 400 designed for players with slow swing speeds can comprise an Ixz target between approximately −70 g·in$^2$ and −60 g·in$^2$, −60 g·in$^2$ and −50 g·in$^2$, −50 g·in$^2$ and −40 g·in$^2$, −40 g·in$^2$ and −30 g·in$^2$. Iron-type club heads 100 with different loft angles $\alpha$ can target slightly different ranges of Ixz values, for a given swing-speed player. For example, 7-iron golf club heads 100, 200, 300, 400 designed for players with slow-swing speeds can comprise an Ixz target between approximately −69 g·in$^2$ and −49 g·in$^2$, whereas 4-iron golf club heads 100, 200, 300, 400 designed for players with slow-swing speeds can comprise an Ixz target between approximately −48 g·in$^2$ and −34 g·in$^2$.

In many embodiments, iron-type golf club heads 100, 200, 300, 400 designed for players with average swing speeds (i.e. swing speeds between 75 and 85 mph when swinging an iron-type club head) can comprise an average-swing-speed Ixy target between approximately 50 g·in$^2$ and 95 g·in$^2$. In some embodiments, iron-type golf club heads

100, 200, 300, 400 designed for players with average swing speeds can comprise an Ixy target between approximately 50 g·in$^2$ and 65 g·in$^2$, 65 g·in$^2$ and 75 g·in$^2$, 75 g·in$^2$ and 85 g·in$^2$, 85 g·in$^2$ and 95 g·in$^2$. Iron-type club heads 100, 200, 300, 400 with different loft angles α can target slightly different ranges of Ixy values, for a given swing-speed player. For example, 7-iron golf club heads 100, 200, 300, 400 designed for players with average-swing speeds can comprise an Ixy target between approximately 63 g·in$^2$ and 90 g·in$^2$, whereas 4-iron golf club heads 100, 200, 300, 400 designed for players with average-swing speeds can comprise an Ixy target between approximately 55 g·in$^2$ and 75 g·in$^2$.

In many embodiments, iron-type golf club heads 100, 200, 300, 400 designed for players with average swing speeds (i.e. swing speeds between 75 and 85 mph when swinging an iron-type club head) can comprise an average-swing-speed Ixz target between approximately −55 g·in$^2$ and −20 g·in$^2$. In some embodiments, iron-type golf club heads 100, 200, 300, 400 designed for players with average swing speeds can comprise an Ixz target between approximately −55 g·in$^2$ and −45 g·in$^2$, −45 g·in$^2$ and −35 g·in$^2$, −35 g·in$^2$ and −25 g·in$^2$, or −25 g·in$^2$ and −20 g·in$^2$. Iron-type club heads 100, 200, 300, 400 with different loft angles α can target slightly different ranges of Ixz values, for a given swing-speed player. For example, 7-iron golf club heads 100, 200, 300, 400 designed for players with average-swing speeds can comprise an Ixz target between approximately −49 g·in$^2$ and −36 g·in$^2$, whereas 4-iron golf club heads 100, 200, 300, 400 designed for players with average-swing speeds can comprise an Ixz target between approximately −34 g·in$^2$ and −25 g·in$^2$.

In many embodiments, iron-type golf club heads 100, 200, 300, 400 designed for players with high swing speeds (i.e. swing speeds between 85 and 105 mph when swinging an iron-type club head) can comprise a high-swing-speed Ixy target between approximately 1 g·in$^2$ and 70 g·in$^2$. In some embodiments, iron-type golf club heads 100, 200, 300, 400 designed for players with high swing speeds can comprise an Ixy target between approximately 1 g·in$^2$ and 20 g·in$^2$, 20 g·in$^2$ and 40 g·in$^2$, 40 g·in$^2$ and 60 g·in$^2$, or 50 g·in$^2$ and 70 g·in$^2$. Iron-type club heads 100, 200, 300, 400 with different loft angles α can target slightly different ranges of Ixy values, for a given swing-speed player. For example, 7-iron golf club heads 100, 200, 300, 400 designed for players with high-swing speeds can comprise an Ixy target between approximately 12 g·in$^2$ and 64 g·in$^2$, whereas 4-iron golf club heads 100, 200, 300, 400 designed for players with high-swing speeds can comprise an Ixy target between approximately 4 g·in$^2$ and 55 g·in$^2$.

In many embodiments, iron-type golf club heads 100, 200, 300, 400 designed for players with high swing speeds (i.e. swing speeds between 85 and 105 mph when swinging an iron-type club head) can comprise a high-swing-speed Ixz target between approximately −40 g·in$^2$ and −1 g·in$^2$. In some embodiments, iron-type golf club heads 100, 200, 300, 400 designed for players with high swing speeds can comprise an Ixz target between approximately −40 g·in$^2$ and −30 g·in$^2$, −30 g·in$^2$ and −20 g·in$^2$, −20 g·in$^2$ and −10 g·in$^2$, −10 g·in$^2$ and −1 g·in$^2$. Iron-type club heads 100, 200, 300, 400 with different loft angles α can target slightly different ranges of Ixz values, for a given swing-speed player. For example, 7-iron golf club heads 100, 200, 300, 400 designed for players with high-swing speeds can comprise an Ixz target between approximately −36 g·in$^2$ and −8 g·in$^2$, whereas 4-iron golf club heads 100, 200, 300, 400 designed for players with high-swing speeds can comprise an Ixz target between approximately −25 g·in$^2$ and −2 g·in$^2$.

In addition to the swing speed affecting the target Ixy and Ixz values, the closure rate and drooping rate of the club head also alters the target Ixy and Ixz values. Players with a common swing speed can impart different closure rates to a club head. When a player swings with a higher closing rotation $\omega_y$, higher magnitude Ixy and Ixz values are needed to offset the natural spin imparted by the closing rotation $\omega_y$. As described above, the closing rotation $\omega_y$ naturally imparts a fade spin to the golf ball below face center and a draw spin above center. Additionally, players tend to impact the golf ball with a slight toe-down rotation (i.e. a positive drooping rotation $\omega_z$). Drooping rotation $\omega_z$ induces the same natural spin directions as the closing rotation $\omega_y$. Depending on a player's unique swing parameters, the golf club head can experience higher or lower drooping rotation $\omega_z$. Higher magnitude target Ixy and Ixz values can assist in offsetting higher drooping rotations $\omega_z$.

In addition to mass property benefits, the lattice structure 130 can also increase the durability of the golf club head 100. Because iron-type golf club heads 100 endure high impact stresses, the durability provided by the lattice structure 130 is especially valuable in the iron-type club head 100. In some embodiments, the lattice structure 130 can brace and connect the rear 106 of the strike face 104 of the iron 100 to a rear wall. The strike face 104 can be thinned because the lattice 130 provides additional support against material failure at impact. In other embodiments, the lattice structure 130 can be disconnected from the rear of the strike face 104, to promote unhindered bending of the strike face 104.

Putter

The lattice structures described above, can also be implemented in putter-type golf club heads. Within putters, the position and effective density profile of the lattice structure can be used to improve moment of inertia (MOI) values and to position the center of gravity (CG) in a desirable location. The CG can be positioned forward from a baseline CG location (CG'), which is where the CG would be located without the lattice structure influencing mass distribution (i.e. for a solid body putter). Using a lattice structure within a mallet or mid-mallet type putter can maintain structural durability, while improving MOI and CG position. As described above for the lattice structure, the desired effective density can be achieved by altering the beam thickness of each unit scaffolding within its respective lattice unit.

General characteristics of the putter-type golf club head are described below, followed by description of specific putter embodiments. Referring to FIGS. 33-39, in some embodiments, the golf club head can be a putter 500, such as a mallet or mid-mallet. The putter 500 comprises a face 504, a sole 510, and an outer shell 560 (or crown). The outer shell 560 comprises a central crown portion 562, a toe crown portion 564 towards the toe end 512 of the club head 500, a heel crown portion 566 towards a heel end 514 of the club head 500, and a skirt portion 568 at a peripheral edge of the club head 500. The skirt 568 can extend around an extremity of the club head 500 from the toe end 512 through a rear 506 of the club head and to the heel end 514. The face 504, sole 510, and outer shell 560 (or crown) can form a perimeter of the golf club head 500. The perimeter can be solid.

In some embodiments, the outer shell 560 can have a uniform thickness. In other embodiments, the crown (central, toe, and heel portions 562, 564, 566) can be thinner than the skirt portion 568. The putter head 500 can also comprise a hosel 505 or a hosel bore configured to attach to a golf club shaft.

The central crown portion 562 can be lower than the toe crown portion 564 and the heel crown portion 566. The skirt portion 568 connects the crown portions 562, 564, 566 to the sole 510. Together, the outer shell 560 and the sole 510 can form an interior cavity 520. The putter head 500 can comprise an exterior surface 522 and an interior surface 524, the interior surface 524 forming a boundary of (or enveloping) the interior cavity 520. The interior cavity 520 can house a lattice structure 530. The lattice structure 530 can fully or partially fill the interior cavity 520. The lattice structure 530 can connect to the interior surface 524 of the interior cavity 520. The lattice structure 530 can affect mass distribution, thus altering MOI, POI, and CG location.

The face 504 can comprise a thickness measured rearward and orthogonal from the face 504 at the strike face centerpoint 516. A thick face can move the CG forward, while a thin face can shift the CG rearward. The putter head 500 can further comprise a front portion 570 and a rear portion 572. In thick face embodiments, the face forms the front portion 570 of the golf club head 500 and everything rearward of the face 504 forms the rear portion 572 of the golf club head 500. In thin face embodiments, a section of the club head 500 forward of a boundary wall 525 is the front portion 570 of the club head 500, and the remainder of the club head, rearward of the boundary wall, forms the rear portion 572 of the club head. The boundary wall 525 can be defined behind the hosel 505, offset a distance from the face 504.

The rear portion 572 of the club head 500 can comprise a total rear portion volume, measured as the solid volume contained by the exterior surface 522 of the rear portion 572. The interior cavity 520 can comprise a cavity volume, measured as the volume contained by the interior surface 524. The interior cavity volume can be a percentage of the rear portion volume, the percentage ranging between 20% and 80%. In some embodiments, the interior cavity volume is the between following percentages of the rear portion volume: 20% and 30%, 30% and 40%, 40% and 50%, 50% and 60%, 60% and 70%, or 70% and 80%. In some embodiments, the interior cavity volume is 66%, or 71% of the rear portion volume.

The outer shell 560 can comprise a thickness measured between the exterior and interior surfaces 524, 522, respectively, of the club head 500. The thickness of the outer shell 560 can be uniform or varying. The outer shell thickness can be between 0.010 inch and 0.050 inch. In some embodiments, the outer shell thickness can be between 0.010 inch and 0.020 inch, 0.020 inch and 0.030 inch, 0.030 inch and 0.040 inch, or 0.040 inch and 0.050 inch. A thinner outer shell results in a lighter weight outer shell, particularly the crown. The weight which is not placed in the crown can be distributed to the periphery of the club head 500 to increase the MOI of the club head 500. In some embodiments, a portion of the crown can be removed to expose the lattice structure, further removing mass from the crown (562, 564, and 566).

The sole 510 of the golf club head 500 can comprise a sole thickness can range between 0.030 inch and 0.080 inch. In some embodiments, the sole thickness can range between 0.030 inch and 0.040 inch, 0.040 inch and 0.050 inch, 0.050 inch and 0.060 inch, 0.060 inch and 0.070 inch, or 0.070 inch and 0.080 inch. In some latticed embodiments, the sole thickness can be equal to or less than approximately 0.040 inch, equal to or less than approximately 0.050 inch, or equal to or less than approximately 0.060 inch.

The lattice structure 530 can support the outer shell 560, allowing the outer shell 560 to be thinner than in an embodiment lacking the lattice structure 530. The lattice structure 530 can provide support to the sole 510, allowing the sole 510 to be thinner than in embodiments lacking the lattice structure 530. The thin outer shell and thin sole, both enabled by the supportive lattice structure 530, can free up discretionary mass. The discretionary mass can be moved to the periphery of the club head for MOI improvements, POI improvements, and/or can be incorporated into the lattice structure to control the CG location.

In some embodiments, the lattice structure 530 can be exposed and visible on the exterior surface 522 of the golf club head 500. The lattice structure 530 can be exposed on the crown 562, 564, and 566, on the sole 510, or on the skirt 568. For example, the lattice structure 530 can be exposed across a section of the toe crown portion 564 and/or the heel crown portion 566. Alternately, the lattice 530 can be exposed across the entire toe crown portion 564 and the entire heel crown portion 566. Exposing the lattice structure 530 can further free discretionary weight by removing portions of the exterior surfaces 522. Additionally, exposing the lattice structure 530 can improve the aesthetics of the club head 500 and allow the technology to be visible to the player. In some embodiments, the lattice structure 530 can appear differently across different regions of the exterior surface 522 due to the varying shape or density profile of the lattice structure 530.

In some putter embodiments, such as mallet and mid-mallet type putters, the Ixx value can be between 400 $g*in^2$ and 460 $g*in^2$, the Iyy value can be between 590 $g*in^2$ and 670 $g*in^2$; and the Izz value can be between 230 $g*in^2$ and 270 $g*in^2$. In some putter embodiments, the Ixx value can be between 450 $g*in^2$ and 460 $g*in^2$; the Izz value can be between 645 $g*in^2$ and 670 $g*in^2$; and the Izz can be between 240 $g*in^2$ and 265 $g*in^2$.

In some mallet and mid-mallet latticed putter embodiments, the CG can be positioned between −0.020 inch and −0.035 inch along the X'-axis, between −0.800 inch and −1.000 inch along the Y'-axis, and between 0.850 inch and 0.900 inch along the Z'-axis. Referring to FIG. 35, in some embodiments, the inclusion of the lattice structure 530 in the golf club head 500 can move the CG towards the front, towards the rear, towards the toe end, and/or towards the heel end. As illustrated in FIG. 35, inclusion of the lattice unit can shift the CG forward from a baseline CG position (CG') to a lattice-included CG position. The baseline CG position (CG') is the CG position of a comparison golf club head lacking a hollow interior cavity and a lattice structure. The comparison club head can have a similar size and style as the herein described club head 500. In some embodiments of the comparison club head, the CG can be positioned between −0.010 inch and −0.020 inch along the X'-axis, between −1.000 inch and −1.400 inch along the Y'-axis, and between 0.900 inch and 1.000 inch along the Z'-axis.

In some embodiments, including the interior cavity 520 and the lattice structure 530 into the golf club head 500 can shift the CG forward by a CG-shift distance of between 0 inches and 1.6 inches. The distance is measured in the Z'-axis direction between the baseline CG position (CG') and the lattice-included CG position. In some embodiments, the CG-shift distance can be between 0 inches and 0.2 inch, 0.2 inch and 0.4 inch, 0.4 inch and 0.6 inch, 0.6 inch and 0.8 inch, 0.8 inch and 1.0 inch, 1.0 inch and 1.2 inch, 1.2 inch and 1.4 inch, or 1.4 inch and 1.6 inch.

First Putter Embodiment

Referring to FIGS. 33-38, in a first putter embodiment, the lattice structure 530 extends from a central reference sphere 550 to a skirt 568 of the club head 500. The lattice structure 530 is completely internal and not visible from the exterior of the club head 500. The lattice structure 530 density increases towards the perimeter (or periphery) of the club head 500. The first putter embodiment club head can comprise a thick face 504. The thick face 504 forms the front portion 570 of the club head 500, and can contribute to the forward CG location of the putter head 500.

Referring to FIGS. 33-38, the first putter embodiment head comprises a lattice structure 530 that partially fills the internal cavity 520. The lattice structure 530 extends from a central reference sphere 554 border surface to the periphery (edges) of the club head 500. The lattice structure 530 ends at the internal surface 524 of the club head (i.e. the surface which encloses and defines the internal cavity 520) and the boundary wall 525 of the front portion 570 of the club head 500. The density profile of the lattice structure 530 increases radially and linearly away from the central reference sphere 550 towards the skirt 568. The central reference sphere can be approximately centered around the baseline CG position (CG', i.e. location of the CG prior to lattice addition), or the central reference sphere 550 can be centered forward of the baseline CG position (CG').

The lattice structure 530 comprises a density profile which increases from the central reference sphere border surface 554 to the periphery of the club head 500. As described above, the lattice structure 530 comprises a plurality of lattice units 534, each unit 534 having a unit scaffolding 536. The unit scaffolding 536 is formed from connected beams 537 (or scaffolding rods). For the embodiment illustrated in FIGS. 38, each unit scaffolding 536 of the plurality of lattice units 534 can comprise a geometric structure having a shape known as fluorite.

In the embodiment of FIG. 38, the beam thickness (or beam diameter) of the lattice units 534 increases linearly from the central reference sphere border surface 554 to the internal surface 524 that encloses the internal cavity 520. The minimum beam thickness is approximately 0 inches. The maximum beam thickness is approximately 0.078 inch (2 mm). The lattice units 534 with scaffold beams 537 that approach the minimum beam thickness values are adjacent the central reference sphere 550. The lattice units 534 with scaffold beams 537 that approach the maximum beam thickness value are adjacent and/or connected to the skirt 568 at the periphery of the club head 500. The density profile of the lattice structure 530 contributes to the increase in the MOI values of the club head 500.

In the embodiment of FIG. 38, the outer shell 560 can comprise an approximately uniform thickness. In some embodiments, the outer shell thickness can be about 0.020 inch, and the sole thickness can be about 0.040 inch. The inclusion of the lattice structure 530 within portions of the internal cavity 520 can help brace and connect the crown 562, 564, and 566 and the sole 510, to increase durability without adding mass.

Second Putter Embodiment

Figure 39:
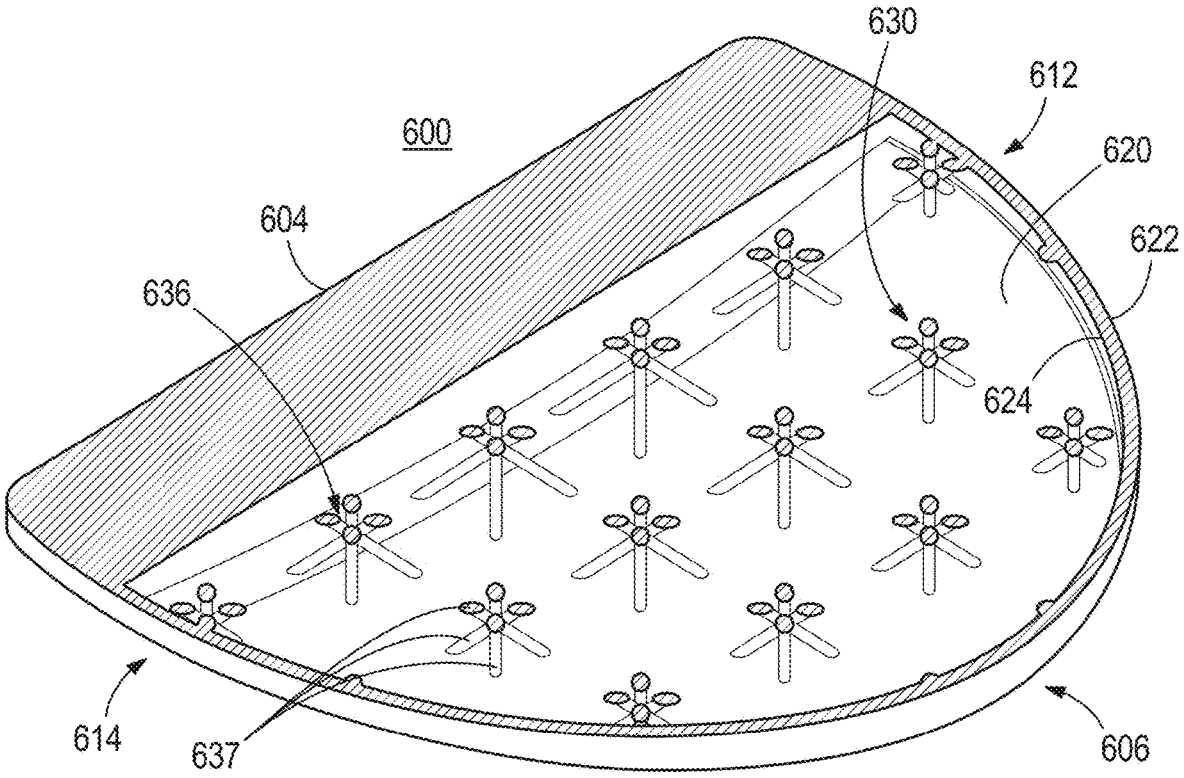
FIG. 39 illustrates a cross-sectional view of a putter-type club head comprising lattice structures according to another embodiment taken along a line in the same position as line K-K of FIG. 33.

Referring to FIG. 39, in a second putter embodiment 600, the latticed region can have a uniform effective density and the lattice structure 630 can occupy the entire internal cavity 620. Similar to the first putter embodiment 500, the lattice structure 630 can be completely internal and not visible from the exterior of the club head 600. The second putter embodiment club head 600 can comprise a thick face 604. The thick face 604 forms the front portion 670 of the club head 600, and can contribute to the forward CG location of the putter.

Referring to FIG. 39, the second putter embodiment club head 600 comprises a lattice structure 630 that fully fills the internal cavity 620. The lattice structure 630 extends uniformly throughout the internal cavity 620. The lattice structure 630 comprises a plurality of lattice units 634. Each lattice unit 634 comprises a unit scaffolding 636, with the remainder of the lattice unit 634 being empty space.

Each unit scaffolding 636 of the plurality of lattice units 634 can comprise beams 637 (or scaffolding rods) interconnecting to form a shape known as fluorite. The beams 637 comprise a beam thickness. The beam thickness of the lattice units 634 is uniform across the plurality of lattice units 634. In some embodiments, the beam thickness is approximately 0.043 inch (1.1 mm).

The outer shell crown thicknesses of the second putter embodiment 600 can be the same as for the first putter embodiment 500. The second putter embodiment club head 600 can comprise a sole thickness that is approximately 0.060 inch (thicker than in the first putter embodiment). The beam thickness, the outer shell thickness, and the sole thickness all affect the durability of the club head 600. The inclusion of the lattice structure 630 within portions of the internal cavity 620 can help brace and connect the crown and the sole, to increase durability without adding mass. In other words, one or both of the crown and sole can be thinner since the lattice structure 630 supports the crown and sole.

Putter Advantages

The lattice structure 530, 630, described herein, allows forward CG placement in a putter head 500, 600. The lattice structure 530, 630 can mine out or replace solid mass with a lower effective density lattice structure 530, 630. The lattice structure 530, 630 can further support the outer shell 560, 660, thus maintaining durability despite the repositioning of mass.

A CG closer to the strikeface (a lower CGz value) reduces a horizontal launch angle on off-center face impacts. The horizontal launch angle is measured off a desired centerline putt path. In other words, the horizontal launch angle quantifies how much the golf ball's initial path away from the strikeface is angled left or right of the hole. A putt with a horizontal launch angle closer to zero will have less offline movement (i.e. a straighter roll) than a putt with a horizontal launch angle further from zero. Therefore, more putts will reach the hole when the horizontal launch angle is closer to zero.

The CG position affects the horizontal launch angle because of the gearing effect that occurs when a golf ball strikes the face. In a putter with a forward CG, a moment arm between the putter CG and the golf ball CG will be shorter than a corresponding moment arm in a putter with a rearward CG. The shorter moment arm reduces the gearing (or rotation) of the club head at impact, thus resulting in less twisting of the strikeface and consequently a less extreme horizontal launch angle. Bringing horizontal launch angle closer to zero also lowers the sidespin imparted to the golf ball at impact, thus further reducing offline movement of the golf ball during the putt.

Blade-type putter heads have CGs that are close to the face due to the narrow geometry of the club head design. Thus, by nature, blade-type putters achieve horizontal launch angles closer to zero than traditional mallet-type putters. The putters with lattice structures, described herein, exhibit near blade-like performance (i.e. blade-like launch, while maintaining the look and feel of a mallet-type putter.

Figure 43:
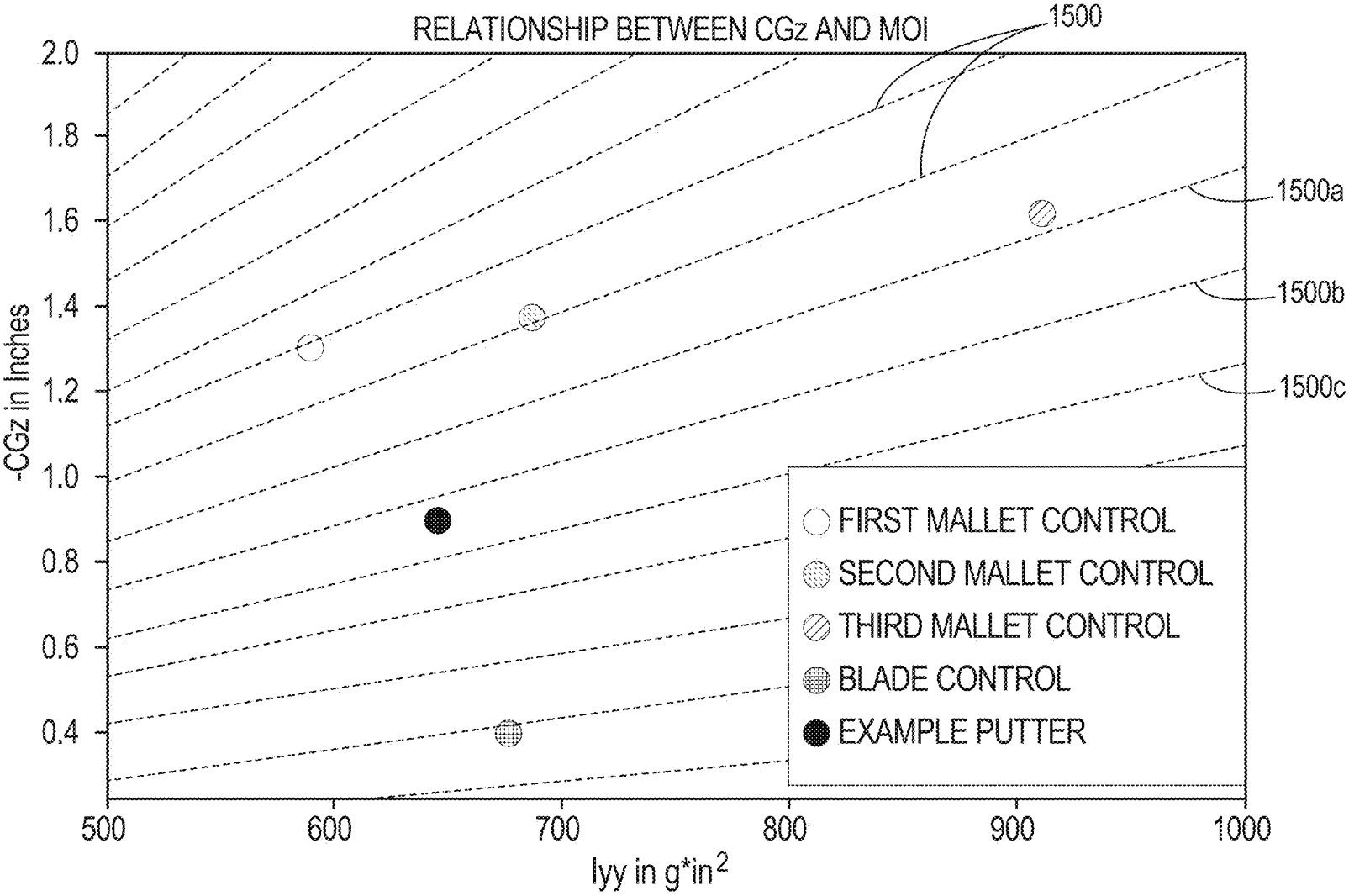
FIG. 43 is a graphical representation of the relationship between Center of Gravity Position and Moment of Inertia for a control club head and a plurality of exemplary putter-type club heads according to the present invention.

Both the CG depth (−CGz) and the Iyy value can influence the horizontal launch angle. In the graph of FIG. 43, −CGz values are graphed against Iyy values. The negative CGz values are graphed, since negative CGz values correspond to the rearward depth of the CG from the origin O.

The contour lines represent lines of constant change in horizontal launch angle per horizontal impact location. The horizontal launch performance is the same along a contour line. As the CG is moved rearward (a more negative CGz, upwards on the graph), Iyy must be increased to achieve the same horizontal launch performance. For example, when a CG is shifted rearwards by half an inch on a putter with an Iyy of approximately 700 g*in$^2$, offsetting the horizontal launch performance would require increasing Iyy to approximately 1000 g*in$^2$.

In the graph of FIG. 43, the lower contour lines, and the regions in between them, are more beneficial for horizontal launch than the higher contour lines and regions. In other words, the lower contour lines represent smaller horizontal launch angles per horizontal impact location. The contour lines can have slopes ranging inclusively between 0.0008 and 0.0035. In some embodiments, the contour lines can have slopes ranging inclusively between 0.0008 and 0.001, 0.001 and 0.002, 0.002 and 0.003, 0.001 and 0.0015, 0.0015 and 0.002, 0.002 and 0.0025, 0.0025 and 0.003, or 0.003 and 0.0035.

Referring to the graph of FIG. 43, some embodiments of the putters described herein can fall within performance regions below the contour line 1500*a* defined by the following equation:

$$CGz=0.0017*Iyy+0.85$$

CGz is measured in inches, and Iyy is measured in g*in$^2$. Some embodiments of the putters described herein can fall within performance regions below the contour line 1500*b* defined by the following equation:

$$CGz=0.0016*Iyy+0.74$$

CGz is measured in inches, and Iyy is measured in g*in$^2$. Some embodiments of the putters described herein can fall within performance regions below the contour line 1500*c* defined by the following equation:

$$CGz=0.0014*Iyy+0.62$$

CGz is measured in inches, and Iyy is measured in g*in$^2$. Falling within performance regions below contour lines 1500*a*, 1500*b*, and/or 1500*c* indicates that a putter will have a straighter roll.

METHOD OF MANUFACTURING

The club head comprising the lattice structure can be formed through any suitable manufacturing process to form a metal body. The club head comprising the lattice structure can be formed from a metal using processes such as casting, die casting, co die casting, additive manufacturing, or metallic 3D printing.

EXAMPLES

Example 1

The POI values Ixy and Ixz were compared between a first exemplary club head 100, a second exemplary club head 200, a third exemplary club head 300, and a control club head. The first exemplary club head 100 was similar to iron-type club head 100 described above. The first exemplary club head comprised an internal cavity with a lattice region comprising a plurality of lattice units of varying density. The density of the plurality of lattice units in the first exemplary club head increased from the sole to the top rail near the toe end of the club head and decreased from the sole to the top rail near the heel end of the club head. Thus, the first exemplary club head comprised a maximum lattice unit density in the high-toe and low-heel regions and a minimum density of lattice units in the low-toe and high-heel regions.

The second exemplary club head 200 was similar to iron-type club head 200 described above. The second exemplary club head comprised an interior cavity with a lattice region comprising a plurality of lattice units of varying density. The density of the plurality of lattice units in the second exemplary club head increased from the strikeface to the rear in the high-heel and low-heel quadrants and decreased from the strikeface to the rear in the high-toe and low-toe quadrants.

The third exemplary club head 300 was similar to iron-type club head 300 described above. The third exemplary club head comprised an internal cavity with a lattice region comprising a plurality of lattice units of varying density. The density of the plurality of lattice units in the third exemplary club head was greatest within a horizontal reference cylinder extending along the X-axis. The third exemplary club head further comprised a first internal mass located within the high-toe quadrant and a second internal mass located within the low-toe quadrant.

The control club head was similar in structure to the first, second and third exemplary club heads. The control club head comprised a body forming a hollow interior cavity. The control head was devoid of any lattice regions within the hollow cavity or other portions of the club head.

The comparison of the products of inertia for the control club and the first, second, and third exemplary club heads is displayed below in Table 1. Table 1 also displays a target value for both Ixy and Ixz that represents the POI values that would create negligible sidespin on shots mis-hit above or below center, given desirable delivery characteristics. For the sake of comparison, all club heads measured were 7-irons.

TABLE 1

| Club Head | Ixy (g*in$^2$) | Ixz (g*in$^2$) |
|---|---|---|
| Target | 55 | −30 |
| Control | −58.92 | −78.28 |
| Exemplary 1 | −14.61 | −77.35 |
| Exemplary 2 | −38.03 | −58.7 |
| Exemplary 3 | −53.59 | −70.9 |

As displayed by the above table, the lattice regions of exemplary club 1 created an increase of Ixy product of inertia of 44.31 g*in$^2$ over the control club. The Ixy product of inertia of exemplary club 1 was 38.9% closer to the "optimized" Ixy product of inertia target value than that of the control club. Exemplary club 1 also resulted in a slight increase in Ixz product of inertia by 0.93 g*in$^2$. The Ixz product of inertia of exemplary club 1 was 1.9% closer to the "optimized" Ixz product of inertia target value than that of the control club.

As further displayed by the above table, the lattice regions of exemplary club 2 created an increase of Ixy product of inertia of 20.89 g*in$^2$ over the control club. The Ixy product of inertia of exemplary club 2 was 18.3% closer to the "optimized" Ixy product of inertia target value than that of the control club. The lattice regions of exemplary club 2 also created an increase of Ixz product of inertia of 19.58 g*in$^2$ over the control club. The Ixz product of inertia of exemplary club 2 was 40.6% closer to the "optimized" Ixz product of inertia target value than that of the control club.

As further displayed by the above table, the lattice regions of exemplary club 3 created a slight increase of Ixy product of inertia by 5.33 g*in$^2$ over the control club. The Ixy product of inertia of exemplary club 3 was 4.7% closer to the "optimized" Ixy product of inertia target value. The lattice regions of exemplary club 3 also created a slight increase of Ixz product of inertia by 7.38 g*in$^2$. The Ixz product of inertia of exemplary club 3 was 15.3% closer to the "optimized" Ixz product of inertia target value.

Figure 40:
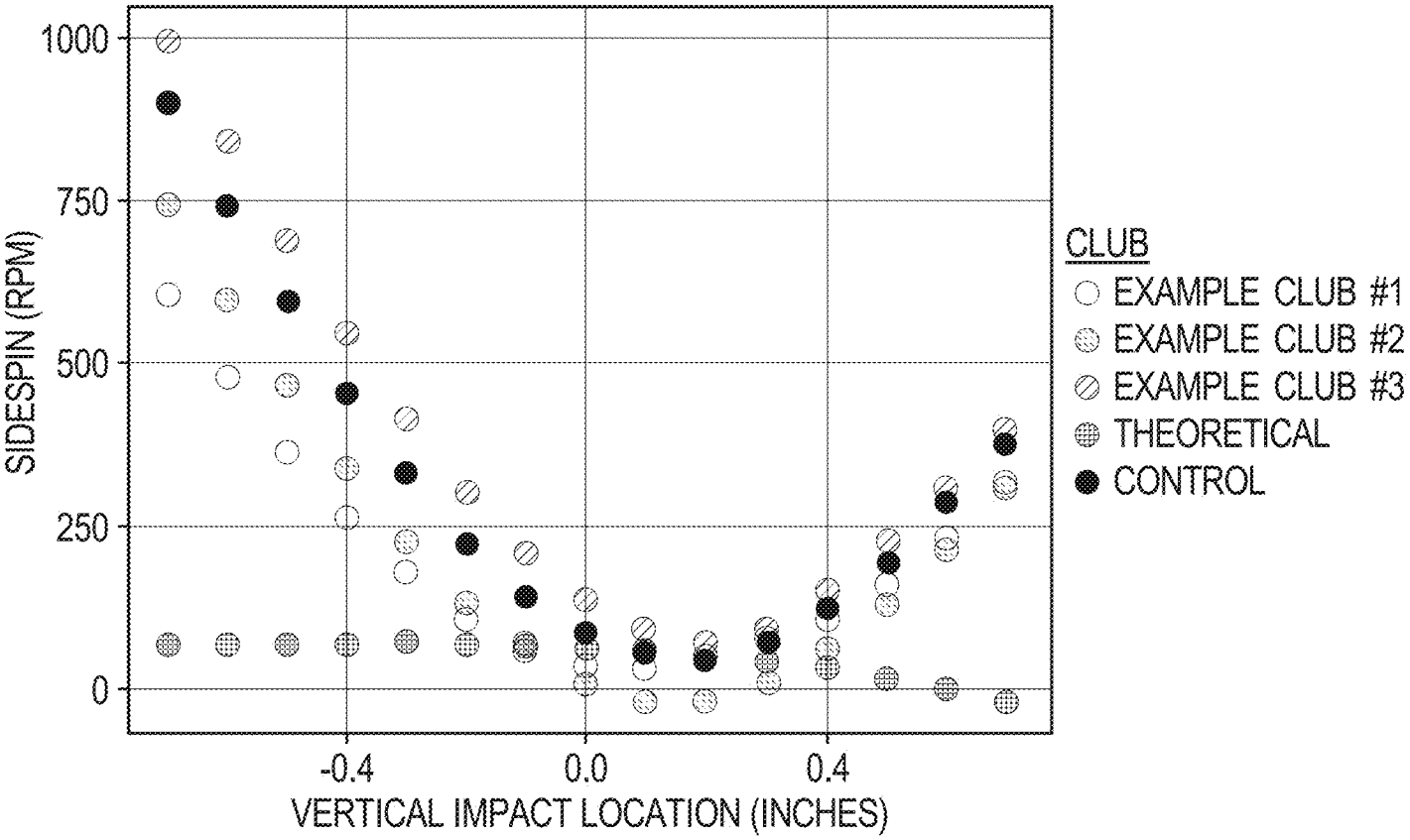
FIG. 40 is a graphical representation of the relationship between vertical impact location and sidespin for a control club head and a plurality of exemplary iron-type club heads according to the present invention.

The increase in product of inertia (both Ixy an Ixz) from the control club to the first, second, and third exemplary clubs resulted changes in the amount of sidespin generated for each club on high and low mis-hits. For each club head, the sidespin of shots struck at different locations in a top-rail-to-sole direction were compared. For each club, the sidespin was measured for shots hit between 0.7 inches above and below center, in increments of 0.1 inch. FIG. 40 and Table 2 below display the results of the comparison of sidespin magnitudes between the various club heads. For reference, FIG. 40 additionally illustrates the simulated sidespin of a theoretical club head whose product of inertia values match the optimal target value. The average sidespin values of each club are displayed for high mis-hits (impact locations 0.1 inch through 0.7 inch), low mis-hits (impact locations −0.1 inch through −0.7 inch), and the total range of impact locations.

TABLE 2

| Location (in.) | Control Sidespin (RPM) | Ex. Club #1 Sidespin (RPM) | Ex. Club #2 Sidespin (RPM) | Ex. Club #3 Sidespin (RPM) |
|---|---|---|---|---|
| 0.7 | 374.1 | 397.3 | 310.1 | 309.8 |
| 0.6 | 277.1 | 306.4 | 215.4 | 226.0 |
| 0.5 | 192.5 | 223.1 | 131.5 | 156.6 |
| 0.4 | 124.4 | 151.0 | 62.6 | 105.2 |
| 0.3 | 76.9 | 93.5 | 12.83 | 75.5 |
| 0.2 | 53.2 | 53.8 | 14.5 | 70.0 |
| 0.1 | 55.6 | 34.4 | 17.0 | 90.2 |
| 0.0 | 85.2 | 37.1 | 6.5 | 136.6 |
| −0.1 | 142.0 | 62.4 | 55.9 | 208.2 |
| −0.2 | 224.3 | 110.0 | 129.5 | 302.6 |
| −0.3 | 329.5 | 178.4 | 224.6 | 416.8 |
| −0.4 | 453.9 | 265.2 | 337.4 | 547.1 |
| −0.5 | 593.6 | 367.4 | 464.0 | 689.3 |
| −0.6 | 744.2 | 481.8 | 600.0 | 839.5 |
| −0.7 | 901.7 | 604.8 | 741.4 | 993.7 |
| Total Average | 308.5 | 224.4 | 221.6 | 344.5 |
| High Average | 164.8 | 179.9 | 109.1 | 147.6 |
| Low Average | 484.2 | 295.7 | 364.7 | 571.0 |

On average, exemplary club head 100 displayed an 84.1 RPM reduction in sidespin over the full range of impact locations (A 27.3% decrease in sidespin over the control club). Further, exemplary club head 1 displayed a 119.7 RPM reduction on low mis-hits (i.e. shots mis-hit between the center of the face and the sole). This is a decrease in sidespin of 38.9% compared to the average sidespin on low mis-hits with the control club. Exemplary club head 1 comprised a 15.1 RPM increase on high mis-hits (a 9.2% increase in sidespin as compared to the control club head). However, the increase in sidespin on high mis-hits is not detrimental to club head performance. When striking a ball with an iron-type club head, players miss low on the face far more often than they miss high. Further, the overall magnitude of sidespin is much more drastic for low mis-hits than for high mis-hits. The large decrease in sidespin on low mis-hits for exemplary club head 1 is worth the trade-off of a small increase in sidespin for high-mis-hits.

On average, exemplary club head 200 displayed an 87.0 RPM reduction in sidespin over the full range of impact locations (A 28.2% decrease in sidespin over the control club). Further, exemplary club head 2 displayed a 55.7 RPM reduction in sidespin on high mis-hits (a 33.8% decrease in sidespin over the control club) and a 119.5 RPM reduction in sidespin on low mis-hits (a 24.7% decrease) when compared to the control club head.

On average, exemplary club head 3 displayed a 35.9 RPM increase in sidespin over the full range of impact locations (An 11.6% increase over the control club). Further, exemplary club head 300 displayed a 17.2 RPM reduction in sidespin on high mis-hits (a 10.4% decrease over the control club) and a 86.9 RPM increase in sidespin on low mis-hits (a 17.9% increase over the control club). Although exemplary club head 300 displayed slight increases to the Ixy and Ixz products of inertia, the overall increase in sidespin demonstrates that the lattice structures must be placed in areas of the club head strategically in order to provide performance benefits.

The decreased sidespin observed in the first exemplary club head 100 and the second exemplary club head 200 will generally result in mis-hits that will travel further and straighter. For the first exemplary club head 100, which comprised an increased Ixy but a similar Ixz in comparison to the control club, the increased Ixy influenced the ball to draw on both high and low mis-hits. Without an increase in Ixz to provide a fade influence, high mis-hits on exemplary club head 100 comprised more fade spin than the control club. However, as stated above, the exemplary club head 100 is still desirable over the control club due to the fact that low mis-hits are far more common in an iron-type club head than high mis-hits.

The second exemplary club head 200 comprised improvements to both Ixy and Ixz with respect to the control club. The combination of the improved Ixy and Ixz lead to reduction in spin for both high and low mis-hits. The combination of the draw influence of improving Ixy and the fade influence of improving Ixz resulted in reduced sidespin at every impact location.

These decreased sidespin values of the first and second exemplary club heads 100, 200 are a direct result of the enhanced mass properties (specifically increased products of inertia that more closely match predetermined target values) of the exemplary club heads achieved by the inclusion of the various lattice regions. By further increasing the products of inertia of the club head through other lattice arrangements, undesirable sidespin can be reduced even further.

Although exemplary club head 300 displayed slight increases to both Ixy and Ixz, the average sidespin increased relative to the control club. As discussed above, the intent of exemplary club head 300 was to increase Ixy and Ixz while providing a CG position toe-ward of the other embodiments. However, reposition the CG resulted in adverse effects on the sidespin. The sidespin results of exemplary club head 300 illustrate the challenge of balancing POI with other desirable design parameters.

Example 2

A mallet control putter and a blade control putter were compared to four examples (or variations) of the first putter embodiment, described above, to determine MOI values, CG position, and simulated horizontal launch angle. The mallet control putter was a stock putter that lacked a hollow interior cavity and lacked a lattice structure. The mallet control putter was roughly the same size and shape as the four exemplary putters, described below. The mallet control putter and the four example putters were all mallet-type putters. The mallet putters were also compared to the blade control.

When comparing properties related to weight distribution within a golf club head, it is desirable to maintain a similar total mass across the compared club heads. As shown in Table III below, the studied mallet club heads had roughly equivalent masses. The blade control has a lower mass due to its size.

A first example putter was a version of the first putter embodiment, described above and illustrated in FIGS. 33-38. The central reference sphere was centered about the baseline CG position in the first example putter. The unit scaffolding comprised a fluorite beam structure. The density of the lattice structure increased linearly towards the skirt or perimeter of the putter.

A second example putter, not illustrated, was a version of the first putter embodiment, described above. The second example putter was the same as the first example putter, except that the central reference sphere was centered about a point in front of the baseline CG position. This position of the central reference sphere moved the CG rearwards, as indicated in Table III below. The unit scaffolding comprised a fluorite beam structure. The density of the lattice structure increased linearly towards the skirt or perimeter of the putter.

A third example putter, not illustrated, was a version of the first putter embodiment, described above. The third example putter was the same as the first example putter, except that the unit scaffolding comprised a re-entrant beam structure in the third example putter. The density of the lattice structure increased linearly towards the skirt of the putter.

A fourth example putter, not illustrated, was a version of the first putter embodiment, described above. The fourth example putter was the same as the first example putter, except that the unit scaffolding comprised a diamond beam structure in the fourth example putter. The density of the lattice structure increased linearly towards the skirt of the putter.

Relative to the mallet control putter, all four exemplary putters exhibited higher MOIs and CG positions closer to the strikeface. Referring to Table III, the MOI in the x-axis direction (heel-to-toe), Ixx, was greater in the first, second, third, and fourth putter heads than in the mallet control putter head. A greater Ixx value results in more forgiveness when a golf ball impacts the face off-center. In some embodiments, the increased forgiveness can lower the offline carry of the golf ball during the putt.

Referring to Table III, the MOI in the y-axis direction (sole-to-crown), Iyy, was greater in the first, second, third, and fourth example putter heads than in the control putter head. A greater Iyy value results in more forgiveness when a golf ball impacts the strikeface above or below the engineered impact location, which is typically at the geometric centerpoint of the strikeface.

Referring to Table III, the MOI in the z-axis direction (front-to-rear), Izz, was greater in the first, second, third, and fourth putter heads than in the control putter head. A greater Izz value is caused by concentrating more weight in the extreme front and extreme rear of the putter head. The internal cavity with a lattice structure in the first, second, third, and fourth example putter heads removed mass from the center of the club head and redistributed it towards the periphery to increase the Izz compared to the control putter head. A higher Izz can benefit players with certain putt stroke types.

Referring to Table III, the CGs of the first, second, third, and fourth example putter heads were closer to the strikeface than the rear, compared to the CG position of the mallet control putter head.

TABLE III

| Club Head | Lattice Type | Mass (g) | Ixx ($g*in^2$) | Iyy ($g*in^2$) | Izz ($g*in^2$) | CGz (inches) |
|---|---|---|---|---|---|---|
| Mallet Control | None | 361.4 | 395.5 | 590.1 | 227.6 | −1.379 |
| First Example | Fluorite | 366.3 | 455.3 | 645.7 | 240.6 | −0.901 |
| Second Example | Fluorite | 368.1 | 454.8 | 668.1 | 263.4 | −0.937 |
| Third Example | Re-entrant | 366.8 | 456.5 | 661.2 | 253.8 | −0.923 |
| Fourth Example | Diamond | 366.5 | 452.7 | 663.9 | 261.2 | −0.932 |
| Blade Control | None | 351.3 | 308.3 | 651.5 | 891.3 | −0.039 |

Industry models were used to correlate CG location to horizontal launch angle. As described above, placing the CG closer to the strikeface (a lower CGz value) reduced the horizontal launch angle on off-center face impacts, which in turn reduced the sidespin imparted to the golf ball.

Figure 41:
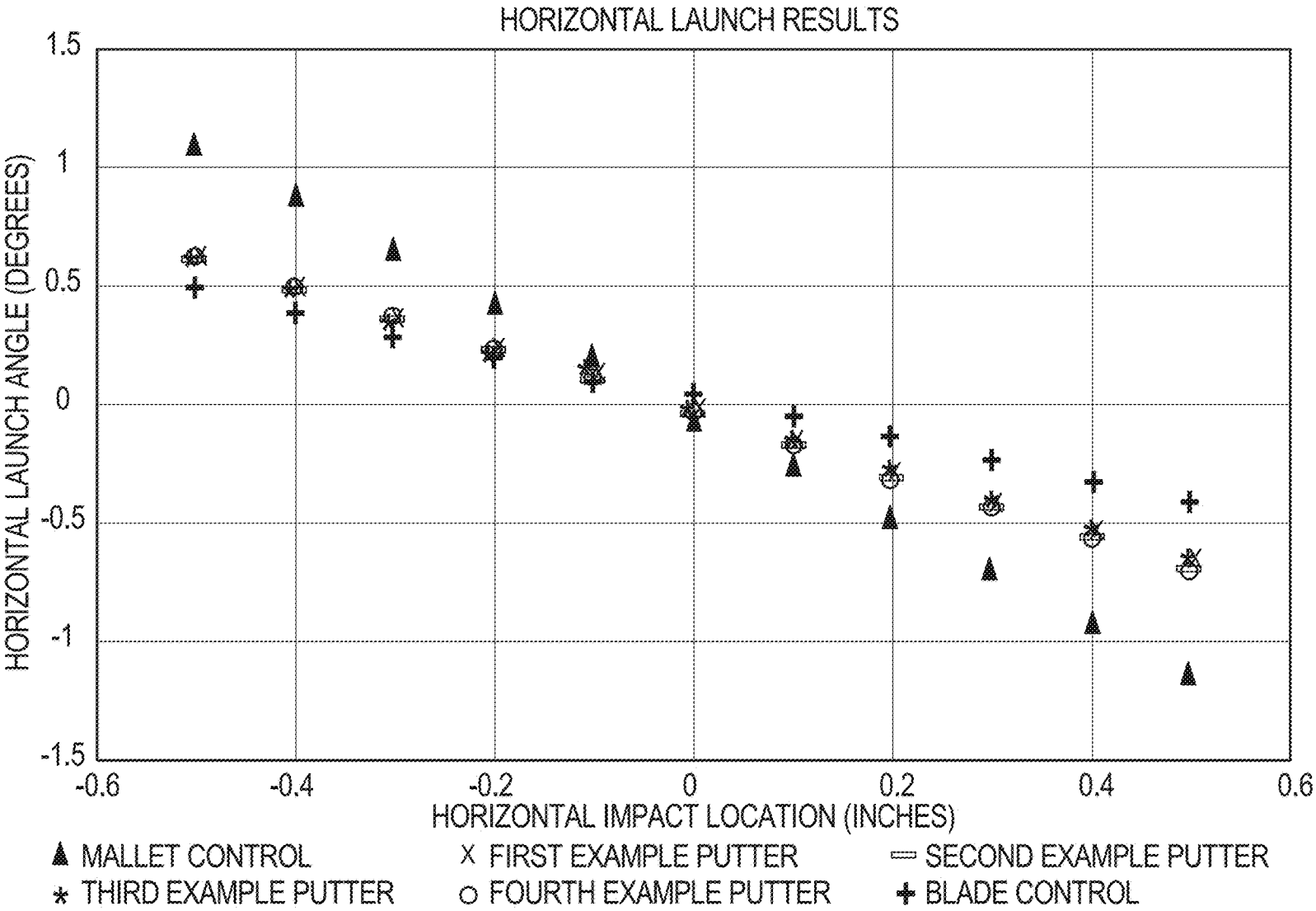
FIG. 41 is a graphical representation of the relationship between horizontal impact location and horizontal launch angle for a control club head and a plurality of exemplary putter-type club heads according to the present invention.

In FIG. 41, the horizontal launch angle imparted to a golf ball is graphed against the horizontal impact location on the strikeface for the compared putter heads. It is desirable to minimize the horizontal launch angle to reduce offline displacement of the putt. The blade control putter head outperformed the other club heads with respect to horizontal launch angle, due to the blade control's forward CG position. Among the mallet-type putters, the first, second, third, and fourth example club heads outperformed the mallet control.

As illustrated in FIG. 41, the first, second, third, and fourth example putters achieved horizontal launch angles that are closer to zero than the mallet control, especially on off-center impacts. For example, the first, second, third, and fourth example putters achieved a horizontal launch angle of approximately 0.5 degree for an impact location of −0.5 inch, whereas the mallet control exhibited a horizontal launch angle of approximately 0.75 degree for the same impact location. For simulated sidespin values, the blade outperformed (i.e. generated less sidespin on off-center shots than) the example club heads, and the example club heads outperformed the mallet control.

There was minimal performance difference between the example club heads, showing that various lattice types can be used to achieve the desired launch angle characteristics. The first, second, third, and fourth example club heads achieved beneficial horizontal launch angle values close to that of blade-type putters, while maintaining the look and feel of mallet-type putters.

Example 3

A mallet control putter and a blade control putter were compared to an example of the first putter embodiment and an example of the second putter embodiment, described above, to determine MOI values, CG position, and simulated horizontal launch angle. The mallet control putter was similar to the mallet control putter described above in Example 2. The blade control putter was similar to the putter control putter in Example 2. The first example putter was similar to the first example putter described above in Example 2. The second example putter was similar to the second embodiment of a putter, described above.

The second example putter comprised a lattice structure with a uniform density. The lattice structure filled the internal cavity of the putter. The second example putter comprised a solid face, a 1 mm thick crown, and a 1.5 mm thick sole. When comparing properties related to weight distribution within a golf club head, it is desirable to maintain a similar total mass across the compared club heads. As shown in Table IV below, the studied mallet club heads had roughly equivalent masses.

Referring to Table IV, the MOIs (Ixx, Iyy, and Izz) of the first and second example putter heads were higher than the respective MOIs of the mallet control putter head. Since the first example putter head has a lattice with a varying density that increases towards the periphery, the first example putter head has slightly higher MOIs than the second example putter head, which has a uniform lattice density. The CGs of the first and second example putter heads were closer to the strikeface than the rear, compared to the CG position of the mallet control putter head.

TABLE IV

| Club Head | Mass (g) | Ixx ($g*in^2$) | Iyy ($g*in^2$) | Izz xx ($g*in^2$) | CGz (inches) |
|---|---|---|---|---|---|
| Mallet Control | 361.4 | 395.5 | 590.1 | 227.6 | −1.379 |
| First Example | 366.3 | 455.3 | 645.7 | 240.6 | −0.901 |
| Second Example | 370.2 | 413.2 | 593.1 | 237.6 | −0.836 |
| Blade Control | 351.3 | 308.3 | 651.5 | 891.3 | −0.039 |

Figure 42:
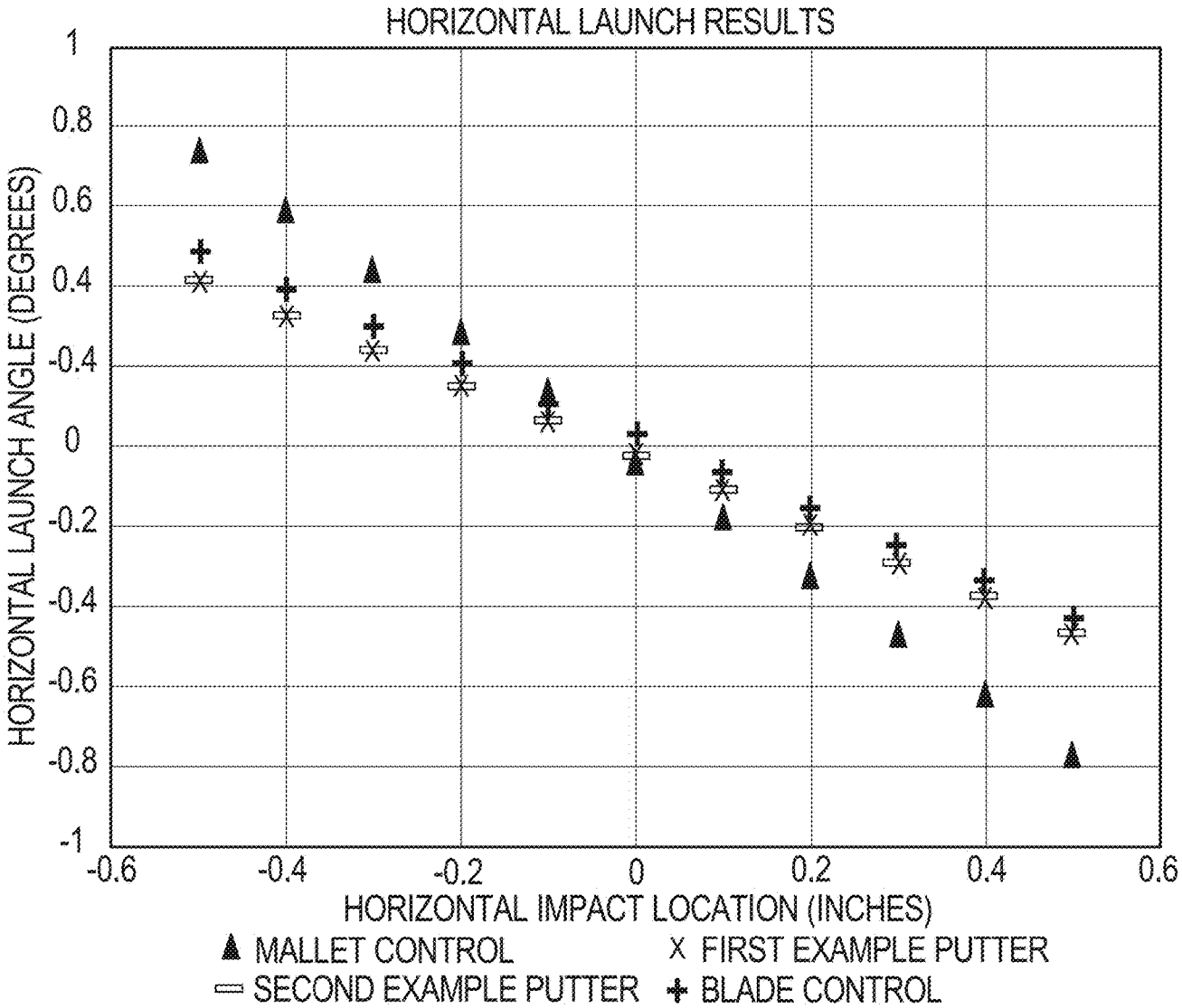
FIG. 42 is a graphical representation of the relationship between horizontal impact location and sidespin for a control club head and a plurality of exemplary putter-type club heads according to the present invention.

Industry models were used to correlate CG location to horizontal launch angle. As illustrated in the graph of FIG. 42, the horizontal launch angle was closer to zero for the first and second example club heads than for the mallet control. The blade control exhibited horizontal launch angle values closer to zero than all three mallet-type putter heads. There was minimal performance difference between the example club heads, showing that various lattice density profiles can be used to achieve the desired launch angle characteristics. The first and second example club heads achieved beneficial horizontal launch angle values close to that of blade-type putters, while maintaining the look and feel of mallet-type putters.

Example 4

A simulation study was done to assess horizontal launch angle performance of a first mallet control, a second mallet control, a third mallet control, a blade control, and an example putter head. The first mallet control was similar to the first mallet controls of Examples 2 and 3 above ("Oslo" putter). The second mallet control comprised heel and toe weights that yielded a higher Iyy value than the first mallet control ("Ketch" putter). The third mallet control was a multi-material, aluminum and steel, club head with extreme heel and toe weighting ("Tomcat 14" putter). The third mallet control exhibited an Iyy value higher than both the first and second example mallets. The blade control was similar to the blade controls of Examples 2 and 3 above ("Anser" putter).

In the graph of FIG. 43, since the lower contour lines represent smaller horizontal launch angles for a constant location on the strikeface, the blade control exhibited the best horizontal launch. More specifically, the blade control is within a low region of the graph (i.e. good performance), due to its forward CG location. The shape of the blade control allows it to achieve an extreme forward CG compared to the mallets. The first, second, and third mallet controls exhibited the worst horizontal launch per horizontal impact location. These three mallet controls are within a high region of the graph (i.e. poor performance), due to their rearward CG locations. The high Iyy value of the third mallet control slightly improved its performance, putting it in a region below (i.e. slightly better performance) the first and second mallet controls. However, even though the third mallet control had an Iyy over 200 $g*in^2$ greater than the second mallet control, the third mallet control was unable to achieve the horizontal launch performance equivalent to the example putter head.

The example club head comprised a CG location between that of the blade control and the mallet controls. Therefore, the example club head exhibited a horizontal launch per horizontal impact location better than the mallet controls and slightly worse than the blade control. The example club head performed partially like a blade-type putter, while maintaining the look and feel of a mallet-type putter.

As the rules to golf may change from time to time (e.g., new regulations may be adopted or old rules may be eliminated or modified by golf standard organizations and/or governing bodies), golf equipment related to the methods, apparatus, and/or articles of manufacture described herein may be conforming or non-conforming to the rules of golf at any particular time. Accordingly, golf equipment related to the methods, apparatus, and/or articles of manufacture described herein may be advertised, offered for sale, and/or sold as conforming or non-conforming golf equipment. The methods, apparatus, and/or articles of manufacture described herein are not limited in this regard.

Although a particular order of actions is described above, these actions may be performed in other temporal sequences. For example, two or more actions described above may be performed sequentially, concurrently, or simultaneously. Alternatively, two or more actions may be performed in reversed order. Further, one or more actions described above may not be performed at all. The apparatus, methods, and articles of manufacture described herein are not limited in this regard.

While the invention has been described in connection with various aspects, it will be understood that the invention is capable of further modifications. This application is intended to cover any variations, uses or adaptation of the invention following, in general, the principles of the invention, and including such departures from the present disclosure as come within the known and customary practice within the art to which the invention pertains.

The invention claimed is:

1. A golf club head comprising:

a face;

a rear;

a toe end;

a heel end opposite the toe end;

a top rail;

a sole opposite the top rail;

a hosel; and a latticed region comprising a plurality of lattice units, each lattice unit comprising a unit scaffolding surrounded by empty space;

wherein:

the golf club head comprises a head volume, a head mass, and a center of gravity;

the latticed region comprises a total lattice volume and a lattice mass;

the total lattice volume is bounded by a surface that is defined by a plurality of perimeter-most points of the plurality of lattice units;

the face, the rear, the top rail, and the sole enclose an internal cavity;

a y-axis extends through the center of gravity from the top rail to the sole;

an x-axis extending through the center of gravity from the heel end to the toe end, wherein the x-axis is perpendicular to the y-axis;

a z-axis extending through the center of gravity from the face to the rear, wherein the z-axis is perpendicular to the y-axis and the x-axis;

the golf club head comprises a plurality of quadrants including a high-toe quadrant, a low-toe quadrant, a high-heel quadrant, and a low-heel quadrant; wherein the plurality of quadrants are divided by the x-axis and the y-axis;

an effective density of the latticed region equals the mass divided by the total lattice volume;

the effective density of the latticed region varies between 0 g/mm$^3$ and 0.0075 g/mm$^3$;

the effective density of the latticed region is greater within the high-toe quadrant and the low-heel quadrant than within the low-toe quadrant and the high-heel quadrant;

the golf club head has a top rail to sole moment of inertia Iyy, a heel to toe moment of inertia Ixx, a face to rear moment of inertia Izz, a product of inertia Ixy about the x-axis and y-axis and a product of inertia Ixz about the x-axis and the z-axis;

the Ixy product of inertia is between −10 g·in$^2$ and −40 g·in$^2$; and the Ixz product of inertia is between −25 g·in$^2$ and −65 g·in$^2$; and wherein:

from a front view, the low-heel quadrant is bounded by a line defined, with reference to the y-axis and the x-axis, by the equation: y=(0.35/x);

from the front view, the high toe quadrant is bounded by a line defined, with reference to the y-axis and the x-axis, by the equation: y=(0.35/x);

from the front view, the high-heel quadrant is bounded by a line defined, with reference to the y-axis and the x-axis, by the equation: y=−(0.35/x); and from the front view, the low-toe quadrant is bounded by a line defined, with reference to the y-axis and the x-axis, by the equation: y=−(0.35/x), wherein x and y are measured in inches.

2. The golf club head of claim 1, wherein:

the latticed region within at least a portion of the high-toe quadrant and the low-heel quadrant has an effective density inclusively between 0.006 g/mm$^3$ and 0.0075 g/mm$^3$.

3. The golf club head of claim 1, wherein:

the latticed region within at least a portion of the low-toe quadrant and the high-heel quadrant has an effective density between 0.0001 g/mm$^3$ and approximately 0.00075 g/mm$^3$.

4. The golf club head of claim 3, wherein:

the latticed region within at least a portion of the low-toe quadrant and the high-heel quadrant has an effective density less than 0.0005 g/mm$^3$.

5. The golf club head of claim 1, wherein:

the Ixy product of inertia is between −20 g·in$^2$ and −5 g·in$^2$; and the Ixz product of inertia is between −50 g·in$^2$ and −65 g·in$^2$.

6. The golf club head of claim 1, wherein:

each lattice unit of the plurality of lattice units comprises a unit scaffolding structure selected from the group consisting of: simple cubic, body centered cubic, face centered cubic, column, columns, diamond, fluorite, octet, truncated cube, truncated octahedron, kelvin cell, IsoTruss, re-entrant, weaire-phelan, triangular honeycomb, triangular honeycomb rotated, hexagonal honeycomb, re-entrant honeycomb, square honeycomb rotate, square honeycomb, face centered cubic foam, body centered cubic foam, simple cubic foam, hex prism diamond, hex prism edge, hex prism vertex centroid, hex prism central axis edge, hex prism laves phase, tet oct vertex centroid, and oct vertex centroid.

7. The golf club head of claim 1, wherein:

the latticed region comprises between 10 and 50 lattice units; and each lattice unit of the plurality of lattice units comprises a cubic shape with sides measuring between 5 mm and 10 mm.

8. The golf club head of claim 1, wherein the unit scaffolding of each lattice unit of the plurality of lattice units connects to the unit scaffolding of an adjacent lattice unit.

9. The golf club head of claim 1, wherein:

the unit scaffolding of each lattice unit comprises beams; and the beams comprise thicknesses ranging inclusively between 0.5 mm and 5 mm.

10. The golf club head of claim 1, wherein:

the golf club head is integrally formed from a material selected from the group consisting of: a titanium alloy, a steel alloy, an aluminum alloy, and an amorphous metal alloy.

11. A golf club head comprising:

a face;

a rear;

a toe end;

a heel end opposite the toe end;

a top rail;

a sole opposite the top rail;

a hosel; and a latticed region;

wherein:

the golf club head comprises a head volume, a head mass, and a center of gravity;

the face, the rear, the top rail, and the sole enclose an internal cavity;

the latticed region comprises a total lattice volume and a lattice mass;

the total lattice volume is bounded by a surface that is defined by a plurality of perimeter-most points of the plurality of lattice units;

the total latticed region volume is bounded by a surface that is defined by a plurality of perimeter-most points of the latticed region;

a y-axis extends through the center of gravity from the top rail to the sole;

an x-axis extending through the center of gravity from the heel end to the toe end, wherein the x-axis is perpendicular to the y-axis;

a z-axis extending through the center of gravity from the face to the rear, wherein the z-axis is perpendicular to the y-axis and the x-axis;

a high-heel region comprises the hosel and a portion of the heel end and the top rail;

the high-heel region is located above and towards the heel end from the center of gravity;

a low-heel region comprises a portion of the heel end and the sole;

the low-heel region is located below and towards the heel end from the center of gravity;

a high-toe region comprises a portion of the toe end and the top rail;

the high-toe region is located above and towards the toe end from the center of gravity;

a low-toe region comprises a portion of the toe end and the sole;

the low-toe region is located below and towards the toe end from the center of gravity;

the high-heel region comprises a high-heel thinned lattice;

the low-toe region comprises a low-toe thinned lattice;

an effective density of the lattice array equals the mass divided by the total lattice array volume;

the effective density of the lattice array varies between 0 $g/mm^3$ and 0.0075 $g/mm^3$;

the effective density of the latticed region is greater within the high-toe region and the low-heel region than within the low-toe region and the high-heel region;

the latticed region comprises a plurality of lattice units, each lattice unit comprising a unit scaffolding surrounded by empty space;

the golf club head has a top rail to sole moment of inertia Iyy, a heel to toe moment of inertia Ixx, a face to rear moment of inertia Izz, a product of inertia Ixy about the x-axis and y-axis, and a product of inertia Ixz about the x-axis and the z-axis;

the Ixy product of inertia is between −10 $g \cdot in^2$ and −40 $g \cdot in^2$; and the Ixz product of inertia is between −25 $g \cdot in^2$ and −65 $g \cdot in^2$; and wherein:

from a front view, the low-heel region is bounded by a line defined, with reference to the y-axis and the x-axis, by the equation: $y=(0.35/x)$;

from the front view, the high-toe region is bounded by a line defined, with reference to the y-axis and the x-axis, by the equation: $y=(0.35/x)$;

from the front view, the high-heel region is bounded by a line defined, with reference to the y-axis and the x-axis, by the equation: $y=-(0.35/x)$; and from the front view, the low-toe region is bounded by a line defined, with reference to the y-axis and the x-axis, by the equation: $y=-(0.35/x)$, wherein x and y are measured in inches.

12. The golf club head of claim 11, wherein:

the latticed region within at least a portion of the high-toe region and the low-heel region has an effective density inclusively between 0.006 $g/mm^3$ and 0.0075 $g/mm^3$.

13. The golf club head of claim 11, wherein:

the Ixy product of inertia is between 20 $g \cdot in^2$ and −5 $g \cdot in^2$; and the Ixz product of inertia is between −50 $g \cdot in^2$ and −65 $g \cdot in^2$.

14. The golf club head of claim 11, wherein:

each lattice unit of the plurality of lattice units comprises a unit scaffolding structure selected from the group consisting of: simple cubic, body centered cubic, face centered cubic, column, columns, diamond, fluorite, octet, truncated cube, truncated octahedron, kelvin cell, IsoTruss, re-entrant, weaire-phelan, triangular honeycomb, triangular honeycomb rotated, hexagonal honeycomb, re-entrant honeycomb, square honeycomb rotate, square honeycomb, face centered cubic foam, body centered cubic foam, simple cubic foam, hex prism diamond, hex prism edge, hex prism vertex centroid, hex prism central axis edge, hex prism laves phase, tet oct vertex centroid, and oct vertex centroid.

15. The golf club head of claim 11, wherein:

the latticed region comprises between 10 and 50 lattice units; and each lattice unit of the plurality of lattice units comprises a cubic shape with sides measuring inclusively between 10 mm and 5 mm.

16. The golf club head of claim 11, wherein the unit scaffolding of each lattice unit of the plurality of lattice units connects to the unit scaffolding of an adjacent lattice unit.

17. The golf club head of claim 11, wherein:

the unit scaffolding of each lattice unit comprises beams; and the beams comprise thicknesses ranging inclusively between 0.5 mm and 5 mm.

18. The golf club head of claim 11, wherein:

the latticed region within at least a portion of the high-toe region and the low-heel region has an effective density inclusively between 0.006 $g/mm^3$ and 0.0075 $g/mm^3$.

19. A golf club head comprising:

a face;

a rear;

a toe end;

a heel end opposite the toe end;

a top rail;

a sole opposite the top rail;

a hosel;

a latticed region comprising a plurality of lattice units, each lattice unit comprising a unit scaffolding surrounded by empty space;

wherein:

the golf club head comprises a total volume, a total mass, and a center of gravity;

the face, the rear, the top rail, and the sole enclose an internal cavity;

the latticed region is located within the internal cavity;

the latticed region comprises a lattice mass, a total latticed region volume, a filled volume;

the filled volume is the volume occupied by the unit scaffolding of the plurality of lattice units; and the filled volume is between 5% and 50% of the total latticed region volume;

each lattice unit comprises a total unit volume, a filled unit volume, and an effective density;

across the plurality of lattice units, an increase in the filled unit volume of each lattice unit increases the effective density of said lattice unit;

the effective density of the plurality of lattice units increases from the sole towards the top rail of the golf club head within a region that is towards the toe end from the center of gravity;

the effective density of the plurality of lattice units decreases from the sole towards the top rail of the golf club head within a region that is towards the heel end from the center of gravity;

a y-axis extends through the center of gravity from the top rail to the sole;

an x-axis extending through the center of gravity from the heel end to the toe end, wherein the x-axis is perpendicular to the y-axis;

a z-axis extending through the center of gravity from the face to the rear, wherein the z-axis is perpendicular to the y-axis and the x-axis;

the golf club head comprises a plurality of regions including a high-toe region, a low-toe region, a high-heel region, and a low-heel region; wherein the plurality of regions are divided by the x-axis and the y-axis;

the golf club head has a top rail to sole moment of inertia Iyy, a heel to toe moment of inertia Ixx, a face to rear moment of inertia Izz, a product of inertia Ixy about the x-axis and y-axis, and a product of inertia Ixz about the x-axis and the z-axis;

the Ixy product of inertia is between −10 $g \cdot in^2$ and −40 $g \cdot in^2$; and the Ixz product of inertia is between −25 $g \cdot in^2$ and −65 $g \cdot in^2$; and wherein:

from a front view, the low-heel region is bounded by a line defined, with reference to the y-axis and the x-axis, by the equation: $y=(0.35/x)$;

from the front view, the high-toe region is bounded by a line defined, with reference to the y-axis and the x-axis, by the equation: $y=(0.35/x)$;

from the front view, the high-heel region is bounded by a line defined, with reference to the y-axis and the x-axis, by the equation: $y=-(0.35/x)$; and from the front view, the low-toe region is bounded by a line defined, with reference to the y-axis and the x-axis, by the equation: $y=-(0.35/x)$, wherein x and y are measured in inches.

20. The golf club head of claim 19, wherein:

the Ixy product of inertia is-between 20 $g \cdot in^2$ and −5 $g \cdot in^2$; the Ixz product of inertia is between −50 $g \cdot in^2$ and −65 $g \cdot in^2$.

21. The golf club head of claim 19, wherein:

the latticed region within at least a portion of the high-toe region and the low-heel region has an effective density inclusively between 0.006 $g/mm^3$ and 0.0075 $g/mm^3$.

* * * * *